US009887465B2

(12) United States Patent
Gummalla et al.

(10) Patent No.: US 9,887,465 B2
(45) Date of Patent: Feb. 6, 2018

(54) SINGLE-LAYER METALIZATION AND VIA-LESS METAMATERIAL STRUCTURES

(71) Applicant: Tyco Electronics Services GMBH, Schaffhausen (CH)

(72) Inventors: Ajay Gummalla, Sunnyvale, CA (US); Maha Achour, Encinitas, CA (US); Cheng Jung Lee, Santa Clara, CA (US); Vaneet Pathak, Palo Alto, CA (US); Gregory Poilasne, El Cajon, CA (US)

(73) Assignee: Tyco Electronics Services GmbH (CH)

( * ) Notice: Subject to any disclaimer, the term of this patent is extended or adjusted under 35 U.S.C. 154(b) by 250 days.

(21) Appl. No.: 13/932,998

(22) Filed: Jul. 1, 2013

(65) Prior Publication Data

US 2014/0022133 A1 Jan. 23, 2014

Related U.S. Application Data

(62) Division of application No. 12/250,477, filed on Oct. 13, 2008, now Pat. No. 8,514,146.

(60) Provisional application No. 60/979,384, filed on Oct. 11, 2007, provisional application No. 60/987,750, filed on Nov. 13, 2007, provisional application No. 61/024,876, filed on Jan. 30, 2008, provisional application No. 61/091,203, filed on Aug. 22, 2008.

(51) Int. Cl.

| | |
|---|---|
| ***H01Q 15/08*** | (2006.01) |
| ***H01Q 1/38*** | (2006.01) |
| ***H01Q 5/307*** | (2015.01) |

(52) U.S. Cl.

CPC ..... *H01Q 15/08* (2013.01); *H01Q 1/38* (2013.01); *H01Q 5/307* (2015.01)

(58) Field of Classification Search

CPC ..... H01Q 15/08
USPC ..... 343/745, 911
See application file for complete search history.

(56) References Cited

U.S. PATENT DOCUMENTS

| | | | | |
|---|---|---|---|---|
| 4,014,024 | A | 3/1977 | Parker et al. | |
| 4,565,984 | A * | 1/1986 | Castera | H03H 2/001 310/26 |
| 5,511,238 | A | 4/1996 | Bayraktaroglu | |
| 5,874,915 | A | 2/1999 | Lee et al. | |
| 6,005,515 | A | 12/1999 | Allen et al. | |
| 6,366,254 | B1 | 4/2002 | Sievenpiper et al. | |
| 6,489,927 | B2 | 12/2002 | LeBlanc et al. | |
| 6,512,494 | B1 | 1/2003 | Diaz et al. | |
| 6,525,695 | B2 | 2/2003 | McKinzie, III | |

(Continued)

FOREIGN PATENT DOCUMENTS

| | | | |
|---|---|---|---|
| CN | 101542838 | B | 3/2013 |
| JP | 50037323 | A | 4/1975 |

(Continued)

OTHER PUBLICATIONS

"U.S. Appl. No. 12/914,936, Supplemental Notice of Allowability dated Nov. 7, 2013", 2 pgs.

(Continued)

*Primary Examiner* — Dameon E Levi
*Assistant Examiner* — Walter Davis

(57) ABSTRACT

Techniques and apparatus based on metamaterial structures provided for antenna and transmission line devices, including single-layer metallization and via-less metamaterial structures.

29 Claims, 49 Drawing Sheets

(56) References Cited

U.S. PATENT DOCUMENTS

| | | | | |
|---|---|---|---|---|
| 6,545,647 | B1 | 4/2003 | Sievenpiper et al. | |
| 6,774,850 | B2 | 8/2004 | Chen | |
| 6,842,140 | B2 | 1/2005 | Killen et al. | |
| 6,859,114 | B2 | 2/2005 | Eleftheriades et al. | |
| 6,897,831 | B2 | 5/2005 | McKinzie | |
| 6,906,674 | B2 | 6/2005 | McKinzie et al. | |
| 6,943,731 | B2 | 9/2005 | Killen et al. | |
| 6,950,069 | B2 | 9/2005 | Gaucher et al. | |
| 6,958,729 | B1 | 10/2005 | Metz | |
| 6,995,711 | B2 | 2/2006 | Killen et al. | |
| 7,068,234 | B2 | 6/2006 | Sievenpiper | |
| 7,071,889 | B2 | 7/2006 | McKinzie et al. | |
| 7,193,562 | B2 | 3/2007 | Shtrom et al. | |
| 7,205,941 | B2 | 4/2007 | Wang et al. | |
| 7,215,007 | B2 | 5/2007 | McKinzie, III et al. | |
| 7,224,241 | B2 | 5/2007 | Jue | |
| 7,256,753 | B2 | 8/2007 | Werner et al. | |
| 7,330,090 | B2 | 2/2008 | Itoh et al. | |
| 7,358,915 | B2 | 4/2008 | Legay et al. | |
| 7,391,288 | B1 | 6/2008 | Itoh et al. | |
| 7,429,961 | B2 | 9/2008 | Sievenpiper et al. | |
| 7,446,712 | B2 | 11/2008 | Itoh et al. | |
| 7,453,328 | B2 | 11/2008 | Jue | |
| 7,463,213 | B2 | 12/2008 | Nakano et al. | |
| 7,482,893 | B2 | 1/2009 | Itoh et al. | |
| 7,592,957 | B2 | 9/2009 | Achour et al. | |
| 7,764,232 | B2 | 7/2010 | Achour et al. | |
| 7,839,236 | B2 | 11/2010 | Dupuy et al. | |
| 7,847,739 | B2 | 12/2010 | Achour et al. | |
| 7,855,696 | B2 | 12/2010 | Gummalla et al. | |
| 7,911,386 | B1 | 3/2011 | Itoh et al. | |
| 7,932,863 | B2 | 4/2011 | Pros et al. | |
| 7,952,526 | B2 | 5/2011 | Lee et al. | |
| 7,961,809 | B2 | 6/2011 | Bourdoux et al. | |
| 8,547,286 | B2 | 10/2013 | Xu et al. | |
| 8,604,982 | B2 | 12/2013 | Achour et al. | |
| 8,830,556 | B2 * | 9/2014 | Smith ..... | B82Y 20/00 250/505.1 |
| 2003/0011522 | A1 | 1/2003 | McKinzie, III et al. | |
| 2003/0198475 | A1 | 10/2003 | Tiemann et al. | |
| 2004/0075614 | A1 | 4/2004 | Dakeya et al. | |
| 2004/0075617 | A1 | 4/2004 | Lynch et al. | |
| 2004/0113848 | A1 | 6/2004 | Gaucher et al. | |
| 2004/0164900 | A1 | 8/2004 | Casabona et al. | |
| 2004/0227668 | A1 | 11/2004 | Sievenpiper | |
| 2005/0225492 | A1 | 10/2005 | Metz | |
| 2005/0253667 | A1 | 11/2005 | Itoh et al. | |
| 2006/0066422 | A1 | 3/2006 | Itoh et al. | |
| 2007/0004363 | A1 | 1/2007 | Kusaka et al. | |
| 2007/0010202 | A1 | 1/2007 | Yamamoto et al. | |
| 2007/0085754 | A1 | 4/2007 | Ella et al. | |
| 2007/0176827 | A1 | 8/2007 | Itoh et al. | |
| 2008/0001684 | A1 | 1/2008 | Itoh et al. | |
| 2008/0048917 | A1 | 2/2008 | Achour et al. | |
| 2008/0074332 | A1 | 3/2008 | Arronte et al. | |
| 2008/0204327 | A1 | 8/2008 | Lee et al. | |
| 2008/0231521 | A1 | 9/2008 | Pros et al. | |
| 2008/0258981 | A1 | 10/2008 | Achour et al. | |
| 2008/0258993 | A1 | 10/2008 | Gummalla et al. | |
| 2009/0128446 | A1 | 5/2009 | Gummalla et al. | |
| 2009/0135087 | A1 | 5/2009 | Gummalla et al. | |
| 2009/0160575 | A1 | 6/2009 | Dupuy et al. | |
| 2009/0251385 | A1 | 10/2009 | Zu et al. | |
| 2010/0045554 | A1 | 2/2010 | Xu et al. | |
| 2010/0109971 | A2 | 5/2010 | Gummalla et al. | |
| 2010/0109972 | A2 | 5/2010 | Xu et al. | |
| 2010/0117908 | A2 | 5/2010 | Lee et al. | |
| 2010/0238081 | A1 | 9/2010 | Achour et al. | |
| 2011/0008873 | A1 | 1/2011 | Lipinski et al. | |
| 2011/0026624 | A1 | 2/2011 | Gummalla et al. | |
| 2011/0039501 | A1 * | 2/2011 | Achour ..... | H01Q 1/38 455/73 |
| 2011/0156963 | A1 | 6/2011 | Rajgopal et al. | |
| 2011/0227795 | A1 * | 9/2011 | Lopez ..... | H01Q 1/243 343/700 MS |
| 2011/0273348 | A1 | 11/2011 | Lopez et al. | |
| 2011/0273353 | A1 | 11/2011 | Achour et al. | |
| 2012/0001815 | A1 * | 1/2012 | Wong ..... | H01Q 1/243 343/749 |

FOREIGN PATENT DOCUMENTS

| | | | |
|---|---|---|---|
| JP | 2006501719 | A | 1/2006 |
| JP | 4918594 | A | 2/2012 |
| KR | 1020030022407 | | 3/2003 |
| KR | 20030086030 | A | 11/2003 |
| KR | 1020100051127 | A | 5/2010 |
| KR | 107011754 | B1 | 10/2011 |
| KR | 1086743 | B1 | 11/2011 |
| KR | 101119228 | B1 | 2/2012 |
| KR | 101236226 | B1 | 2/2013 |
| KR | 101236313 | B1 | 2/2013 |
| KR | 101297314 | B1 | 8/2013 |
| TW | I376838 | B | 11/2012 |
| VN | 10010380 | | 6/2012 |
| WO | WO-0108259 | A1 | 2/2001 |
| WO | WO-2007098061 | A3 | 8/2007 |
| WO | WO-2007127955 | A2 | 11/2007 |
| WO | WO-2007127955 | A3 | 11/2007 |
| WO | WO-2008024993 | A2 | 2/2008 |
| WO | WO-2008115881 | A1 | 9/2008 |
| WO | WO-2008024993 | A3 | 2/2009 |
| WO | WO-2009049303 | A1 | 4/2009 |
| WO | WO-2009064926 | A1 | 5/2009 |
| WO | WO-2010021854 | A1 | 2/2010 |

OTHER PUBLICATIONS

"International Application Serial No. PCT/US2009/053044, International Preliminary Report on Patentabilty dated Mar. 3, 2011", 6 pgs.

"Korean Application Serial No. 2013-7007687, Notice of Non Final Rejection dated Apr. 8, 2014", w/English Translation, 5 pgs.

"Korean Application Serial No. 2013-7007687, Notice of Non Final Rejection dated Sep. 13, 2013", w/English Translation, 5 pgs.

"Korean Application Serial No. 2013-7007687, Response filed Jul. 8, 2014 to Office Action dated Apr. 8, 2014", w/English Claims, 14 pgs.

"Korean Application Serial No. 2013-7007687, Response filed Nov. 29, 2013 to Office Action dated Sep. 13, 2013", w/English Claims, 14 pgs.

"U.S. Appl. No. 11/741,674, Notice of Allowance dated May 18, 2010", 14 pgs.

"U.S. Appl. No. 11/741,674, Response filed Apr. 22, 2010 to Restriction Requirement dated Apr. 15, 2010", 12 pgs.

"U.S. Appl. No. 11/741,674, Restriction Requirement dated Apr. 15, 2010", 7 pgs.

"U.S. Appl. No. 11/844,982, Final Office Action dated Jun. 5, 2009", 13 pgs.

"U.S. Appl. No. 11/844,982, Non Final Office Action dated Feb. 17, 2009", 10 pgs.

"U.S. Appl. No. 11/844,982, Notice of Allowance dated Jan. 13, 2009", 7 pgs.

"U.S. Appl. No. 11/844,982, Notice of Allowance dated Jul. 27, 2009", 9 pgs.

"U.S. Appl. No. 11/844,982, Response filed Feb. 20, 2009 to Non Final Office dated Feb. 17, 2009", 27 pgs.

"U.S. Appl. No. 11/844,982, Response filed Jun. 29, 2009 to Final Office Action dated Jun. 5, 2009", 26 pgs.

"U.S. Appl. No. 12/050,107, Notice of Allowance dated Jun. 29, 2010", 8 pgs.

"U.S. Appl. No. 12/050,107, Preliminary Amendment dated Mar. 31, 2009", 3 pgs.

"U.S. Appl. No. 12/250,477, Non Final Office Action dated Feb. 15, 2012", 14 pgs.

"U.S. Appl. No. 12/250,477, Notice of Allowance dated Mar. 18, 2013", 9 pgs.

"U.S. Appl. No. 12/250,477, Notice of Allowance dated Oct. 2, 2012", 8 pgs.

(56) References Cited

OTHER PUBLICATIONS

"U.S. Appl. No. 12/250,477, Preliminary Amendment filed Jan. 28, 2009", 15 pgs.
"U.S. Appl. No. 12/250,477, Response filed May 15, 2012 to Non Final Office Action dated Feb. 15, 2012", 18 pgs.
"U.S. Appl. No. 12/250,477, Response filed Sep. 15, 2011 to Restriction Requirement dated Aug. 15, 2011", 15 pgs.
"U.S. Appl. No. 12/250,477, Restriction Requirement dated Aug. 15, 2011", 6 pgs.
"U.S. Appl. No. 12/270,410 , Response filed Feb. 7, 2012 to Final Office Action dated Nov. 7, 2011", 23 pgs.
"U.S. Appl. No. 12/270,410, Advisory Action dated Feb. 24, 2012", 4 pgs.
"U.S. Appl. No. 12/270,410, Final Office Action dated Nov. 7, 2011", 18 pgs.
"U.S. Appl. No. 12/270,410, Non Final Office Action dated May 12, 2011", 20 pgs.
"U.S. Appl. No. 12/270,410, Response filed Mar. 21, 2011 to Restriction Requirement dated Feb. 17, 2011", 22 pgs.
"U.S. Appl. No. 12/270,410, Response filed Sep. 12, 2011 to Non Final Office Action dated May 12, 2011", 26 pgs.
"U.S. Appl. No. 12/270,410, Restriction Requirement dated Feb. 17, 2011", 6 pgs.
"U.S. Appl. No. 12/536,422 , Response filed May 9, 2013 to Non Final Office Action dated Nov. 9, 2012", 12 pgs.
"U.S. Appl. No. 12/536,422 , Response filed May 17, 2012 to Non Final Office Action dated Feb. 17, 2012", 12 pgs.
"U.S. Appl. No. 12/536,422, Non Final Office Action dated Feb. 17, 2012", 16 pgs.
"U.S. Appl. No. 12/536,422, Non Final Office Action dated Nov. 9, 2012", 17 pgs.
"U.S. Appl. No. 12/536,422, Notice of Allowance dated May 24, 2013", 10 pgs.
"U.S. Appl. No. 12/562,114, Notice of Allowance dated Aug. 6, 2010", 7 pgs.
"U.S. Appl. No. 12/562,114, Preliminary Amendment filed Jun. 7, 2010", 4 pgs.
"U.S. Appl. No. 12/562,114, Preliminary Amendment filed Sep. 17, 2009", 31 pgs.
"U.S. Appl. No. 12/562,114, Preliminary Amendment filed Sep. 22, 2009", 15 pgs.
"U.S. Appl. No. 12/785,226 , Response filed Oct. 3, 2012 to Final Office Action dated May 3, 2012", 11 pgs.
"U.S. Appl. No. 12/785,226, Final Office Action dated May 3, 2012", 14 pgs.
"U.S. Appl. No. 12/785,226, Final Office Action dated May 14, 2013", 10 pgs.
"U.S. Appl. No. 12/785,226, Non Final Office Action dated Aug. 12, 2011", 10 pgs.
"U.S. Appl. No. 12/785,226, Non Final Office Action dated Nov. 2, 2012", 13 pgs.
"U.S. Appl. No. 12/785,226, Response filed Jan. 12, 2012 to Non Final Office Action dated Aug. 12, 2011", 13 pgs.
"U.S. Appl. No. 12/785,226, Response filed May 2, 2013 to Non Final Office Action dated Nov. 2, 2012", 10 pgs.
"U.S. Appl. No. 12/785,246 , Response filed Dec. 1, 2011 to Non Final Office Action dated Aug. 1, 2011", 7 pgs.
"U.S. Appl. No. 12/785,246, Non Final Office Action dated Feb. 8, 2012", 12 pgs.
"U.S. Appl. No. 12/785,246, Non Final Office Action dated Aug. 1, 2011", 6 pgs.
"U.S. Appl. No. 12/785,246, Preliminary Amendment filed Oct. 28, 2010", 2 pgs.
"U.S. Appl. No. 12/849,623, Non Final Office Action dated Jan. 6, 2012", 5 pgs.
"U.S. Appl. No. 12/849,623, Notice of Allowance dated Feb. 8, 2013", 5 pgs.
"U.S. Appl. No. 12/849,623, Notice of Allowance dated Jun. 14, 2012", 5 pgs.
"U.S. Appl. No. 12/849,623, Preliminary Amendment filed Oct. 6, 2010", 8 pgs.
"U.S. Appl. No. 12/849,623, Response filed May 7, 2012 to Non Final Office Action dated Jan. 6, 2012", 9 pgs.
"U.S. Appl. No. 12/849,623, Response filed May 23, 2011 to Restriction Requirement dated Mar. 22, 2011", 10 pgs.
"U.S. Appl. No. 12/849,623, Restriction Requirement dated Mar. 22, 2011", 5 pgs.
"U.S. Appl. No. 12/914,936 , Response filed May 7, 2013 to Non Final Office Action dated Dec. 7, 2012", 8 pgs.
"U.S. Appl. No. 12/914,936, Advisory Action dated Sep. 27, 2011", 3 pgs.
"U.S. Appl. No. 12/914,936, Final Office Action dated Jul. 21, 2011", 8 pgs.
"U.S. Appl. No. 12/914,936, Non Final Office Action dated Jan. 6, 2011", 6 pgs.
"U.S. Appl. No. 12/914,936, Non Final Office Action dated Dec. 7, 2012", 8 pgs.
"U.S. Appl. No. 12/914,936, Non Final Office Action dated Dec. 28, 2011", 7 pgs.
"U.S. Appl. No. 12/914,936, Notice of Allowance dated Jun. 11, 2012", 8 pgs.
"U.S. Appl. No. 12/914,936, Response filed Mar. 28, 2012 to Non Final Office Action dated Dec. 28, 2011", 11 pgs.
"U.S. Appl. No. 12/914,936, Response filed May 6, 2011 to Non Final Office Action dated Jan. 6, 2011", 11 pgs.
"U.S. Appl. No. 12/914,936, Response filed Sep. 14, 2011 to Final Office Action dated Jul. 21, 2011", 10 pgs.
"Chinese Application Serial No. 200780024716.3, Office Action dated Mar. 12, 2012", w/ English Translation, 10 pgs.
"Chinese Application Serial No. 200780024716.3, Office Action dated Sep. 13, 2012", w/English Translation, 5 pgs.
"Chinese Application Serial No. 200780024716.3, response to Office Action filed Jul. 27, 2012", w/English Translation, 77 pgs.
"Chinese Application Serial No. 2007800392167, Office Action dated Apr. 5, 2012", w/English Translation, 4 pgs.
"Chinese Application Serial No. 200880111281.0, Office Action dated Sep. 10, 2012", w/English Translation, 15 pgs.
"European Application Serial No. 08732356.4, Extended Search Report dated Apr. 16, 2012", 11 pgs.
"European Application Serial No. 08838349.2, Office Action dated Aug. 16, 2012", 1 pg.
"European Application Serial No. 08838349.2, Response filed Feb. 22, 2013 to Office Action dated Aug. 16, 2012", 11 pgs.
"European Application Serial No. 08838349.2, Search Report dated Jul. 30, 2012", 7 pgs.
"International Application Serial No. PCT/US2007/067696, International Preliminary Report on Patentability dated Oct. 28, 2008", 6 pgs.
"International Application Serial No. PCT/US2007/067696, International Search Report dated Jul. 14, 2008", 1 pg.
"International Application Serial No. PCT/US2007/067696, Written Opinion dated Jul. 14, 2008", 5 pgs.
"International Application Serial No. PCT/US2007/076791, International Preliminary Report on Patentability dated Mar. 3, 2009", 7 pgs.
"International Application Serial No. PCT/US2007/076791, International Search Report dated Dec. 12, 2008", 1 pg.
"International Application Serial No. PCT/US2007/076791, Written Opinion dated Mar. 12, 2008", 6 pgs.
"International Application Serial No. PCT/US2008/079753, International Search Report dated Jan. 29, 2009", 3 pgs.
"International Application Serial No. PCT/US2008/079753, International Written Opinion dated Jan. 29, 2009", 5 pgs.
"International Application Serial No. PCT/US2008/083455, International Search Report and Written Opinion dated Feb. 27, 2009", 11 pgs.
"International Application Serial No. WO2007127955A2, International Search Report dated Dec. 31, 2009", 3 pgs.
"International Application Serial No. WO2007127955A2, Written Opinion dated Dec. 31, 2009", 4 pgs.

(56) References Cited

OTHER PUBLICATIONS

"International Search Report and Written Opinion dated Aug. 21, 2008 for International Application No. PCT/US2008/057255, filed Mar. 17, 2008", 10 pgs.
"Japanese Application Serial No. 2009-507995, Office Action dated Apr. 19, 2011", w/English Translation, 9 pgs.
"Japanese Application Serial No. 2009-525799, Non Final Office Action dated Sep. 13, 2011", w/English Translation, 6 pgs.
"Japanese Application Serial No. 2009-525799, Response filed Nov. 22, 2011 to Office Action dated Sep. 27, 2011", w/English Translation, 14 pgs.
"Japanese Application Serial No. 2011-144488, Office Action dated Mar. 13, 2013", w/English Translation, 7 pgs.
"Korean Application Serial No. 2010-7011754, Office Action dated Jan. 21, 2011", w/English Translation, 7 pgs.
"Korean Application Serial No. 10-2008-7028654, Final Office Action dated Sep. 30, 2010", w/English translation, 6 pgs.
"Korean Application Serial No. 10-2008-7028654, Office Action dated Dec. 29, 2010", w/English Translation, 5 pgs.
"Korean Application Serial No. 10-2008-7028654, Office Action dated May 31, 2010", w/English Translation, 16 pgs.
"Korean Application Serial No. 10-2008-7028654, Response filed Oct. 30, 2010 to Final Office Action dated Sep. 30, 2010", English translation, 7 pgs.
"Korean Application Serial No. 10-2011-7004230, Office Action dated May 24, 2012", w/English Translation, 15 Pgs.
"Korean Application Serial No. 2009-7005625, Final Office Action dated Aug. 29, 2010", English translation, 2 pgs.
"Korean Application Serial No. 2009-7005625, Notice of Allowance dated Sep. 5, 2011", w/English Translation, 6 pgs.
"Korean Application Serial No. 2009-7005625, Office Action dated Dec. 29, 2010", w/English Translation, 6 pgs.
"Korean Application Serial No. 2009-7005625, Office Action dated May 31, 2010", w/English Translation, 5 pgs.
"Korean Application Serial No. 2009-7005625, Response filed Oct. 30, 2010 to Final Office Action dated Sep. 29, 2010", English translation, 3 pgs.
"Korean Application Serial No. 2010-7007682, Final Office Action dated Apr. 25, 2011", w/English Translation, 9 pgs.
"Korean Application Serial No. 2010-7007682, Office Action dated Dec. 26, 2012", w/English Translation, 7 pgs.
"Korean Application Serial No. 2010-7007682, Office Action dated Jul. 23, 2010", w/English Translation, 14 pgs.
"Korean Application Serial No. 2010-7007682, Response filed Mar. 26, 2013 to Office Action dated Dec. 26, 2012", w/English Claims.
"Korean Application Serial No. 2010-7009769, Final Office Action dated Dec. 23, 2010", w/English translation, 7 pgs.
"Korean Application Serial No. 2010-7009769, Office Action dated Jul. 23, 2010", w/English translation, 12 pgs.
"Korean Application Serial No. 2010-7009770, Final Office Action dated Dec. 23, 2010", with English translation, 6 pgs.
"Korean Application Serial No. 2010-7009770, Response filed Sep. 23, 2010 to Office Action dated Jul. 23, 2010", English translation, 14 pgs.
"Korean Application Serial No. 2010-7011754, Office Action dated Aug. 18, 2010", w/English Translation, 12 pgs.
"Korean Application Serial No. 2010-7011754, Response filed Oct. 18, 2010 to Office Aaction dated Aug. 18, 2010", English Translation Only, 9 pgs.
"Korean Application Serial No. 2010-7011755, Final Office Action dated Jan. 21, 2011", w/English Translation, 11 pgs.
"Korean Application Serial No. 2010-7011755, Office Action dated Aug. 18, 2010", w/English Translation, 16 pgs.
"Korean Application Serial No. 2010-7011755, Response filed Oct. 18, 2010 to Office Action dated Aug. 18, 2010", English Translation Only, 17 pgs.
"Korean Application Serial No. 2011-7004230, Response filed Jul. 24, 2012 to Office Action dated May 24, 2012", w/English claims, 26 pgs.
"Korean Application Serial No. Korean Application Serial No. 2010-7009770, Office Action dated Jul. 23, 2010", English Translation, 6 pgs.
"Taiwan Application Serial No. 97139201, Office Action dated Mar. 22, 2012", w/English Translation, 13 pgs.
"Taiwanese Application Serial No. 1-2008-02876, Office Action dated May 4, 2010", English translation, 6 pgs.
"Taiwanese Application Serial No. 1-2008-02876, Response filed Jun. 28, 2010 to Office Action dated May 4, 2010", w/English claims, 21 pgs.
"Taiwanese Application Serial No. 1-2009-00589, Office Action dated Jan. 18, 2011", English translation, 2 pgs.
"Taiwanese Application Serial No. 96115082, Office Action dated Feb. 14, 2011", w/English translation, 5 pgs.
"Taiwanese Application Serial No. 96115082, Office Action dated Nov. 2, 2011", w/English Translation, 5 pgs.
"Taiwanese Application Serial No. 97143837, Office Action dated Sep. 6, 2012", w/English Translation, 16 pgs.
"Taiwanese Application Serial No. 97143837, Response filed Feb. 20, 2013 to Office Action dated Sep. 6, 2012", w/English Translation, 19 pgs.
"Tawainese Application Serial No. 97139201, Response filed Jul. 4, 2012 to Office Action dated Mar. 22, 2012", w/English Translation, 32 pgs.
Caloz, Christophe, et al., "Array Factor Approach of Leaky-Wave Antennas and Application to 1-D/2-D Composite Right/Left-Handed (CRLH) Structures", IEEE Microwave and Wireless Components Letters, vol. 14 No. 6, (Sep. 2004), 4 pgs.
Caloz, Christophe, et al., "Electromagnetic Metamaterials: Transmission Line Theory and Microwave Applications", John Wiley & Sons, (2006), 186 pgs.
Caloz, Christophe, et al., "Guided-Wave Applications", Electromagnetic Metamaterials: Transmission Line Theory and Microwave Applications, (2006), 192-260.
Caloz, Christophe, "Radiated-Wave Applications", Electromagnetic Metamaterials, ISBN: 978-0-47-166985-2, (Nov. 7, 2005), 261-315.
Cheng-Jung, L, et al., "Design of resonant small antenna using composite right/left-handed transmission lines", Antennas and propagation Society International Symposium, (Jul. 8, 2005), 218-221.
Choi, S H, et al., "A new ultra-wideband antenna for UWB applications", Microwave and Optical Technology Letters, 40(5), (Mar. 5, 2004), 399-401.
Collin, R. E, Field Theory of Guided Waves, John Wiley & Sons, Inc., 2nd Ed., (Dec. 1990).
Damm, C., et al., "Artificial Line Phase Shifter with separately tunable Phase and Line Impedance", 36th European Microwave Conference, (2006), 423-426.
Dupuy, et al., "Power Combiners and Dividers Based on Composite Right and Left Handed Metamaterial Structures", U.S. Appl. No. 11/963,710, filed Dec. 21, 2007.
Eleftheriades, G V, et al., "Negative-refractive-index transmission-line metamaterials and enabling electromagnetic applications", Antennas and Propagation Society International Symposium, (Jun. 2004), 1399-1402.
Eleftheriades, George V, "Antenna Applications and Subwavelength Focusing Using Negative-Refractive-Index Transmission Line Structures", Metamaterials: Physics and Engineering Explorations, Chapter 5, (Sep. 20, 2006), 143-169.
Engheta, N., et al., "Metamaterials: Physics and Engineering Explorations", John Wiley & Sons, Inc., (Jul. 2006).
Gesbert, D., et al., "From Theory to Practice: An Overview of MIMO Space-Time Coded Wireless Systems", IEEE Journal Selected Areas in Communications, 21(3), (Apr. 2003), 281-302.
Gummalla, et al., "U.S. Appl. No. 61/091,203, Information Disclosure Statement dated Aug. 22, 2008", Metamaterial Antenna Structures with Non-Linear Coupling Geometry.
Herraiz-Martinez, Francisco Javier, et al., "Multi-frequency microstrip patch antennas based on metamaterial structures", IEEE Antennas and Propogation Society International Symposium 2007, (2007), 3484-3487.

(56) References Cited

OTHER PUBLICATIONS

Horii, Y, et al., "Super Compact Multilayered Left-Handed Transmission Line and Diplexer Application", IEEE Transactions on Microwave Theory and Techniques, 53(4), (Apr. 2005), 1527-1534.
Huang, W., et al., "Composite Right-Left Handed Metamaterial ultra-wideband antenna", IEEE International Workshop on Antenna Technology, 2009. iWAT 2009., (2009), 1-4.
Itoh, T., "Invited Paper: Prospects for Metamaterials", Electronics Letters 40(16), (Aug. 2004), 972-973.
Jiang, J.-S., et al., "Comparison of Beam Selection and Antenna Selection Techniques in Indoor MIMO Systems at 5.8 GHz", Proceedings Radio and Wireless Conference (RAWCON), (Aug. 2003), 179-182.
Kang, M., et al., "Miniaturized MIM CRLH transmission line structure and application to backfire-to-endfire leaky-wave antenna", IEEE Antennas and Propagation Society International Symposium, 2004, vol. 1, (2004), 827-830.
Lai, A, "Analysis and Design of Left-Handed Metamaterial Lenses Using Ansoft HFSS", UCLA Annual Research Review, Oct. 2005, Microwave Electronics Lab, (Oct. 2005), 1-8.
Lai, A, et al., "Composite right/left handed transmission line metamaterials.", IEEE Microwave Magazine, 5(3), (Sep. 2004), 34-50.
Lai, A, et al., "Dual-Mode Compact Microstrip Antenna Based on Fundamental Backward Wave", Asia-Pacific Conference Proceedings, vol. 4, UCLA, (Dec. 2005), 4-7.
Lai, Anthony, et al., "Inifinite Wavelength Resonant Antennas with Monopolar Radiation Pattern Based on Periodic Structures", IEEE Transactions on Antennas and Propagation, 55(3), (Mar. 2007), 868-876.
Lee, et al., "Multi-Metamaterial-Antenna Systems with Directional Couplers", U.S. Appl. No. 12/340,657, filed Dec. 20, 2008.
Lee, C, et al., "Design of Resonant Small Antenna Using Composite Right/Left-Handed Transmission Line", IEEE Antennas and Propagation Society Intl. Symposium, (Jul. 2005), 218-221.
Lim, S, et al., "Metamaterial-Based Electronically Controlled Transmission-Line Structure as a Novel Leaky-Wave Antenna with Tunable Radiation Angle and Beamwidth", IEEE Transactions on Microwave Theory and Techniques, 52(12), (Dec. 2004), 2678-2690.
Lim, S., et al., "A Reflecto-Directive System Using a Composite Right/Left-Handed (CRLH) Leaky-Wave Antenna and Heterodyne Mixing", IEEE Mircrowave and Wireless Components Letters, vol. 14, No. 4, (Apr. 2004), 183-185.
Liu, C., et al., "Frequency-Scanned Leaky-Wave Antenna from Negative Refractive Index Transmission Lines", 2nd European Conference on Antennas and Propagation (EuCAP 2007), (Nov. 2007), 4 pgs.
Park, Jae-Hyun, et al., "Compact Spiral Zeroth-order Resonance Antenna using metamaterial transmission line", Journal of the Institute of Electronics Engineers of Korea. TC, Telecommunication, 44(7), University Paper, (2007), 6 pgs.
Pozar, D. M., "Microwave Engineering", 3rd Ed. John Wiley & Sons, (2005), 318-323 & 370.
Rahmat-Samii, Yahya, et al., "Development of Complex Artificial Ground Planes in Antenna Engineering", Metamaterials: Physics and Engineering Explorations, (Sep. 20, 2006), 313-349.
Sajin, George, et al., "Silicon Supported Microwave Directional Coupler Metamaterial Approach", International Semiconductor Conference, 2007. CAS 2007., (Oct. 2007), 241-244.
Sanada, A., et al., "A planar zeroth-order resonator antenna using a left-handed transmission line", 34th European Microwave Conference, 2004, vol. 3, (2004), 1341-1344.
Sanada, A., et al., "A via-free microstrip left-handed transmission line", 2004 IEEE MTT-S International Microwave Symposium Digest, vol. 1, (2004), 301-304.
Sato, K., "Composite right/left-handed leaky wave antenna for millimeter-wave automotive applications", First European Conference on Antennas and Propagation, 2006. EuCAP 2006., (2006), 1-4.
Sievenpiper, Daniel F., "High-Impedence Electromagnetic Surfaces", Ph.D. Dissertation, University of California, Los Angeles, (1999), 162 pgs.
Simion, S., et al., "CPW Antenna Fabricated on Silicon Substrate, Based on Transmission Line Metamaterial Approach", ICEAA 2007. International Conference on Electromagnetics in Advanced Applications, 2007., (2007), 488-491.
Sungjoon, L, et al., "A reflecto-directive system using a composite right/left-handed (CRLH) leaky-wave antenna and heterodyne mixing", Microwave and Wireless Component Letter, (Apr. 30, 2004), 183-185.
Tong, W, et al., "Dual Composite Right/Left-Handed (D-CRLH) Transmission Line in GaAs MMIC Technology", International Workshop on Antenna Technology: Small and Smart Antennas Metamaterials and Applications, 2007. IWAT '07., (2007), 105-108.
Vendik, O. G, et al., "Electronically controlled phase shifters based on right/left-handed transmission lines", 2005 European Microwave Conference, vol. 2, (2005).
Waldschmidt, C., et al., "Compact Wide-Band Multimode Antennas for MIMO and Diversity", IEEE Transactions on Antennas and Propagation, 52(8), (Aug. 2004), 1963-1969.
Waldschmidt, C., et al., "Complete RF System Model for Analysis of Compact MIMO Arrays", IEEE Transactions on Vehicular Technology, 53(3), (May 2004), 579-586.
Waldschmidt, C., et al., "Handy MIMO", IEEE Communications Engineer, 3(1), (Feb./Mar. 2005), 22-25.
Wu, Chien-Hung, et al., "A novel small planar antenna utilizing cascaded right/left-handed transmission lines", 2007 IEEE Antennas and Propagation Society International Symposium, (2007), 1889-1892.
"Korean Application Serial No. 10-2010-7012787, Office Action dated Oct. 29, 2014", 9 pgs.
"Republic of Korea Application Serial No. 2010-7012787 Response filed Dec. 29, 2014 to Office Action dated Oct. 29, 2014", With the English claims, 56 pgs.

* cited by examiner

SINGLE-LAYER METALIZATION AND VIA-LESS METAMATERIAL STRUCTURES

PRIORITY CLAIMS AND RELATED APPLICATIONS

This application is a divisional application of U.S. application Ser. No. 12/250,477, filed Oct. 13, 2008, which claimed the benefit of priority of: U.S. Provisional Application No. 60/979,384, filed Oct. 11, 2007; U.S. Provisional Application No. 60/987,750, filed Nov. 13, 2007; U.S. Provisional Application No. 61/024,876, filed Jan. 30, 2008; and U.S. Provisional Application No. 61/091,203, filed Aug. 22, 2008, the benefit of priority of each of which is hereby presently claimed and each of which is hereby incorporated herein by reference.

BACKGROUND

This application relates to metamaterial structures.

The propagation of electromagnetic waves in most materials obeys the right handed rule for the (E, H, β) vector fields, where E is the electrical field, H is the magnetic field, and β is the wave vector. The phase velocity direction is the same as the direction of the signal energy propagation (group velocity) and the refractive index is a positive number. Such materials are "right handed" (RH). Most natural materials are RH materials. Artificial materials can also be RH materials.

A metamaterial (MTM) has an artificial structure. When designed with a structural average unit cell size p much smaller than the wavelength of the electromagnetic energy guided by the metamaterial, the metamaterial can behave like a homogeneous medium to the guided electromagnetic energy. Unlike RH materials, a metamaterial can exhibit a negative refractive index with permittivity ∈ and permeability μ being simultaneously negative, and the phase velocity direction is opposite to the direction of the signal energy propagation where the relative directions of the (E, H, β) vector fields follow the left handed rule. Metamaterials that support only a negative index of refraction with permittivity ∈ and permeability μ being simultaneously negative are pure "left handed" (LH) metamaterials.

Many metamaterials are mixtures of LH metamaterials and RH materials and thus are Composite Left and Right Handed (CRLH) metamaterials. A CRLH metamaterial can behave like a LH metamaterial at low frequencies and a RH material at high frequencies. Designs and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

Techniques and apparatus based on metamaterial structures provided for antenna and transmission line devices, including single-layer metallization and via-less metamaterial structures.

In one aspect, a metamaterial device includes a dielectric substrate having a first surface and a second, different surface; and a metallization layer formed on the first surface and patterned to have two or more conductive parts to form a single-layer composite left and right handed (CRLH) metamaterial structure on the first surface.

In another aspect, a metamaterial device includes a dielectric substrate having a first surface and a second, different surface; a first metallization layer formed on the first surface; and a second metallization layer formed on the second surface. The first and second metallization layers are patterned to have two or more conductive parts to form a composite left and right handed (CRLH) metamaterial structure that comprises a unit cell which is free of a conductive via penetrating the dielectric substrate to connect the first metallization layer and the second metallization layer.

In yet another aspect, a metamaterial device includes a dielectric substrate having a first surface and a second, different surface; a cell patch on the first surface; a top ground electrode spaced from the cell patch and located on the first surface; a top via line on the first surface having a first end connected to the cell patch and a second end connected to the top ground electrode; a cell launch pad formed on the second surface beneath the cell patch on the first surface and electromagnetically coupled to the cell patch through the substrate to direct a signal to or receive a signal from the cell patch without being directly connected to the cell patch through a conductive via that penetrates through the substrate; and a bottom feed line formed on the second surface and connected to the cell launch pad to direct the signal to or from cell launch pad. The cell patch, the top ground electrode, the top via line, the cell launch pad, and the bottom feed line form a composite left and right handed (CRLH) metamaterial structure.

These and other aspects and implementations and their variations are described in detail in the attached drawings, the detailed description and the claims.

BRIEF DESCRIPTION OF THE DRAWINGS

FIG. 14(*b*) shows the simulated return loss of the two-cell SLM MTM antenna shown in FIG. 14.

FIG. 14(*c*) shows the measured return loss of the one-cell SLM MTM antenna fabricated as shown in FIGS. 13(*a*)-13(*c*).

FIG. 16(*b*) shows the simulated input impedance of the two-cell SLM MTM antenna shown in FIG. 15.

FIG. 21(*b*) shows a simplified equivalent circuit for a two-layer MTM structure without a via and with a via line on the bottom layer.

FIG. 22(*b*) shows the simulated return loss of the one-cell TLM-VL MTM antenna shown in FIGS. 20(*a*)-20(*d*), with an added via connecting the center of the cell patch and the center of the bottom truncated ground.

FIG. 29(*b*) shows the simulated input impedance of the one-cell SLM MTM antenna shown in FIGS. 28(*a*)-28(*d*).

FIG. 35(*b*) shows the simulated input impedance of the TLM-VL antenna shown in FIGS. 34(*a*)-34(*d*).

FIG. 37(*b*) shows the simulated input impedance of the semi single-layer antenna shown in FIGS. 36(*a*)-36(*d*).

FIG. 49(*b*) shows the simulated input impedance of the three-layer MTM antenna with the vertical coupling shown in FIGS. 48(*a*)-48(*f*).

FIG. 51(*b*) shows the simulated input impedance of the TLM-VL MTM antenna with the vertical coupling shown in FIGS. 50(*a*)-50(*c*).

DETAILED DESCRIPTION

Figure 1:
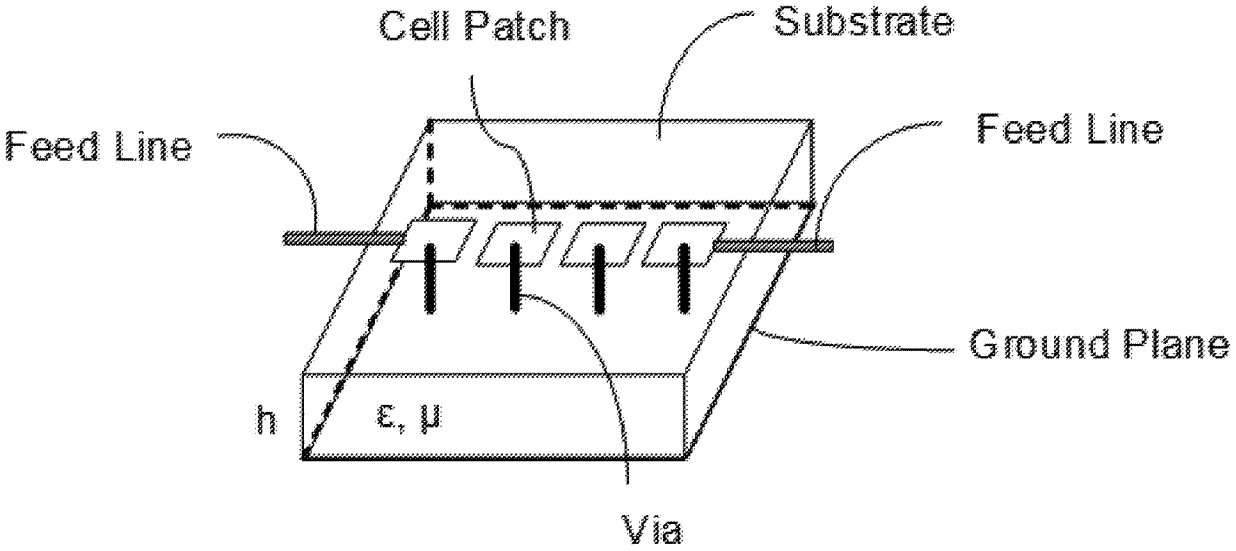
FIG. 1 shows an example of a 1D CRLH MTM TL based on four unit cells.

Metamaterial (MTM) structures can be used to construct antennas and other electrical components and devices, allowing for a wide range of technology advancements such as size reduction and performance improvements. The MTM antenna structures can be fabricated on various circuit platforms, including circuit boards such as a FR-4 Printed Circuit Board (PCB) or a Flexible Printed Circuit (FPC) board. Examples of other fabrication techniques include thin film fabrication techniques, system on chip (SOC) techniques, low temperature co-fired ceramic (LTCC) techniques, and monolithic microwave integrated circuit (MMIC) techniques.

The examples and implementations of MTM structures described in this document include Single-Layer Metallization (SLM) MTM antenna structures that place conductive components of a MTM structure, including a ground electrode, in a single conductive metallization layer formed on one side of a dielectric substrate or board, and Two-Layer Metallization Via-Less (TLM-VL) MTM antenna structures in which two conductive metallization layers on two parallel surfaces of a dielectric substrate or board are used to form a MTM structure without having a conductive via to connect one component of the MTM structure on one conductive metallization layer of the dielectric substrate or board to another component of the MTM structure on the other conductive metallization layer of the dielectric substrate or board. Such SLM MTM and TLM-VL MTM structures can be structured in various configurations and may be coupled with other MTM or non-MTM circuits and circuit elements on the circuit boards.

For example, such SLM MTM and TLM-VL MTM structures can be used in devices having thin substrates or materials in which via holes cannot be drilled and/or plated. For another example, such SLM and TLM-VL MTM antenna structures may be wrapped inside or around a product enclosure. Antennas based on such SLM MTM and TLM-VL MTM structures can be made conformal to the internal wall of a housing of a product, the outer surface of an antenna carrier or the contour of a device package. Examples of thin substrates or materials in which via holes cannot be drilled and/or plated include FR4 substrates with a thickness less than 10 mils, thin glass materials, Flex films, and thin-film substrates with a thickness of 3 mils-5 mils. Some of these materials can be bent easily with good manufacturability. Certain FR-4 and glass materials may require heat-bending or other techniques to achieve desired curved or bent shapes.

The MTM antenna structures described in this document can be configured to generate multiple frequency bands including a "low band" and a "high band." The low band includes at least one left-handed (LH) mode resonance and the high band includes at least one right-handed (RH) mode resonance. The multi-band MTM antenna structures described in this document can be used in cell phone applications, handheld device applications (e.g., PDAs and smart phones) and other mobile device applications, in which the antenna is expected to support multiple frequency bands with adequate performance under limited space constraints. The MTM antenna designs disclosed in this document can be adapted and designed to provide one or more advantages over other antennas such as compact sizes, multiple resonances based on a single antenna solution, resonances that are stable and insensitive to shifts caused by the user interaction, and resonant frequencies that are substantially independent of the physical size. The configuration of elements in a MTM antenna structure can be structured to achieve desirable bands and bandwidths based on the single antenna solution with the CRLH properties.

The MTM antennas described in this document can be designed to operate in various bands, including frequency bands for cell phone and mobile device applications, WiFi applications, WiMax applications and other wireless communication applications. Examples for the frequency bands for cell phone and mobile device applications are: the cellular band (824-960 MHz) which includes two bands, CDMA and GSM bands; and the PCS/DCS band (1710-2170 MHz) which includes three bands: PCS, DCS and WCDMA bands. A quad-band antenna can be used to cover one of the CDMA and GSM bands in the cellular band and all three bands in the PCS/DCS band. A penta-band antenna can be used to cover all five bands with two in the cellular band and three in the PCS/DCS band. Examples of frequency bands for WiFi applications include two bands: one ranging from 2.4 to 2.48 GHz, and the other ranging from 5.15 GHz to 5.835 GHz. The frequency bands for WiMax applications involve three bands: 2.3-2.4 GHZ, 2.5-2.7 GHZ, and 3.5-3.8 GHz.

An MTM antenna or MTM transmission line (TL) is a M™ structure with one or more MTM unit cells. The equivalent circuit for each MTM unit cell includes a right-handed series inductance (LR), a right-handed shunt capacitance (CR), a left-handed series capacitance (CL), and a left-handed shunt inductance (LL). LL and CL are structured and connected to provide the left-handed properties to the unit cell. This type of CRLH TLs or antennas can be implemented by using distributed circuit elements, lumped circuit elements or a combination of both. Each unit cell is smaller than $-\lambda/4$ where $\lambda$ is the wavelength of the electromagnetic signal that is transmitted in the CRLH TL or antenna.

A pure LH metamaterial follows the left-hand rule for the vector trio (E, H, $\beta$), and the phase velocity direction is opposite to the signal energy propagation. Both the permittivity $\in$ and permeability $\mu$ of the LH material are negative. A CRLH metamaterial can exhibit both left-hand and right-hand electromagnetic modes of propagation depending on the regime or frequency of operation. Under certain circumstances, a CRLH metamaterial can exhibit a non-zero group velocity when the wavevector of a signal is zero. This situation occurs when both left-hand and right-hand modes are balanced. In an unbalanced mode, there is a bandgap in which electromagnetic wave propagation is forbidden. In the balanced case, the dispersion curve does not show any discontinuity at the transition point of the propagation constant $\beta(\omega_o)=0$ between the left- and right-hand modes, where the guided wavelength is infinite, i.e., $\lambda_g=2\pi/|\beta|\rightarrow\infty$, while the group velocity is positive:

$$v_g = \left.\frac{d\omega}{d\beta}\right|_{\beta=0} > 0.$$

This state corresponds to the zeroth order mode m=0 in a TL implementation in the LH region. The CRHL structure supports a fine spectrum of low frequencies with the dispersion relation that follows the negative β parabolic region. This allows a physically small device to be built that is electromagnetically large with unique capabilities in manipulating and controlling near-field radiation patterns. When this TL is used as a Zeroth Order Resonator (ZOR), it allows a constant amplitude and phase resonance across the entire resonator. The ZOR mode can be used to build MTM-based power combiners and splitters or dividers, directional couplers, matching networks, and leaky wave antennas.

In the case of RH TL resonators, the resonance frequency corresponds to electrical lengths $\theta_m=\beta_m l=m\pi$ (m=1, 2, 3 . . . ), where l is the length of the TL. The TL length should be long to reach low and wider spectrum of resonant frequencies. The operating frequencies of a pure LH material are at low frequencies. A CRLH MTM structure is very different from an RH or LH material and can be used to reach both high and low spectral regions of the RF spectral ranges. In the CRLH case $\theta_m=\beta_m l=m\pi$, where l is the length of the CRLH TL and the parameter m=0, ±1, ±2, ±3 . . . ±∞.

Examples of specific MTM antenna structures are described below. Certain technical information associated with the these examples is described in U.S. patent application Ser. No. 11/741,674 entitled "Antennas, Devices, and Systems Based on Metamaterial Structures," filed on Apr. 27, 2007, and U.S. patent application Ser. No. 11/844,982 entitled "Antennas Based on Metamaterial Structures," filed on Aug. 24, 2007, which are incorporated by reference as part of the specification of this document.

FIG. 1 illustrates an example of a 1-dimensional (1D) CRLH MTM transmission line (TL) based on four unit cells. One unit cell includes a cell patch and a via, and is a building block for constructing a desired MTM structure. The illustrated TL example includes four unit cells formed in two conductive metallization layers of a substrate where four conductive cell patches are formed on the top conductive metallization layer of the substrate and the other side of the substrate has a metallization layer as the ground electrode. Four centered conductive vias are formed to penetrate through the substrate to connect the four cell patches to the ground plane, respectively. The unit cell patch on the left side is electromagnetically coupled to a first feed line and the unit cell patch on the right side is electromagnetically coupled to a second feed line. In some implementations, each unit cell patch is electromagnetically coupled to an adjacent unit cell patch without being directly in contact with the adjacent unit cell. This structure forms the MTM transmission line to receive an RF signal from one feed line and to output the RF signal at the other feed line.

Figure 2:
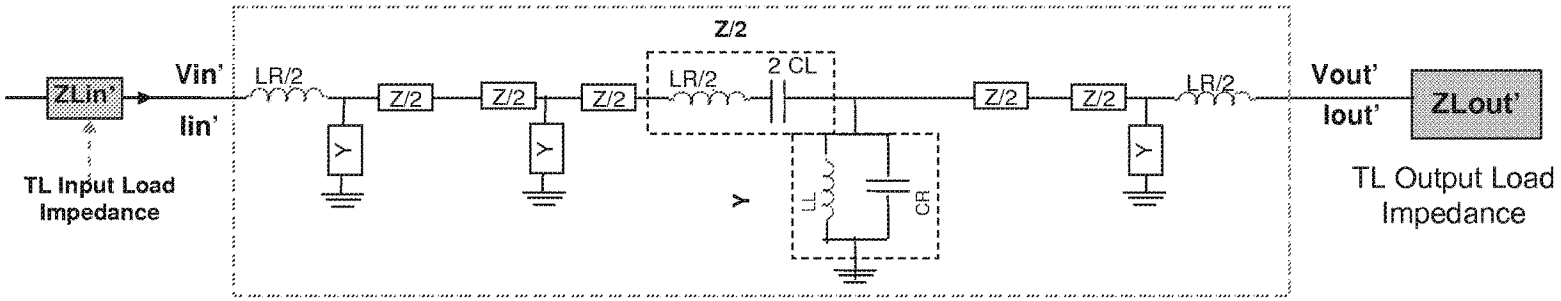
FIG. 2 shows an equivalent circuit of the 1D CRLH MTM TL shown in FIG. 1

FIG. 2 shows an equivalent network circuit of the 1D CRLH MTM TL in FIG. 1. The ZLin' and ZLout' correspond to the TL input load impedance and TL output load impedance, respectively, and are due to the TL coupling at each end. This is an example of a printed two-layer structure. LR is due to the cell patch on the dielectric substrate, and CR is due to the dielectric substrate being sandwiched between the cell patch and the ground plane. CL is due to the presence of two adjacent cell patches, and the via induces LL.

Each individual unit cell can have two resonances $\omega_{SE}$ and $\omega_{SH}$ corresponding to the series (SE) impedance Z and shunt (SH) admittance Y. In FIG. 2, the Z/2 block includes a series combination of LR/2 and 2CL, and the Y block includes a parallel combination of LL and CR. The relationships among these parameters are expressed as follows:

$$\omega_{SH} = \frac{1}{\sqrt{LL\ CR}};\ \omega_{SE} = \frac{1}{\sqrt{LL\ CL}};\qquad \text{Eq. (1)}$$

$$\omega_R = \frac{1}{\sqrt{LL\ CR}};\ \omega_L = \frac{1}{\sqrt{LL\ CL}};$$

$$\text{where, } Z = j\omega LR + \frac{1}{j\omega CL}\ \textit{and}\ Y = j\omega CR + \frac{1}{j\omega LL}.$$

The two unit cells at the input/output edges in FIG. 1 do not include CL, since CL represents the capacitance between two adjacent cell patches and is missing at these input/output edges. The absence of the CL portion at the edge unit cells prevents $\omega_{SE}$ frequency from resonating. Therefore, only $\omega_{SH}$ appears as an m=0 resonance frequency.

Figure 3:
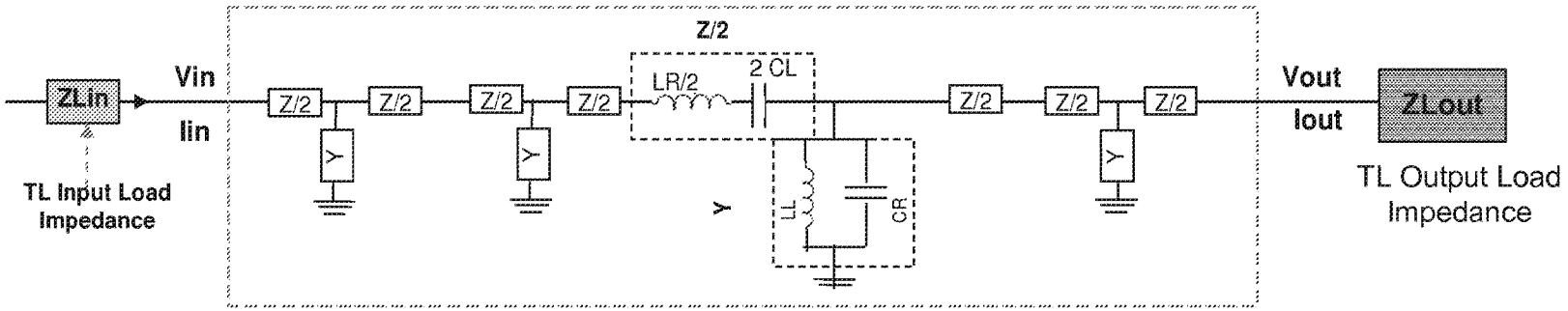
FIG. 3 shows another representation of the equivalent circuit of the 1D CRLH MTM TL shown in FIG. 1.

To simplify the computational analysis, a portion of the ZLin' and ZLout' series capacitor is included to compensate for the missing CL portion, and the remaining input and output load impedances are denoted as ZLin and ZLout, respectively, as seen in FIG. 3. Under this condition, all unit cells have identical parameters as represented by two series Z/2 blocks and one shunt Y block in FIG. 3, where the Z/2 block includes a series combination of LR/2 and 2CL, and the Y block includes a parallel combination of LL and CR.

Figure 4A:
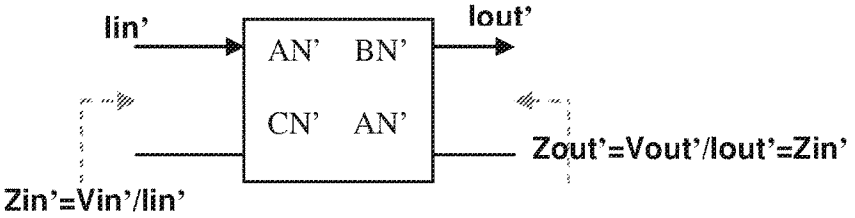
FIG. 4A shows a two-port network matrix representation for the 1D CRLH TL equivalent circuit shown in FIG. 2.
Figure 4B:
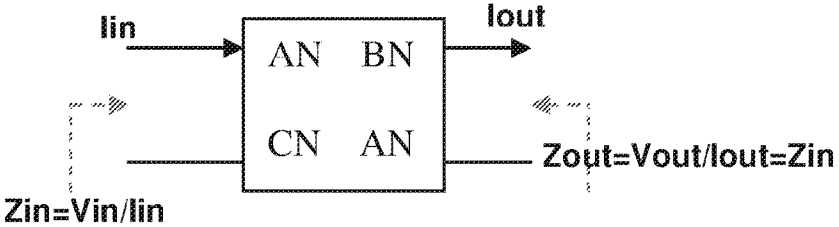
FIG. 4B shows another two-port network matrix representation for the 1D CRLH TL equivalent circuit shown in FIG. 3.
Figure 5:
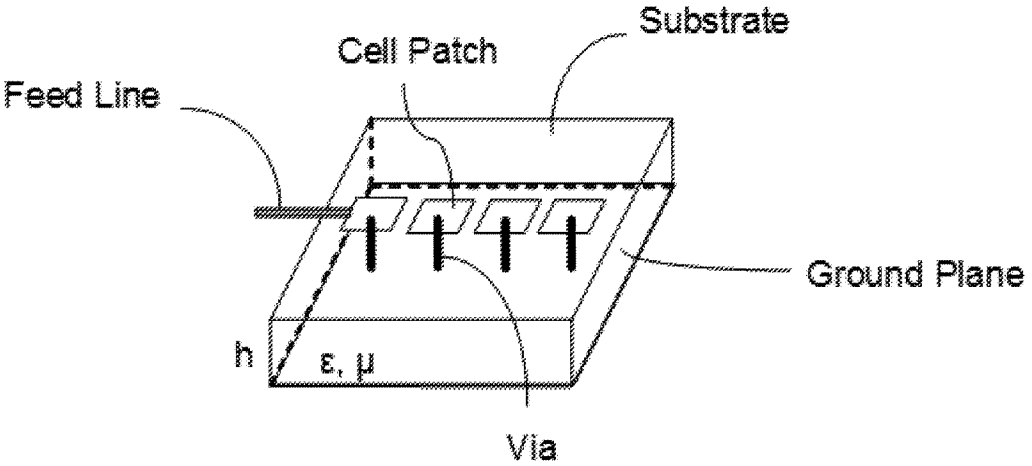
FIG. 5 shows an example of a 1D CRLH MTM antenna based on four unit cells.

FIG. 4A and FIG. 4B illustrate a two-port network matrix representation for TL circuits without the load impedances as shown in FIG. 2 and FIG. 3, respectively, FIG. 5 illustrates an example of a 1D CRLH MTM antenna based on four unit cells. Different from the 1D CRLH MTM TL in FIG. 1, the antenna in FIG. 5 couples the unit cell on the left side to a feed line to connect the antenna to a antenna circuit and the unit cell on the right side is an open circuit so that the four cells interface with the air to transmit or receive an RF signal.

Figure 6B:
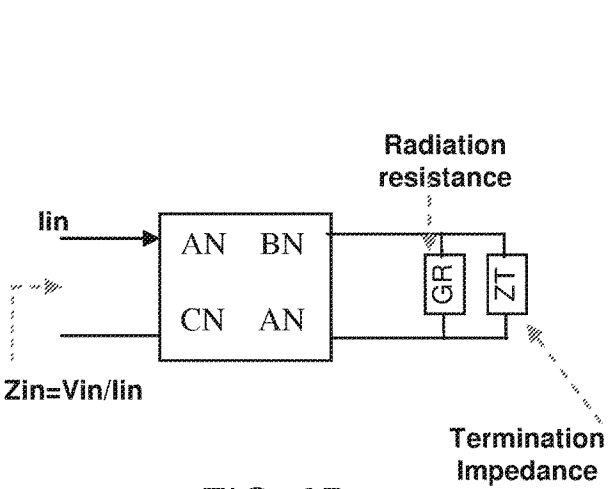
FIG. 6B shows another two-port network matrix representation for the 1D CRLH antenna equivalent circuit analogous to the TL case shown in FIG. 4B.
Figure 6A:
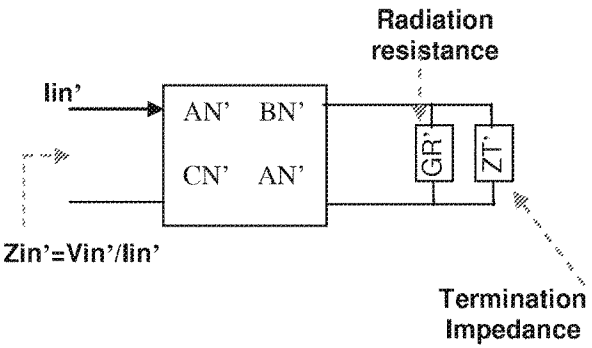
FIG. 6A shows a two-port network matrix representation for the 1D CRLH antenna equivalent circuit analogous to the TL case shown in FIG. 4A.

FIG. 6A shows a two-port network matrix representation for the antenna circuit in FIG. 5. FIG. 6B shows a two-port network matrix representation for the antenna circuit in FIG. 5 with the modification at the edges to account for the missing CL portion to have all the unit cells identical. FIGS. 6A and 6B are analogous to the TL circuits shown in FIGS. 4A and 4B, respectively.

In matrix notations, FIG. 4B represents the relationship given as below:

$$\begin{pmatrix} Vin \\ Iin \end{pmatrix} = \begin{pmatrix} AN & BN \\ CN & AN \end{pmatrix}\begin{pmatrix} Vout \\ Iout \end{pmatrix},\qquad \text{Eq. (2)}$$

where AN=DN because the CRLH MTM TL circuit in FIG. 3 is symmetric when viewed from Vin and Vout ends.

In FIGS. 6A and 6B, the parameters GR' and GR represent a radiation resistance, and the parameters ZT' and ZT represent a termination impedance. Each of ZT', ZLin' and ZLout' includes a contribution from the additional 2CL as expressed below:

$$ZLin' = ZLin + \frac{2}{j\omega CL},\ ZLout' = ZLout + \frac{2}{j\omega CL},\quad ZT' = ZT + \frac{2}{j\omega CL}. \qquad \text{Eq. (3)}$$

Since the radiation resistance GR or GR' can be derived by either building or simulating the antenna, it may be difficult to optimize the antenna design. Therefore, it is preferable to adopt the TL approach and then simulate its corresponding antennas with various terminations ZT. The relationships in Eq. (1) are valid for the circuit in FIG. 2 with the modified values AN', BN', and CN', which reflect the missing CL portion at the two edges.

The frequency bands can be determined from the dispersion equation derived by letting the N CRLH cell structure resonate with not propagation phase length, where n=0, ±1, ±2, . . . ±N. Here, each of the N CRLH cells is represented by Z and Y in Eq. (1), which is different from the structure shown in FIG. 2, where CL is missing from end cells. Therefore, one might expect that the resonances associated with these two structures are different. However, extensive calculations show that all resonances are the same except for n=0, where both $\omega_{SE}$ and $\omega_{SH}$ resonate in the structure in FIG. 3, and only $\omega_{SH}$ resonates in the structure in FIG. 2. The positive phase offsets (n>0) correspond to RH region resonances and the negative values (n<0) are associated with LH region resonances.

The dispersion relation of N identical CRLH cells with the Z and Y parameters is given below:

$$\begin{cases} N\beta p = \cos^{-1}(A_N),\ \Rightarrow |A_N| \le 1 \Rightarrow 0 \le \chi = -ZY \le 4\forall N \\ \text{where } A_N = 1 \text{ at even resonances} |n| = \\ 2m \in \left\{0, 2, 4, \ldots\ 2\times \mathrm{Int}\left(\frac{N-1}{2}\right)\right\} \\ \text{and } A_N = -1 \text{ at odd resonances} |n| = \\ 2m+1 \in \left\{1, 3, \ldots \left(2\times \mathrm{Int}\left(\frac{N}{2}\right)-1\right)\right\} \end{cases}, \qquad \text{Eq. (4)}$$

where Z and Y are given in Eq. (1), AN is derived from the linear cascade of N identical CRLH unit cells as in FIG. 3, and p is the cell size. Odd n=(2 m+1) and even n=2m resonances are associated with AN=−1 and AN=1, respectively. For AN' in FIG. 4A and FIG. 6A, the n=0 mode resonates at $\omega_0=\omega_{SH}$ only and not at both $\omega_{SE}$ and $\omega_{SH}$ due to the absence of CL at the end cells, regardless of the number of cells. Higher-order frequencies are given by the following equations for the different values of $\chi$ specified in Table 1:

$$\text{For } n > 0, \qquad \text{Eq. (5)}$$

$$\omega_{\pm n}^2 = \frac{\omega_{SH}^2 + \omega_{SE}^2 + \chi\omega_R^2}{2} \pm \sqrt{\left(\frac{\omega_{SH}^2 + \omega_{SE}^2 + \chi\omega_R^2}{2}\right)^2 - \omega_{SH}^2\omega_{SE}^2}.$$

Table 1 provides $\chi$ values for N=1, 2, 3, and 4. It should be noted that the higher-order resonances |n|>0 are the same regardless if the full CL is present at the edge cells (FIG. 3) or absent (FIG. 2). Furthermore, resonances close to n=0 have small $\chi$ values (near $\chi$ lower bound 0), whereas higher-order resonances tend to reach $\chi$ upper bound 4 as stated in Eq. (4).

TABLE 1

Resonances for N = 1, 2, 3 and 4 cells

| N\Modes | \|n\| = 0 | \|n\| = 1 | \|n\| = 2 | \|n\| = 3 |
|---|---|---|---|---|
| N = 1 | $\chi_{(1,0)} = 0$; $\omega_0 = \omega_{SH}$ | | | |
| N = 2 | $\chi_{(2,0)} = 0$; $\omega_0 = \omega_{SH}$ | $\chi_{(2,1)} = 2$ | | |
| N = 3 | $\chi_{(3,0)} = 0$; $\omega_0 = \omega_{SH}$ | $\chi_{(3,1)} = 1$ | $\chi_{(3,2)} = 3$ | |
| N = 4 | $\chi_{(4,0)} = 0$; $\omega_0 = \omega_{SH}$ | $\chi_{(4,1)} = 2 - \sqrt{2}$ | $\chi_{(4,2)} = 2$ | |

Figure 7A:
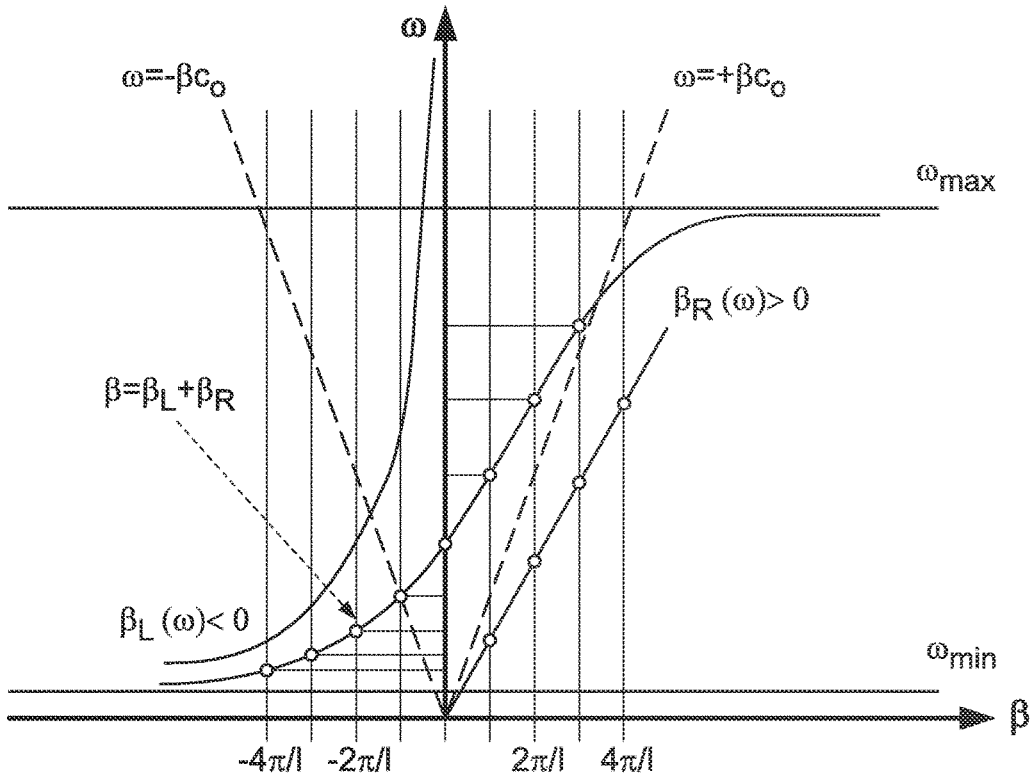
FIG. 7A shows an example of a dispersion curve for the balanced case.
Figure 7B:
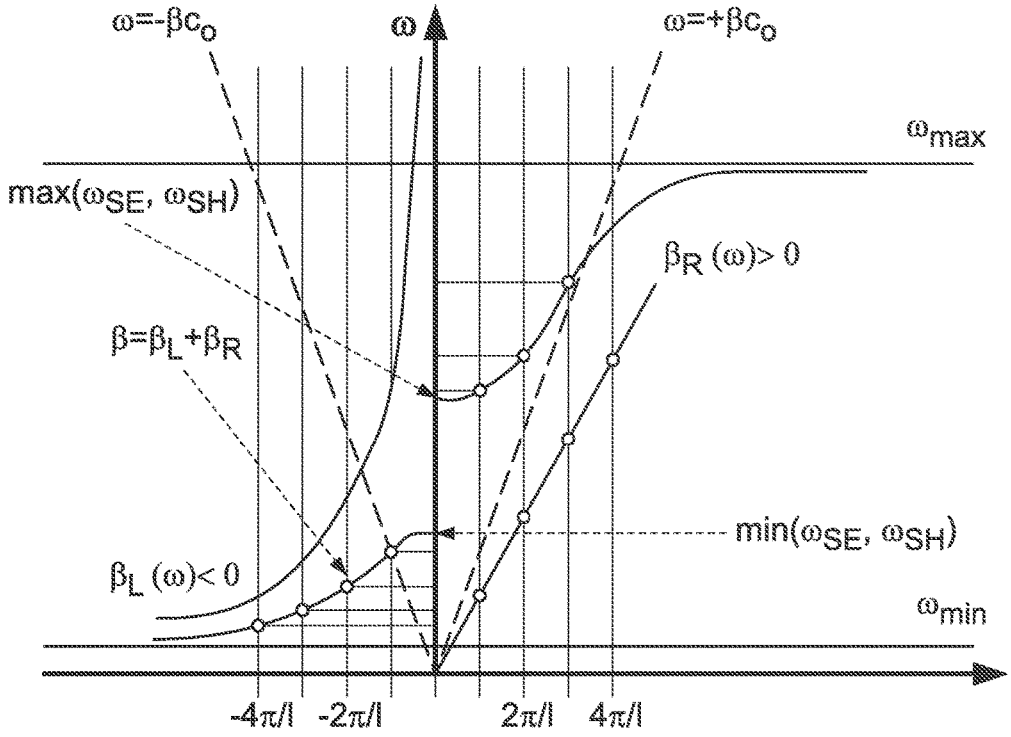
FIG. 7B shows an example of a dispersion curve for the unbalanced case.

The dispersion curve β as a function of frequency w is illustrated in FIGS. 7A and 7B for the $\omega_{SE}=\omega_{SH}$ (balanced, i.e., LR CL=LL CR) and $\omega_{SE}\neq\omega_{SH}$ (unbalanced) cases, respectively. In the latter case, there is a frequency gap between $\min(\omega_{SE},\omega_{SH})$ and $\max(\omega_{SE},\omega_{SH})$. The limiting frequencies $\omega_{min}$ and $\omega_{max}$ values are given by the same resonance equations in Eq. (5) with $\chi$ reaching its upper bound $\chi$=4 as stated in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2} \qquad (6)$$

$$\omega_{max}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2}.$$

In addition, FIGS. 7A and 7B provide examples of the resonance position along the dispersion curves. In the RH region (n>0) the structure size l=Np, where p is the cell size, increases with decreasing frequency. In contrast, in the LH region, lower frequencies are reached with smaller values of Np, hence size reduction. The dispersion curves provide some indication of the bandwidth around these resonances. For instance, LH resonances have the narrow bandwidth because the dispersion curves are almost flat. In the RH region, the bandwidth is wider because the dispersion curves are steeper. Thus, the first condition to obtain broadbands, $1^{st}$ BB condition, can be expressed as follows:

$$COND1: \qquad \text{Eq. (7)}$$

$$1^{st}BB \text{ condition} \left|\frac{d\beta}{d\omega}\right|_{res} = \left|-\frac{\frac{d(AN)}{d\omega}}{\sqrt{(1-AN^2)}}\right|_{res} << 1$$

$$\text{near } \omega = \omega_{res} = \omega_0, \omega_{\pm 1}, \omega_{\pm 2} \ldots$$

$$\Rightarrow \left|\frac{d\beta}{d\omega}\right|_{res} = \left|\frac{\frac{d\chi}{d\omega}}{2p\sqrt{\chi\left(1-\frac{\chi}{4}\right)}}\right|_{res} << 1$$

$$\text{with } p = \text{cell size and} \left.\frac{d\chi}{d\omega}\right|_{res} = \frac{2\omega_{\pm n}}{\omega_R^2}\left(1 - \frac{\omega_{SE}^2\omega_{SH}^2}{\omega_{\pm n}^4}\right),$$

where $\chi$ is given in Eq. (4) and $\omega_R$ is defined in Eq. (1). The dispersion relation in Eq. (4) indicates that resonances occur when |AN|=1, which leads to a zero denominator in the $1^{st}$ BB condition (COND1) of Eq. (7). As a reminder, AN is the first transmission matrix entry of the N identical unit cells (FIG. 4B and FIG. 6B). The calculation shows that COND1 is indeed independent of N and given by the second equation in Eq. (7). It is the values of the numerator and $\chi$ at resonances, which are shown in Table 1, that define the slopes of the dispersion curves, and hence possible bandwidths. Targeted structures are at most Np=λ/40 in size with the bandwidth exceeding 4%. For structures with small cell sizes p, Eq. (7) indicates that high $\omega_R$ values satisfy COND1, i.e., low CR and LR values, since for n<0 resonances occur at χ values near 4 in Table 1, in other terms (1−χ/4→0).

As previously indicated, once the dispersion curve slopes have steep values, then the next step is to identify suitable matching. Ideal matching impedances have fixed values and may not require large matching network footprints. Here, the word "matching impedance" refers to a feed line and termination in the case of a single side feed such as in antennas. To analyze an input/output matching network, Zin and Zout can be computed for the TL circuit in FIG. 4B. Since the network in FIG. 3 is symmetric, it is straightforward to demonstrate that Zin=Zout. It can be demonstrated that Zin is independent of N as indicated in the equation below:

$$Zin^2 = \frac{BN}{CN} = \frac{B1}{C1} = \frac{Z}{Y}\left(1 - \frac{\chi}{4}\right), \quad \text{Eq. (8)}$$

which has only positive real values. One reason that B1/C1 is greater than zero is due to the condition of |AN|≤1 in Eq. (4), which leads to the following impedance condition:

$$0 \le -ZY = \chi \le 4.$$

The $2^{nd}$ broadband (BB) condition is for Zin to slightly vary with frequency near resonances in order to maintain constant matching. Remember that the real input impedance Zin' includes a contribution from the CL series capacitance as stated in Eq. (3). The $2^{nd}$ BB condition is given below:

$$COND2:$$

$$2^{ed}BB \text{ condition near resonances, } \left.\frac{dZin}{d\omega}\right|_{near\,res} << 1. \quad \text{Eq. (9)}$$

Different from the transmission line example in FIG. 2 and FIG. 3, antenna designs have an open-ended side with an infinite impedance which poorly matches the structure edge impedance. The capacitance termination is given by the equation below:

$$Z_T = \frac{AN}{CN}, \quad \text{Eq. (10)}$$

which depends on N and is purely imaginary. Since LH resonances are typically narrower than RH resonances, selected matching values are closer to the ones derived in the n<0 region than the n>0 region.

One method to increase the bandwidth of LH resonances is to reduce the shunt capacitor CR. This reduction can lead to higher $\omega_R$ values of steeper dispersion curves as explained in Eq. (7). There are various methods of decreasing CR, including but not limited to: 1) increasing substrate thickness, 2) reducing the cell patch area, 3) reducing the ground area under the top cell patch, resulting in a "truncated ground," or combinations of the above techniques.

The MTM TL and antenna structures in FIGS. 1 and 5 use a conductive layer to cover the entire bottom surface of the substrate as the full ground electrode. A truncated ground electrode that has been patterned to expose one or more portions of the substrate surface can be used to reduce the area of the ground electrode to less than that of the full substrate surface. This can increase the resonant bandwidth and tune the resonant frequency. Two examples of a truncated ground structure are discussed with reference to FIGS. 8 and 11, where the amount of the ground electrode in the area in the footprint of a cell patch on the ground electrode side of the substrate has been reduced, and a remaining strip line (via line) is used to connect the via of the cell patch to a main ground electrode outside the footprint of the cell patch. This truncated ground approach may be implemented in various configurations to achieve broadband resonances.

Figure 8:
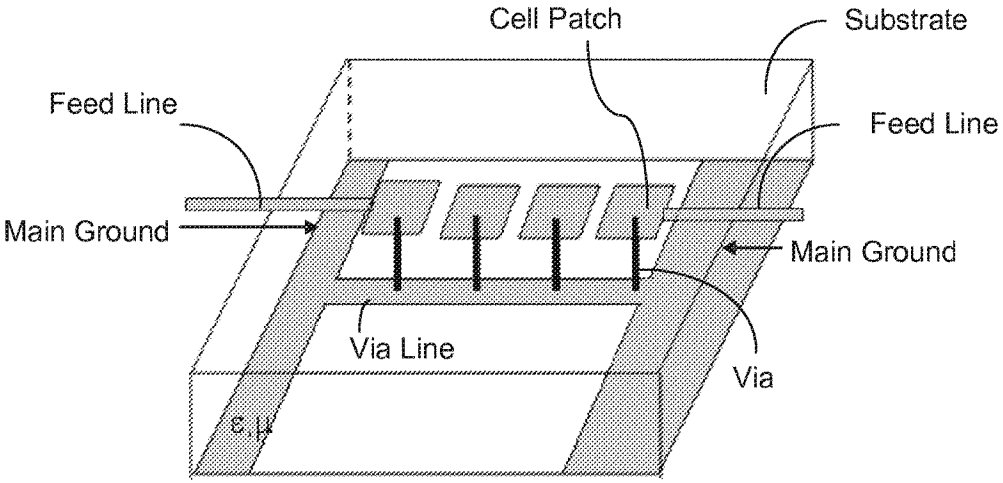
FIG. 8 shows an example of a 1D CRLH MTM TL with a truncated ground based on four unit cells.
Figure 9:
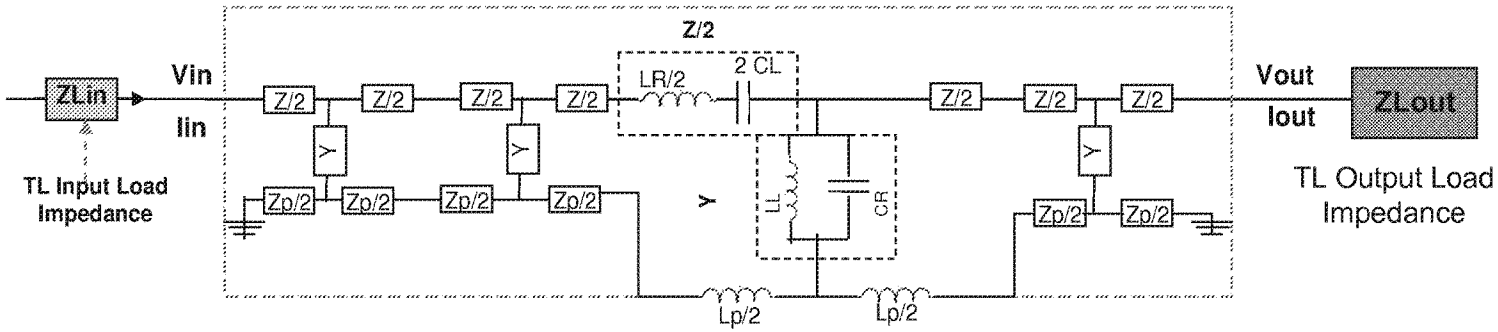
FIG. 9 shows an equivalent circuit of the 1D CRLH MTM TL with the truncated ground shown in FIG. 8.
Figure 10:
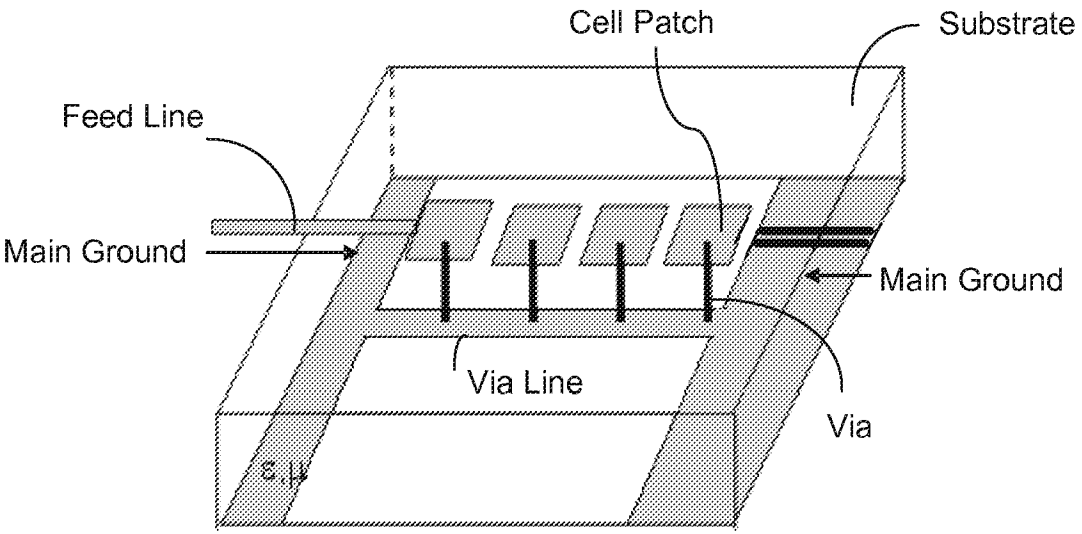
FIG. 10 shows an example of a 1D CRLH MTM antenna with a truncated ground based on four unit cells.

FIG. 8 illustrates one example of a truncated ground electrode for a four-cell MTM transmission line where the ground electrode has a dimension that is less than the cell patch along one direction underneath the cell patch. The ground conductive layer includes a via line that is connected to the vias and passes through underneath the cell patches. The via line has a width that is less than a dimension of the cell path of each unit cell. The use of a truncated ground may be a preferred choice over other methods in implementations of commercial devices where the substrate thickness cannot be increased or the cell patch area cannot be reduced because of the associated decrease in antenna efficiencies. When the ground is truncated, another inductor Lp (FIG. 9) is introduced by the metallization strip (via line) that connects the vias to the main ground as illustrated in FIG. 8. FIG. 10 shows a four-cell antenna counterpart with the truncated ground analogous to the TL structure in FIG. 8.

Figure 11:
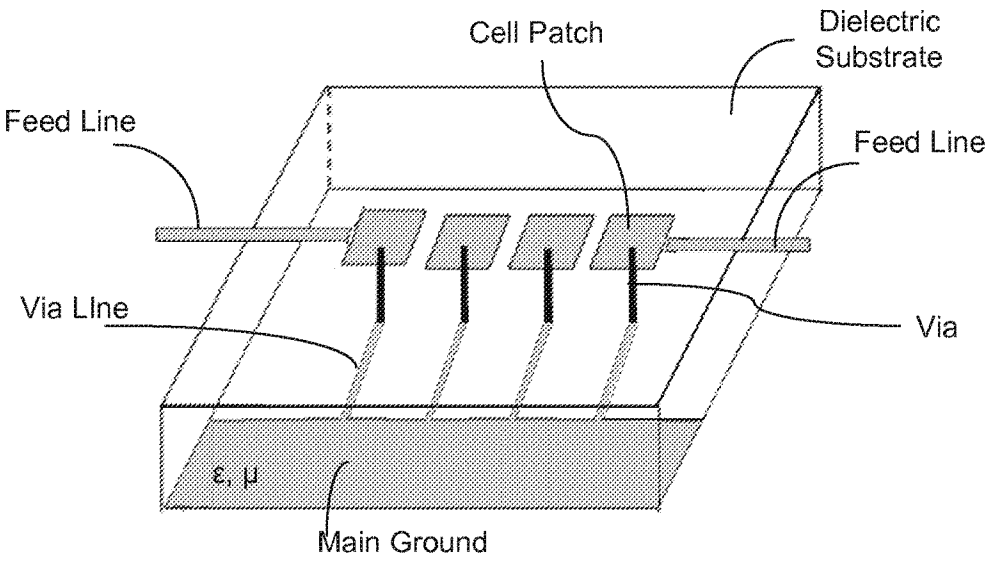
FIG. 11 shows another example of a 1D CRLH MTM TL with a truncated ground based on four unit cells.

FIG. 11 illustrates another example of a MTM antenna having a truncated ground structure. In this example, the ground conductive layer includes via lines and a main ground that is formed outside the footprint of the cell patches. Each via line is connected to the main ground at a first distal end and is connected to the via at a second distal end. The via line has a width that is less than a dimension of the cell path of each unit cell.

The equations for the truncated ground structure can be derived. In the truncated ground examples, the shunt capacitance CR becomes small, and the resonances follow the same equations as in Eqs. (1), (5) and (6) and Table 1. Two approaches are presented. FIGS. 8 and 9 represent the first approach, Approach 1, wherein the resonances are the same as in Eqs. (1), (5) and (6) and Table 1 after replacing LR by (LR+Lp). For |n|≠0, each mode has two resonances corresponding to (1) ω±n for LR being replaced by (LR+Lp) and (2) ω±n for LR being replaced by (LR+Lp/N) where N is the number of unit cells. Under this Approach 1, the impedance equation becomes:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)}, \quad \text{Eq. (11)}$$

$$\text{where } \chi = -YZ \text{ and } \chi = -YZ_P,$$

where Zp=jωLp and Z, Y are defined in Eq. (2). The impedance equation in Eq. (11) provides that the two resonances ω and ω' have low and high impedances, respectively. Thus, it is easy to tune near the ω resonance in most cases.

Figure 12:
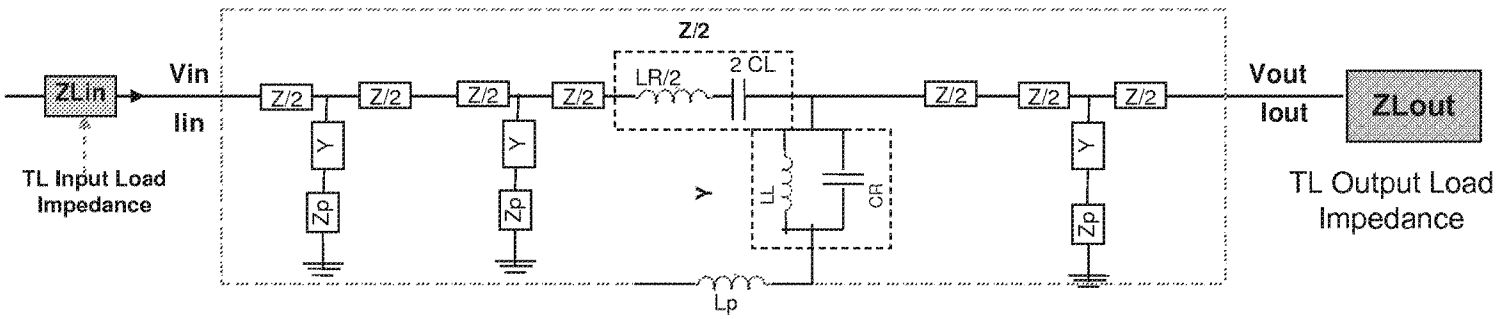
FIG. 12 shows an equivalent circuit of the 1D CRLH MTM TL with the truncated ground shown in FIG. 11.

The second approach, Approach 2, is illustrated in FIGS. 11 and 12 and the resonances are the same as in Eqs. (1), (5), and (6) and Table 1 after replacing LL by (LL+Lp). In the second approach, the combined shunt inductor (LL+Lp) increases while the shunt capacitor CR decreases, which leads to lower LH frequencies.

The above exemplary MTM structures are formed on two metallization layers and one of the two metallization layers is used as the ground electrode and is connected to the other metallization layer through a conductive via. Such two-layer CRLH MTM TLs and antennas with a via can be constructed with a full ground electrode as shown in FIGS. 1 and 5 or a truncated ground electrode as shown in FIGS. 8 and 10.

SLM and TLM-VL MTM structures described here simplify the above two-layer-via design by either reducing the two-layer design into a single metallization layer design or by providing a two-layer design without the interconnecting vias. SLM and TLM-VL MTM structures may be used to reduce device cost and simplify manufacturing. Specific examples and implementations of such SLM MTM structures and TLM-VL MTM structures are described below.

A SLM MTM structure, despite its simpler structure, can be implemented to perform functions of a two-layer CRLH MTM structure with a via connected to a truncated ground. In a two-layer CRLH MTM structure with a via connecting the two metallization layers, the shunt capacitance CR is induced in the dielectric material between the cell patch on the top layer and the ground metallization on the bottom layer and the value of CR tends to be small with the truncated ground electrode in comparison with a design that has a full ground electrode.

A SLM MTM structure can be formed in a single conductive layer to have various circuit components and the ground electrode. In one implementation, a SLM MTM structure includes a dielectric substrate having a first substrate surface and an opposite substrate surface, a metallization layer formed on the first substrate surface and patterned to have two or more metallization parts to form a single-layer metamaterial structure within the metallization layer without a conductive via penetrating the dielectric substrate. The metallization parts in the metallization layer include a first metal patch as a unit cell patch of the SLM MTM structure, a second metal patch as a ground electrode for the unit cell and spatially separated from the unit cell patch, a via metal line that interconnects the ground electrode and the unit cell patch, a signal feed line that electromagnetically coupled to the unit cell patch without being directly in contact with the unit cell patch.

Therefore, there is no dielectric material vertically sandwiched between two metallization parts in this SLM MTM structure. As a result, the shunt capacitance CR of the SLM MTM structure is negligibly small with a proper design. A small shunt capacitance can still be induced between the cell patch and the ground electrode, both of which are in the single metallization layer. The shunt inductance LL in the SLM MTM structure is negligible due to the absence of the via penetrating the substrate, but the inductance Lp can be relatively large due to the via metal line in the metallization layer connected to the ground electrode.

Figure 13A:
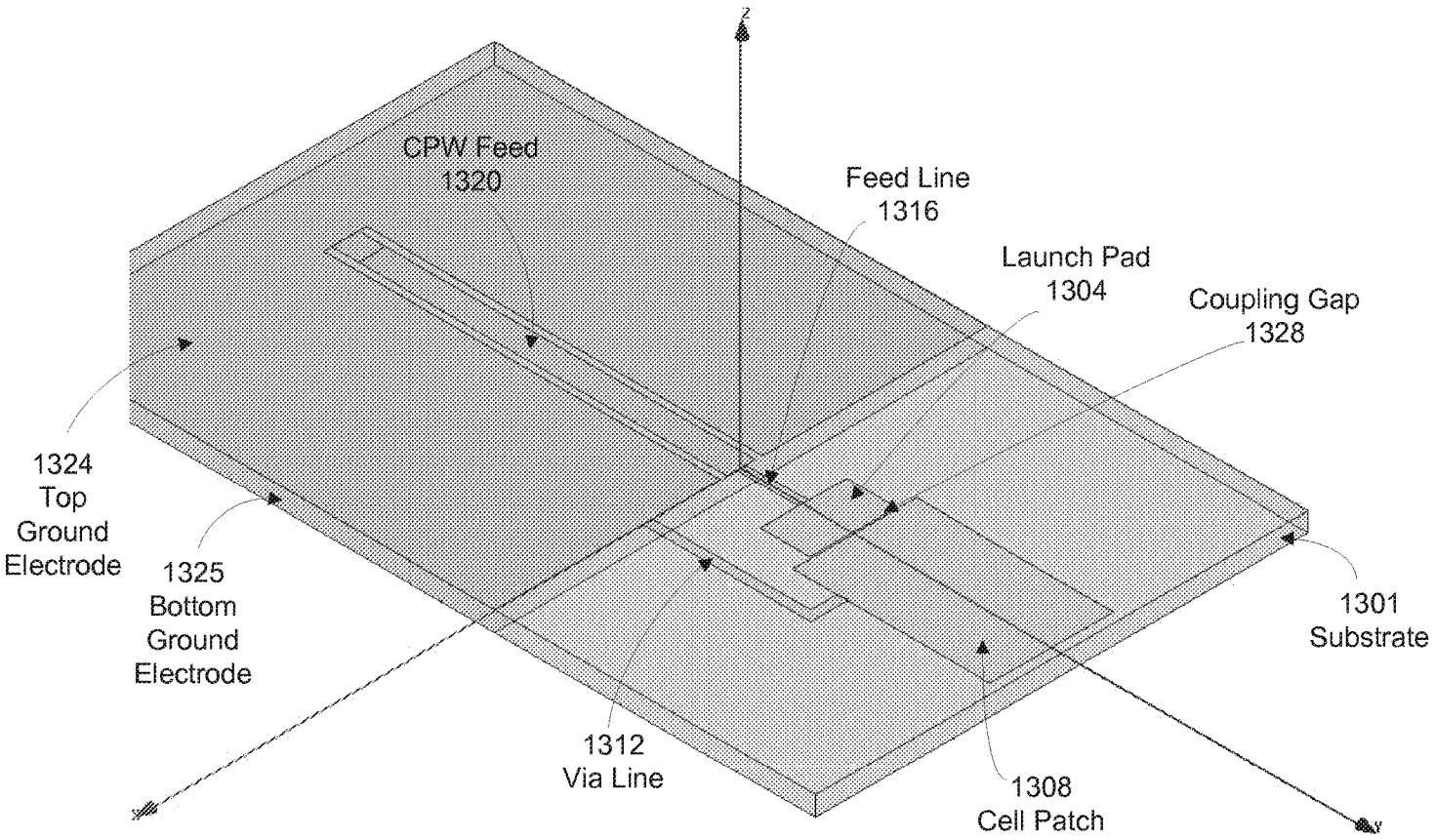
FIGS. 13(*a*)-13(*c*) show an example of a one-cell SLM MTM antenna structure, illustrating the 3D view, top view of the top layer and side view, respectively.
Figure 13B:
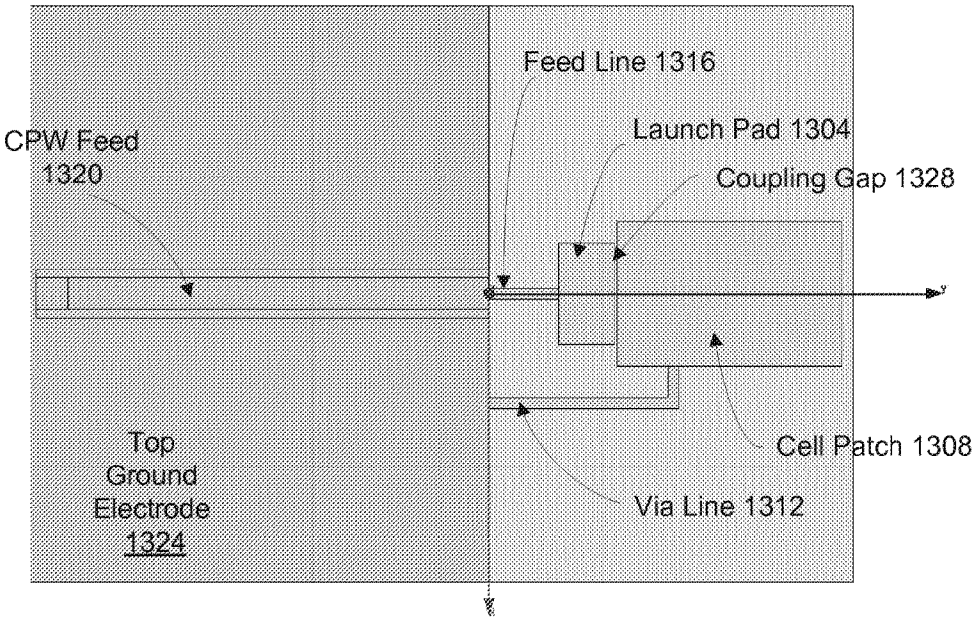
Figure 13C:
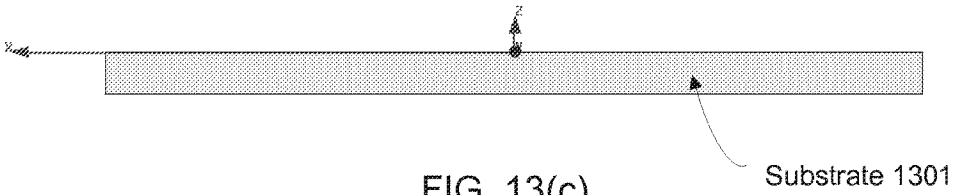

FIGS. 13(*a*)-13(*c*) show an example of a one-cell SLM MTM antenna, showing the 3D view, top view of the top layer and side view, respectively. This one-cell SLM MTM antenna is formed on a substrate 1301. A top metallization layer is formed on the top surface of the substrate 1301 and is patterned to form components of the SLM cell and the ground electrode for the SLM cell.

More specifically, the top metallization layer is patterned into various metal parts: a top ground electrode 1324, a metal patch 1308 as a cell patch which is spaced from the top ground electrode 1324, a launch pad 1304 separate from the cell patch 1308 by a coupling gap 1328, and a via line 1312 that interconnects the top ground electrode 1324 and the cell patch 1308. A feed line 1316 is formed in the top metallization layer and is connected to the launch pad 1304 to direct a signal to or receive a signal from the cell patch 1308. This single metallization layer design eliminates the need for a truncated ground formed on the bottom surface of the substrate 1301 and a conductive via that penetrates through the substrate 1301 to connect the cell patch 1308 and the truncated ground.

In the illustrated example, the bottom surface of the substrate 1301 has a bottom metallization layer that is not used to construct a component of the SLM MTM structure. This bottom metallization layer is patterned to form a bottom ground electrode 1325 that occupies a portion of the substrate 1301 while exposing another portion of the bottom surface of the substrate 1301. The cell patch 1308 of the SLM MTM structure formed in the top metallization layer is located above the portion of the bottom surface that is free of the bottom metallization and is not above the bottom ground electrode 1325 to eliminate or minimize the shunt capacitance associated with the cell patch 1308. The top ground electrode 1324 is formed above the bottom ground electrode 1325 so that a co-planer waveguide (CPW) feed 1320 can be formed in the top electrode ground 1324. This CPW feed 1320 is connected to the feed line 1316 to direct a signal to or receive a signal from the cell patch 1308. Therefore, in this particular example, the CPW ground is formed by top and bottom ground planes or electrodes 1324 and 1325 and the bottom ground electrode 1325 is provided to achieve the CPW design for the feed line. In other implementations where the above particular CPW design is not used, the bottom ground electrode 1325 can be eliminated. For example, the antenna formed by the SLM MTM structure can be fed with a CPW line that does not require a bottom ground electrode 1325 and is supported by the top ground electrode 1324 only, or a probed patch, or a cable connector.

To a certain extent, the present SLM MTM antenna can be viewed as a MTM structure in which the via and via line in a two-layer MTM antenna are replaced with a via line located on the top metallization layer. The position and length of the via line 1312 can be designed to produce desired impedance matching conditions and to produce desired one or more frequency bands.

Notably, in this one-cell SLM MTM antenna structure, the portion of the bottom surface of the substrate 1301 underneath the cell patch 1308 is free of a metal part and there is no truncated ground or metallization areas directly below the cell patch 1308 on the bottom layer of the substrate 1301. The feed line 1316 delivers power of an electromagnetic signal from the CPW feed 1320 to the launch pad 1304, which capacitively couples the electromagnetic signal to the cell patch 1308 through a coupling gap 1328. The dimension of the gap 1328 can be set based on the design, such as a few mils in one implementation. The cell patch 1308 is connected to the ground electrode 1324 through the via line 1312. The SLM MTM antenna equivalent circuit is similar to the equivalent circuit for the two-layer CRLH MTM antenna with a via connected to a truncated ground, analyzed in the previous sections, except that the shunt capacitance CR and the shunt inductor LL are negligible but Lp is large in the SLM MTM antenna.

Table 2 is a summary for the elements of the one-cell SLM antenna structure shown in FIGS. 13(*a*), 13(*b*) and 13(*c*).

TABLE 2

| Parameter | Description | | Location |
|---|---|---|---|
| Antenna Element | Each antenna element comprises an SLM Cell connected to the CPW Feed 1320 through a Launch Pad 1304 and a Feed Line 1316. | | |
| Feed Line | Connects the Launch Pad 1304 with the CPW Feed 1320. | | Top Layer |
| Launch Pad | Rectangular shape that connects a Cell Patch 1308 to the Feed Line 1316. There is a Coupling Gap 1328 between the Launch Pad 1304 and Cell Patch 1308. | | Top Layer |
| SLM Cell | Cell Patch | Rectangular shape | Top Layer |
| | Via Line | Line that connects the Cell Patch 1308 with the top ground electrode 1324 | Top Layer |

The one-cell SLM antenna structure shown in FIGS. 13(*a*), 13(*b*) and 13(*c*) can be implemented for various applications. For example, design parameters associated with the SLM MTM antenna specifically for WiFi applications can be selected as follows: the substrate 1332 is 20 mm wide and 0.787 mm thick; the material is FR4 with a dielectric constant of 4.4; the feed line 1316 is 0.4 mm wide; the gap between the launch pad 1304 and the edge of the ground electrode 1324 is 2.5 mm; the launch pad 1304 has 3.5 mm in width and 2 mm in length; the cell patch 1308 is 8 mm long and 5 mm wide and is located at 0.1 mm away from the launch pad 1304; and the portion of the via line 1312 that connects to the cell patch 1308 is 2 mm offset from the middle length of the cell.

Figure 14A:
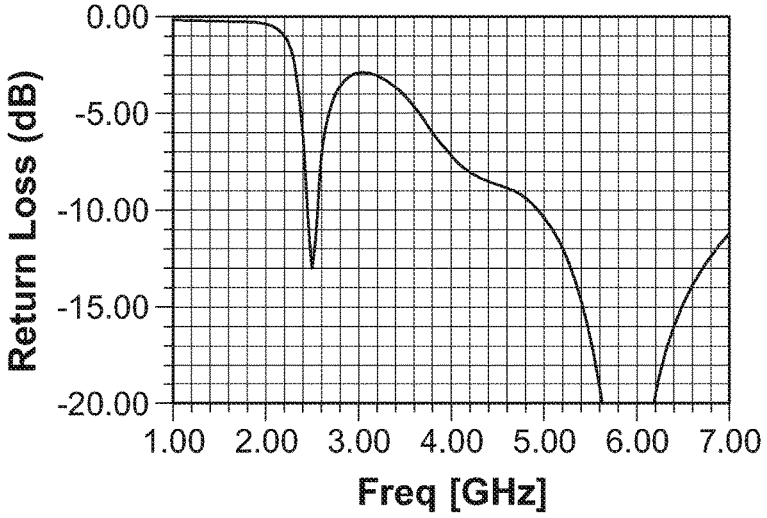
FIG. 14(*a*) shows the simulated return loss of the one-cell SLM MTM antenna shown in FIGS. 13(*a*)-13(*c*).
Figure 14B:
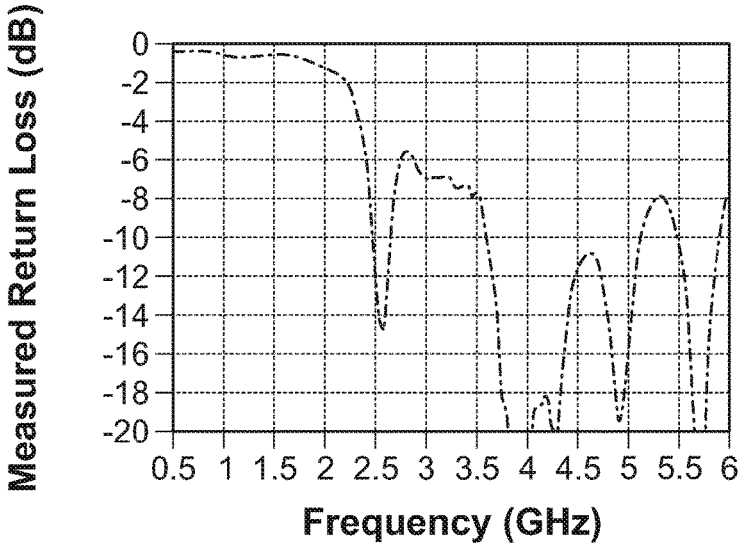
Figure 14C:
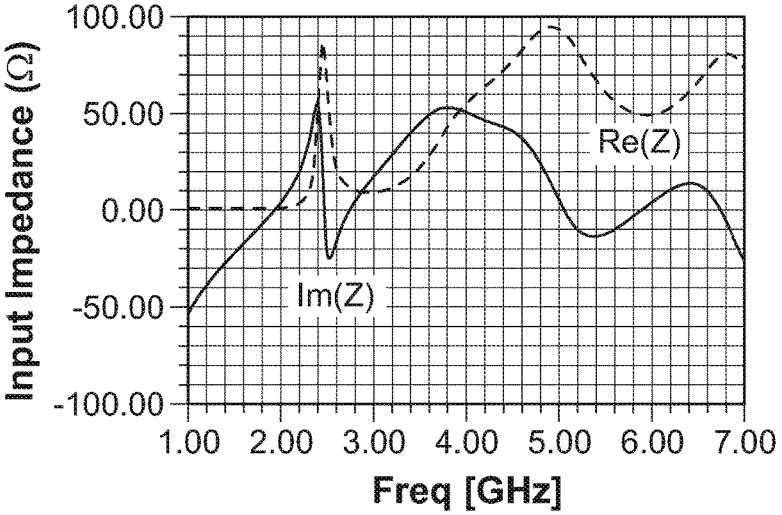

The analyses for two-layer MTM structures are described in the previous sections. Similar analyses can be carried out for the case of a truncated ground with a negligible shunt capacitance CR for the one-cell (N=1) SLM MTM antenna. This exemplary antenna with the above parameter values has two frequency bands as illustrated in the simulated return loss in FIG. 14(*a*) and the measured return loss in FIG. 14(*b*). The lowest band has LH contributions and is centered at 2.45 GHz. This band has a bandwidth of about 100 MHz at −10 dB as shown in FIG. 14(*a*). The 50-Ω matching occurs at the high-frequency edge of the LH band as illustrated in FIG. 14(*c*), which shows the simulated input impedance.

The above one-cell SLM MTM antenna formed in the single-layer metamaterial structure can be used to construct SLM MTM antennas with two or more electromagnetically coupled cells. Such a SLM MTM antenna includes at least a first cell metal patch formed at a first location on a first substrate surface of a substrate and a second cell metal patch formed at a second location on the first substrate surface, a ground electrode formed at a third location on the first substrate surface that is spaced from the first and second locations as the ground for the first and second cell metal patches, and at least one feed line formed on the first substrate surface and electromagnetically coupled to one of the first and second cell metal patches. For each cell metal patch, a via line is formed on the first substrate surface to include a first end that is connected to the ground electrode and a second end that is connected to the cell metal patch. On the second substrate surface on the opposite side of the first substrate surface, no metal part is formed at a location corresponding to a cell metal patch on the first substrate surface.

Figure 15:
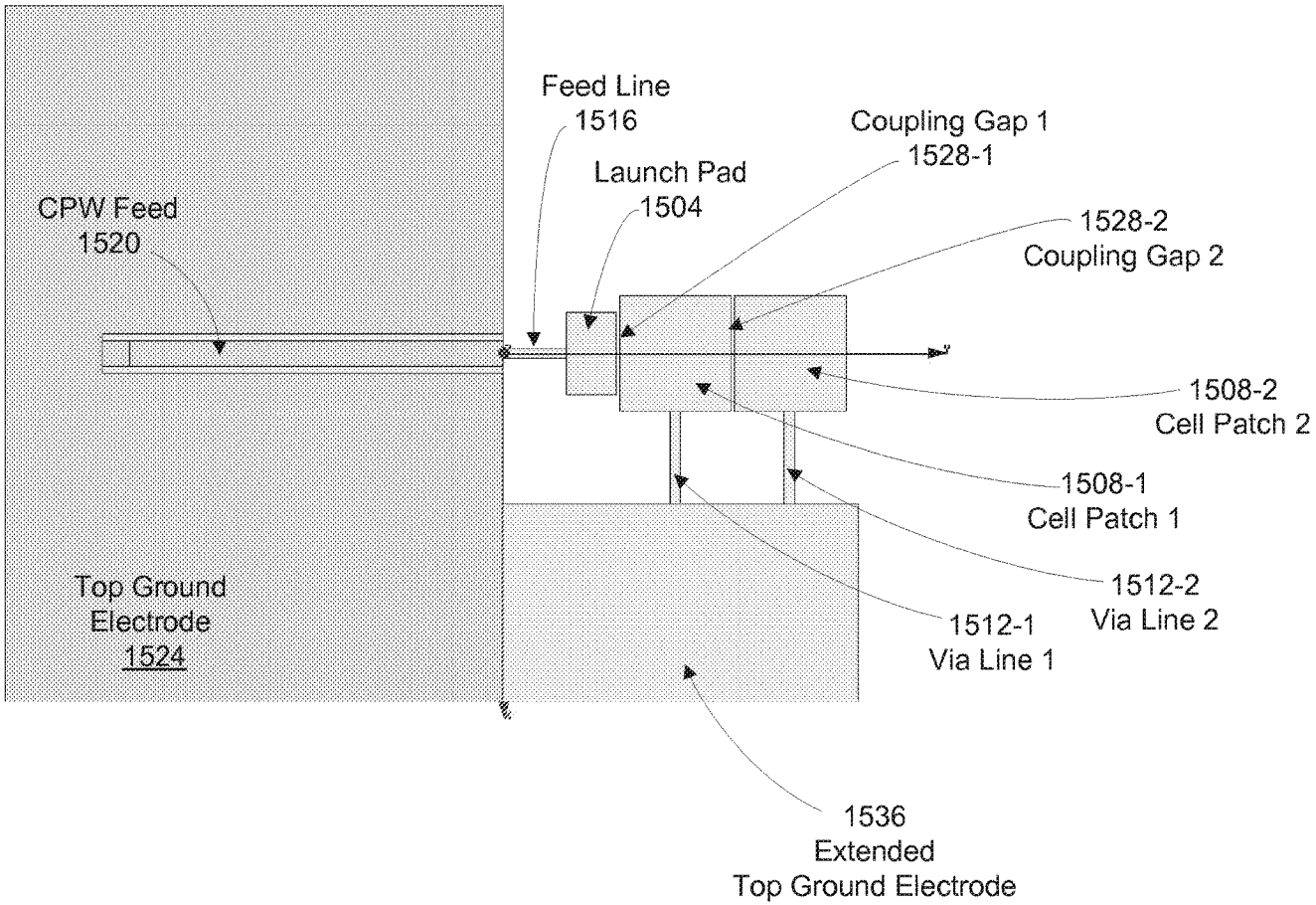
FIG. 15 shows the 3D view of an example of a two-cell SLM MTM antenna.

FIG. 15 illustrates an example of a two-cell SLM MTM antenna, which is similar in structure to the previous one-cell SLM MTM antenna in FIG. 13(*a*), except that the top ground electrode is extended to the front of the two cell patches 1508-1 and 1508-2 to connect the two cell patches 1508-1 and 1508-2 by two separate via lines 1512-1 and 1512-2 to the top ground electrode. Similar to FIG. 13(*a*), the bottom surface of the substrate for the two-cell SLM MTM antenna in FIG. 15 has a bottom metallization layer that is patterned to form a bottom ground electrode which forms the CPW ground with the top ground electrode 1524 and is not used to construct a component of the SLM MTM structure. This bottom metallization layer is patterned with the bottom ground electrode to occupy a portion of the bottom surface of the substrate while exposing another portion of the bottom surface of the substrate. The top ground electrode 1524 and the two SLM cells 1508-1 and 1508-2 are formed on the top surface of the substrate. The unit cell patches 1508-1 and 1508-2 in the top metallization layer are located above the portion of the bottom surface that is free of the bottom metallization to eliminate or minimize the shunt capacitance associated with the unit cell patches 1508-1 and 1508-2. The bottom ground electrode and the top ground electrode 1524 are used to form the CPW ground to support the CPW feed 1520. In other implementations where the above particular CPW design that requires the bottom ground electrode is not used, the bottom metallization layer can be eliminated and a CPW line that does not require a bottom ground plane, or a probed patch, or a cable connector can be used to supply signals to or receive signals from the two-cell antenna.

Specifically, the cell patch 1 (1508-1) and cell patch 2 (1508-2) of two-cell SLM antenna are located to be next to each other and are separated by a coupling gap 2 (1528-2) to provide electromagnetic coupling therebetween. A launch pad 1504 in the top metallization layer couples the electromagnetic signal to or from the cell patch 1 (1508-1) through a coupling gap 1 (1528-1). A feed line 1516 formed in the top metallization layer connects a grounded CPW feed 1520, a metal strip that is separated from the ground electrode 1524 by a narrow gap, with the launch pad 1504. The top ground electrode 1524 has a extended portion or protrusion 1536 located in front of the two cell patches 1508-1 and 1508-2. This configuration enables two via lines 1512-1 and 1512-2 connecting the two cell patches 1508-1 and 1508-2 to the top ground electrode to be substantially equal in length.

Figure 16A:
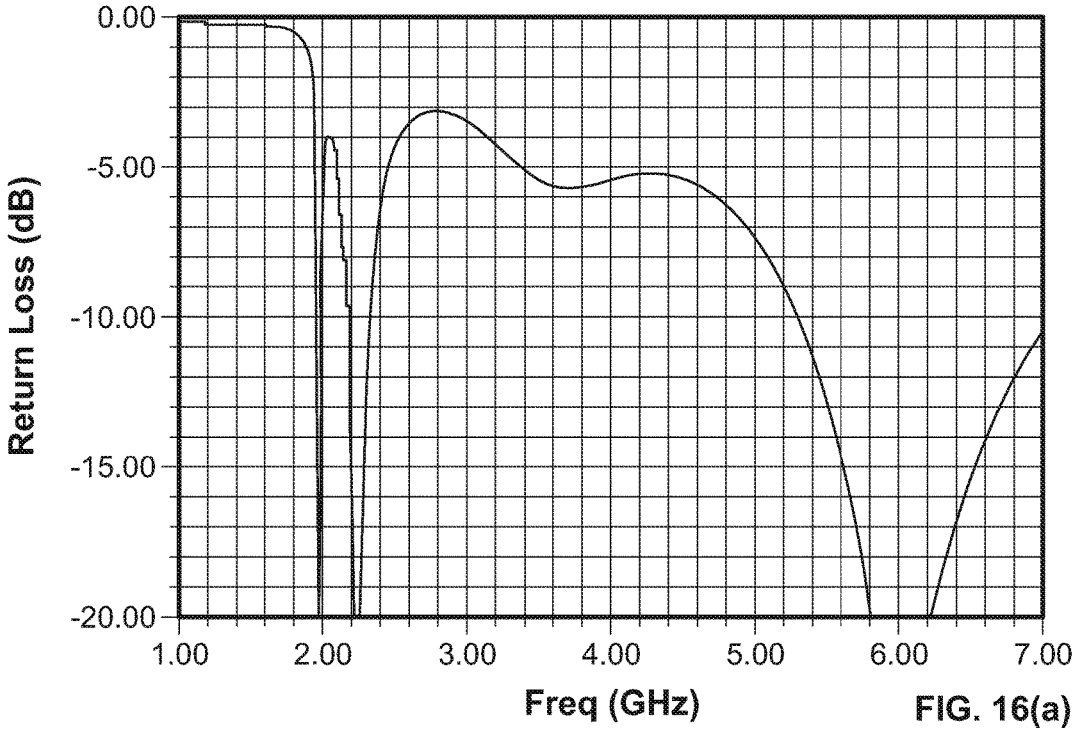
FIG. 16(*a*) shows the simulated input impedance of the two-cell SLM MTM antenna shown in FIG. 15.
Figure 16B:
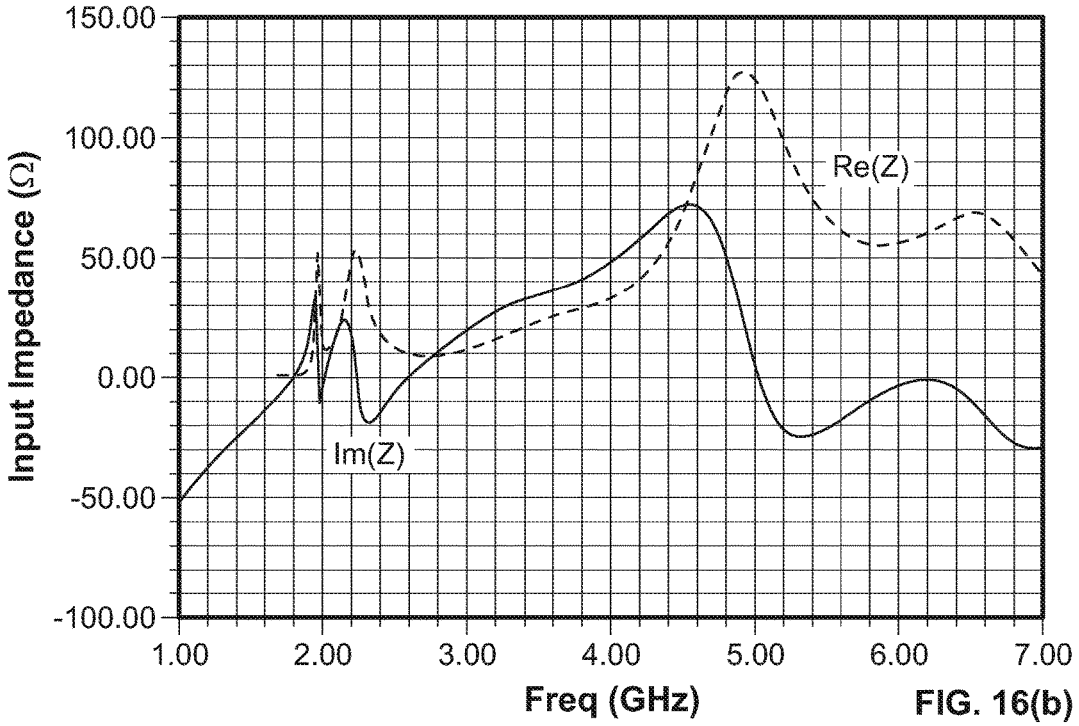

The analyses for two-layer MTM structures are described in the previous sections. Similar analyses can be carried out for the case of a truncated ground with a negligible shunt capacitance CR for the two-cell (N=2) SLM MTM antenna. The simulated return loss for the two-cell SLM MTM antenna is shown in FIG. 16(*a*). The comparison of the return losses between the one-cell design in FIG. 13(*a*) and two-cell designs in FIG. 15 shows that the lowest and narrow resonance of the two-cell SLM MTM antenna in FIG. 16(*a*) corresponds to higher-order LH modes. The simulated input impedance is shown in FIG. 16(*b*).

Figure 17:
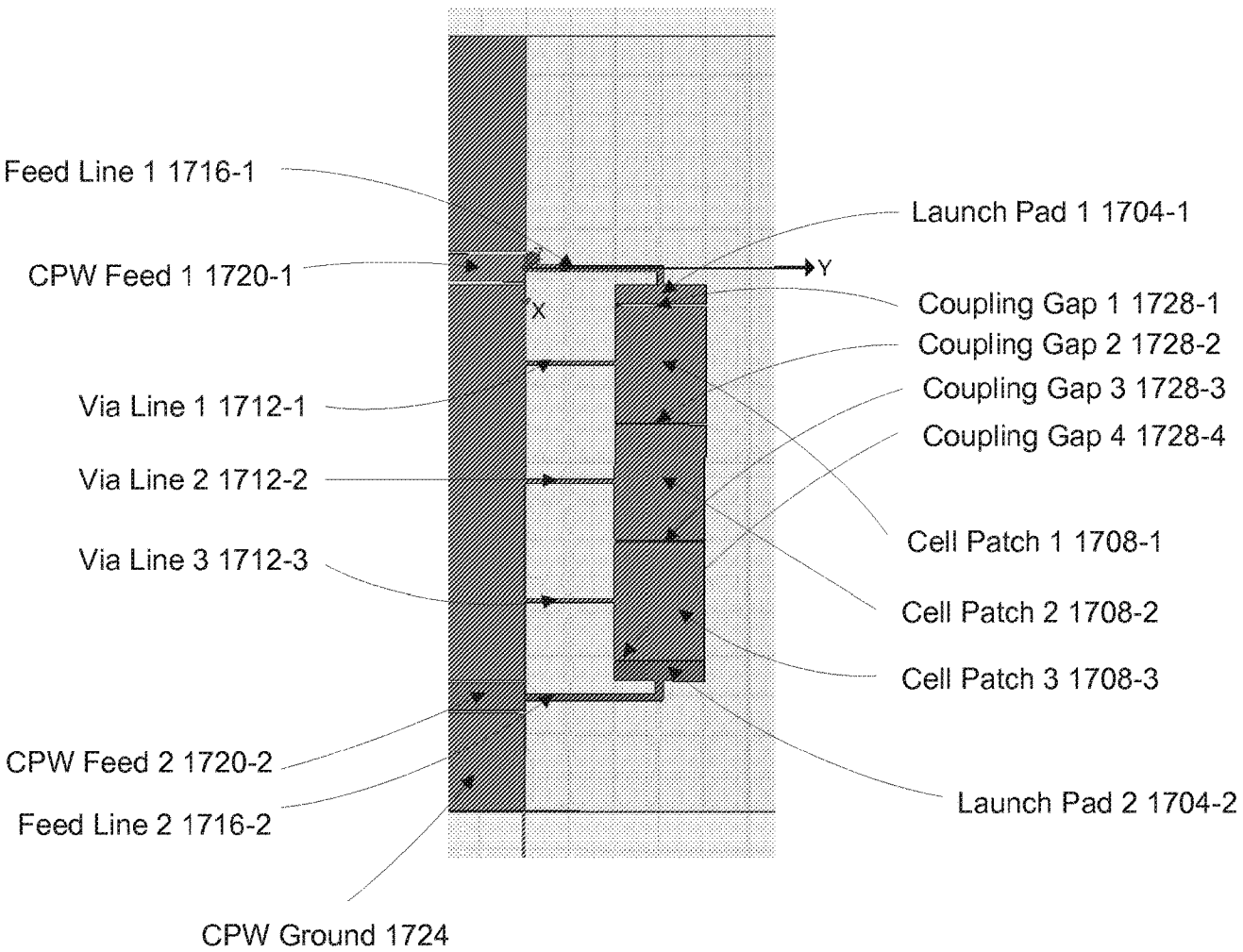
FIG. 17 shows an example of a three-cell MTM TL.

FIG. 17 shows an example of three-cell transmission line (TL) in a SLM MTM configuration where only the top metallization layer pattern is shown. The values of the electromagnetic guided wavelengths corresponding to two different resonances in the low frequency region of this TL confirm that the low frequency resonances are indeed in the LH region. This TL structure comprises three cell patches 1728-1, 1728-2 and 1728-3 placed in a row with a coupling gap between two adjacent cell patches to provide electromagnetic coupling without direct contact. The cell patches 1728-1, 1728-2 and 1728-3 are connected to the ground electrode 1724 through three via lines 1712-1, 1712-2 and 1712-3, respectively. Two feed lines 1716-1 and 1716-2 are electromagnetically coupled two end cell patches 1708-1 and 1708-3 as the input and output of the TL. Two CPW feeds 1720-1 and 1720-2 are connected to the feed lines 1716-1 and 1716-2, respectively to deliver some signal power to both ends of the three-cell series, respectively. The rest of the signal power is radiated. The first cell patch 1708-1 is capacitively coupled over a coupling gap 1 (1728-1) to a launch pad 1 (1704-1), which is coupled to the CPW feed 1 (1720-1) through the feed line 1 (1716-1). The second cell patch 2 (1708-2) is capacitively coupled to the first cell patch 1 (1708-1) over a coupling gap 1728-2, and the third cell patch 1708-3 is capacitively coupled to the second cell patch 1708-2 over a coupling gap 1728-3. The other end of the third cell patch 1708-3 is coupled to the CPW feed 2 (1720-2) through a launch pad 2 (1704-2) and the feed line 2 1716-2, with a coupling gap 4 (1728-4) between the launch pad 2 (1704-2) and the third cell patch (1708-3).

Figure 18:
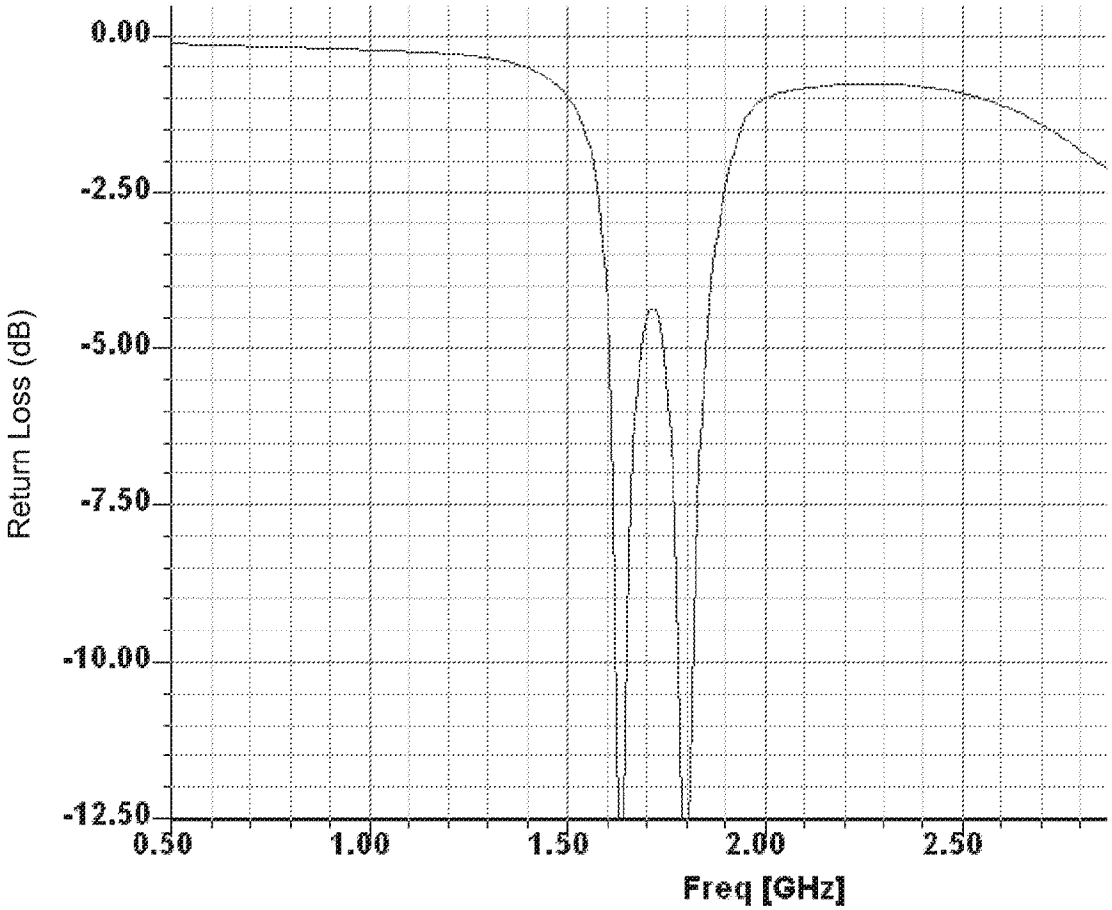
FIG. 18 shows the simulated return loss of the three-cell MTM TL shown in FIG. 17.
Figure 19B:
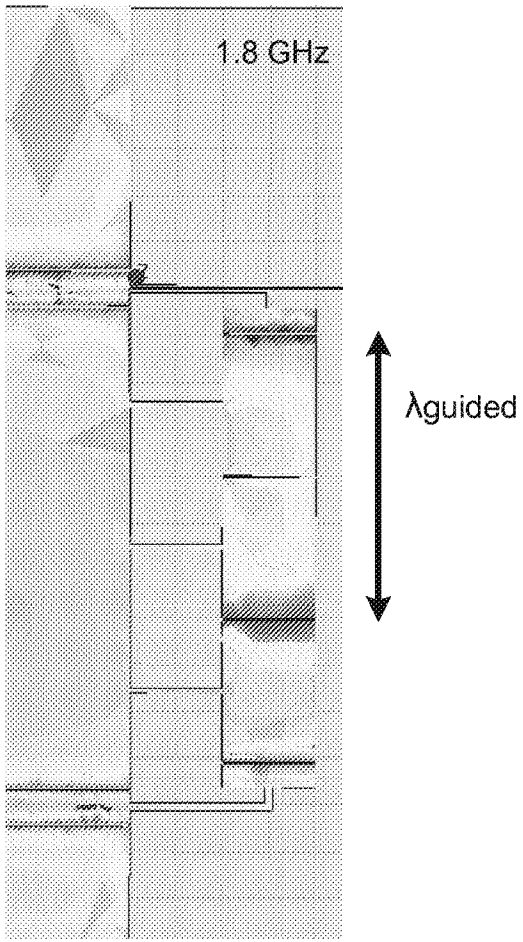
FIGS. 19(*a*) and 19(*b*) show the electromagnetic guided wavelengths corresponding to the 1.6 GHz resonance and 1.8 GHz resonance, respectively.
Figure 19A:
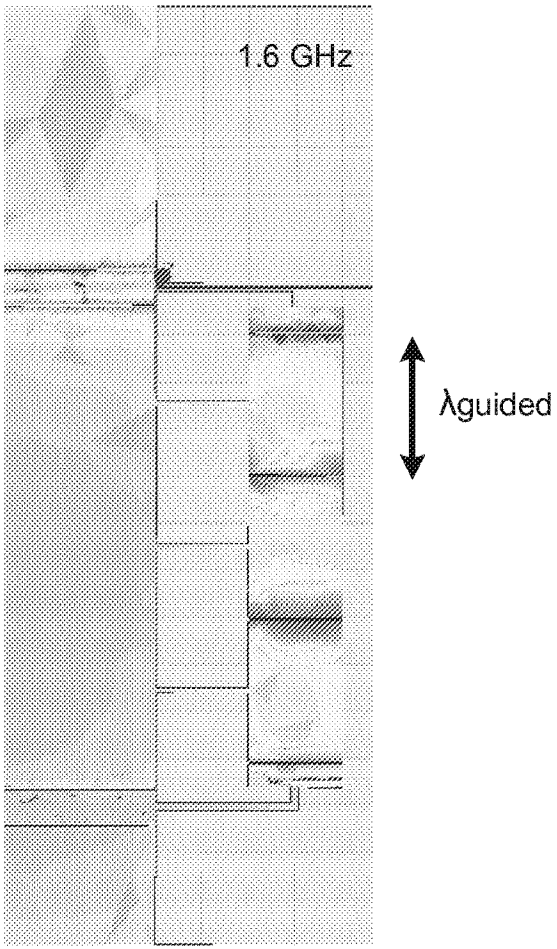
Figure 20A:
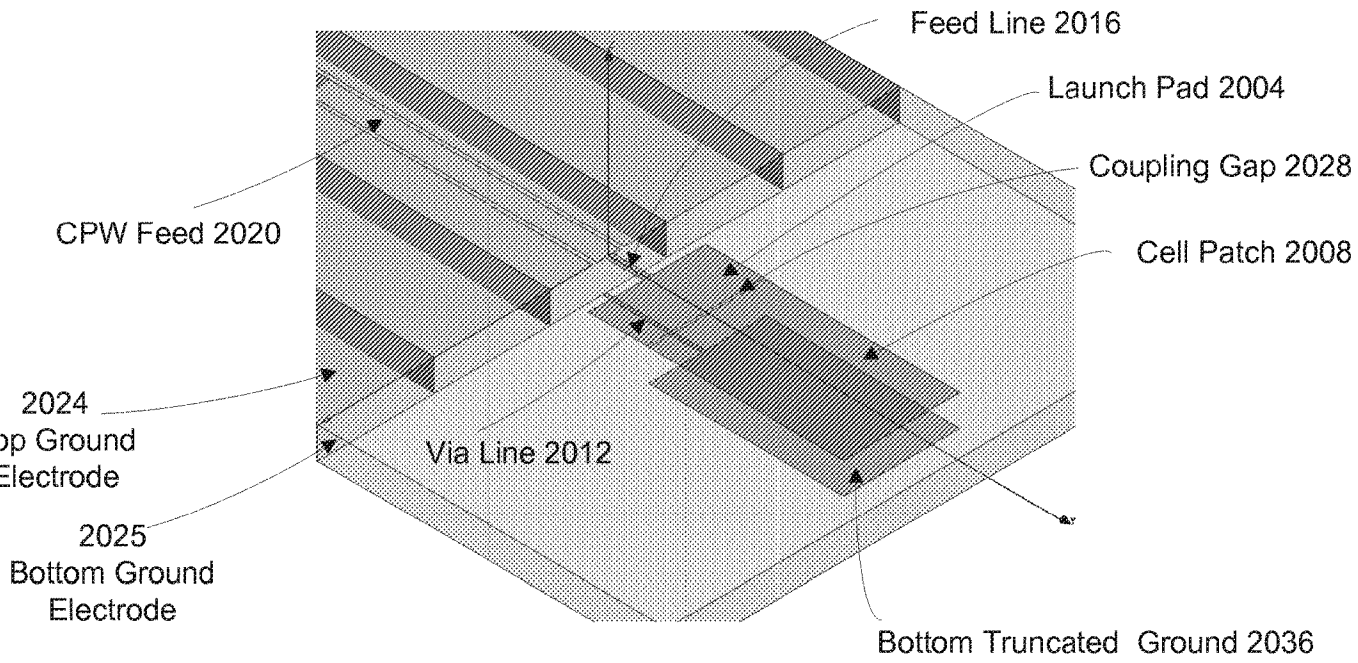
FIGS. 20(*a*)-20(*d*) show an example of a one-cell TLM-VL MTM antenna structure, illustrating the 3D view, side view, top view of the top layer and top view of the bottom layer, respectively.
Figure 20B:
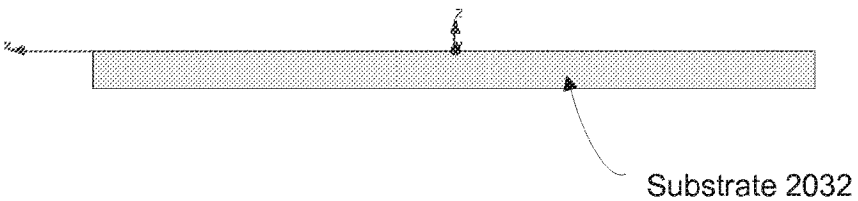
Figure 20D:
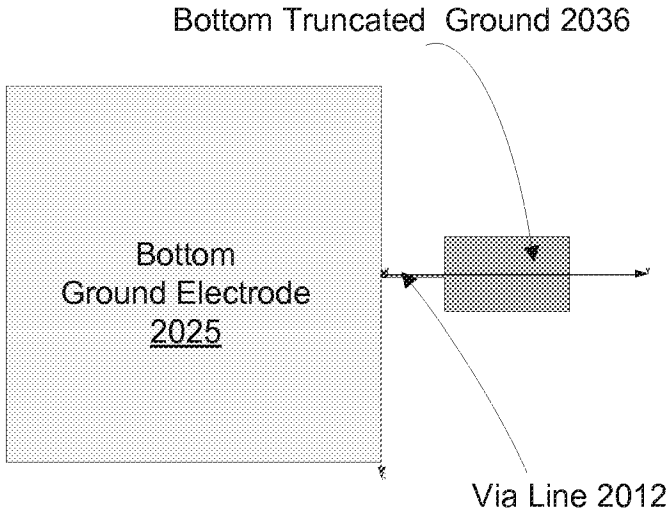
Figure 20C:
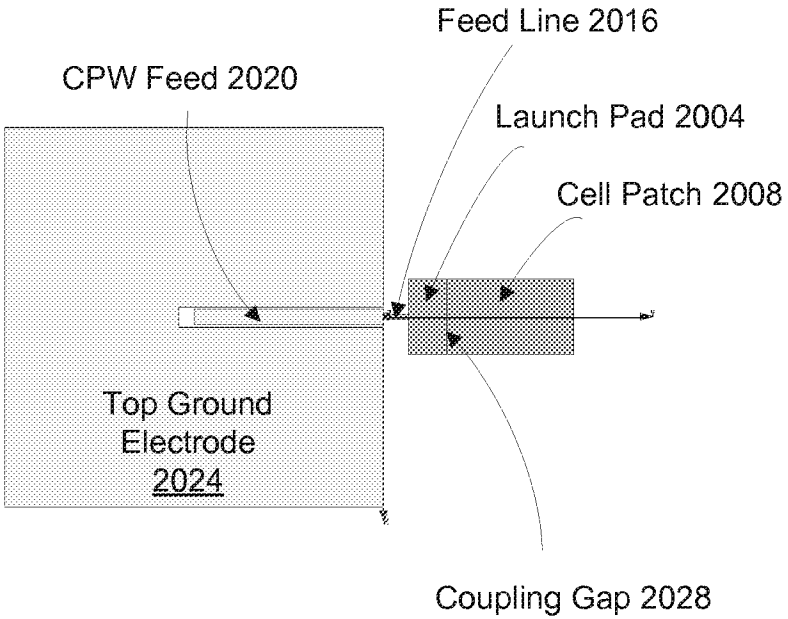

The design parameters are chosen to generate the 1.6 GHz and 1.8 GHz resonances in the simulated return loss as shown in FIG. 18. The electromagnetic guided wavelengths corresponding to these two resonances are depicted in FIGS. 19(*a*) and 19(*b*), respectively. In the conventional non-MTM right-hand (RH) RF circuits, the guided wavelength increases as the frequency decreases, thereby making RH RF structures larger for lower frequencies. On the other hand, in the left-hand (LH) MTM RF circuits, the guided wavelength decreases as the frequency decreases. Thus, FIGS. 19(*a*) and 19(*b*) confirm that these low resonances are indeed in the LH region.

In addition to SLM MTM structures, TLM-VL MTM structures also simplify the structure of a two-layer CRLH MTM antenna with a via connected to a bottom truncated ground by eliminating the via as a via-less (VL) MTM structure. Such a TLM-VL MTM structure can include a dielectric substrate having a first substrate surface and an opposite substrate surface, and a first metallization layer formed on the first substrate surface and patterned to comprise a ground electrode part and a cell metal patch that are spaced from each other. A feed line is formed on the first substrate surface and is electromagnetically coupled to one end of the cell metal patch. This TLM-VL MTM structure includes a second metallization layer formed on the second substrate surface and patterned to include a metal patch located underneath the cell metal patch without being connected to the cell metal patch by a conductive via that penetrates through the dielectric substrate. The metal patch underneath the top cell metal patch can be a truncated ground. When properly configured, such a TLM-VL MTM structure can be operated to achieve the functions of a two-layer CRLH MTM antenna with a via connected to a truncated ground. Different from a SLM MTM structure, a TLM-VL MTM structure exhibits a small but finite shunt capacitance CR between a cell patch on one metallization layer and a second metallization layer due to the dielectric material sandwiched between the cell patch on the top layer and the truncated ground on the bottom layer. The inductance of the inductor Lp associated with the metal via line is relatively large, and the via line is in series with the shunt capacitor CR. The shunt inductance LL in the TLM-VL MTM is negligible due to the absence of the via. LH resonances can be excited in the frequency region below the minimum of [$\omega_{sh}=1/\sqrt{(LL\ CR)}$, $\omega_{se}=1/\sqrt{(LR\ CL)}$], where LL is defined as (LL+Lp) as in the Approach 2 above.

Figure 21B:
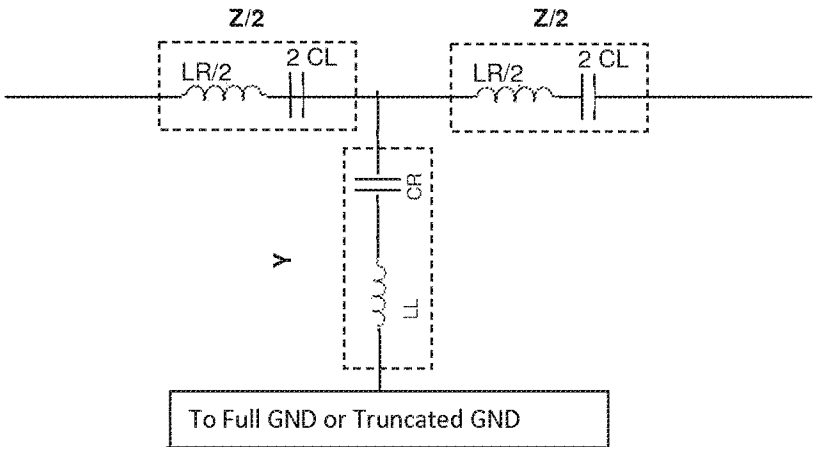
FIG. 21(*a*) shows a simplified equivalent circuit for a two-layer MTM structure with a via.
Figure 21A:
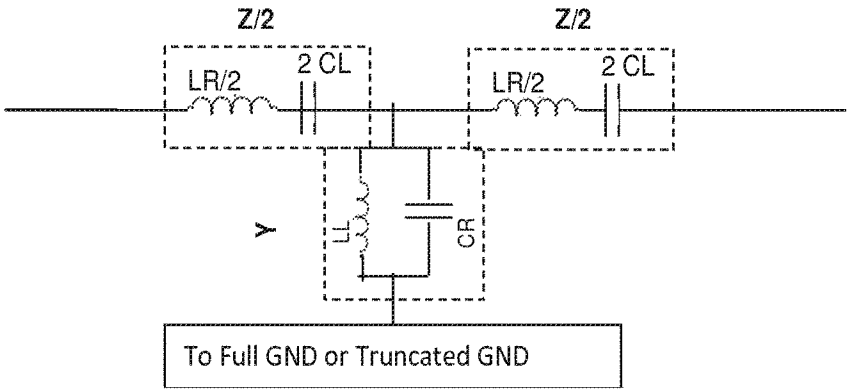

An example of a one-cell TLM-VL antenna is depicted in FIGS. 20(*a*)-20(*d*), showing the 3D view, side view, top view of the top layer and top view of the bottom layer, respectively. This one-cell TLM-VL antenna structure includes components in top and bottom metallization layers. Referring to FIG. 20(*c*), the components in the top metallization layer include a top ground electrode 2024, a CPW feed 2020 formed in a gap in the top ground electrode 2024, a launch pad 2004, a feed line 2016 connecting the CPW feed 2020 and the launch pad 2004, and a cell patch 2008 spaced from the launch pad 2004 by a coupling gap 2028. The bottom metallization layer is patterned to form the bottom ground electrode 2025 underneath the top ground electrode 2024, a bottom truncated ground 2036 underneath the cell patch 2008 and a via line 2012 connecting the bottom truncated ground 2036 and the bottom ground electrode 2025. The feed line 2016 in this example is connected to the CPW feed 2020 that requires a bottom ground plane. Thus, the CPW ground comprises both top and bottom ground electrodes 2024 and 2025 in this example. In other implementations, the antenna can be fed with a conventional CPW line that does not require a bottom ground, with a probed patch, or simply with a cable connector or a microstrip TL. Different from the via-less (VL) design in the SLM MTM structures, a bottom truncated ground 2036 that corresponds to the cell patch on the top surface of the substrate is formed on the bottom surface of the substrate to create a resonating structure. The signal is coupled through the dielectric material between the cell patch 2008 and the bottom truncated ground 2036. The launch pad 2004 couples the electromagnetic signal to the cell patch 2008 through a coupling gap 2028. The dimension of the gap 2008 can be a few mils. Because of the presence of the bottom truncated ground 2036 underneath the cell patch 2008, a shunt capacitor CR is effectuated between the cell patch 2008 and the bottom truncated ground 2036. The via line 2012 that connects the bottom truncated ground 2036 with the bottom ground electrode 2025 induces an inductance (Lp) that is in series with the shunt capacitor CR as shown in FIG. 21(*b*). In this example, the shunt inductor LL is negligible because no vias is involved in the structure. In FIG. 21(*b*), the notation LL represents LL+Lp as in the Approach 2. In a two-layer MTM structure with a via, CR is in parallel with LL, which is induced by the via, as explained in the previous sections with reference to FIGS. 2, 3, 9 and 12. The simplified equivalent circuit is reproduced for the latter case in FIG. 21(*a*) for comparison.

For the TLM-VL antenna structure in FIGS. 20(*a*)-20(*d*), because LL (i.e., Lp) is large and CR is finite, the frequency $$\omega_{sh} = \frac{1}{\sqrt{L_L C_R}}$$

is always less than $$\omega_{se} = \frac{1}{\sqrt{L_R C_L}}.$$

The LH resonances occur below the minimum of $\omega_{sh}$ and $\omega_{se}$. The effective permittivity and permeability are given by the following equations respectively:

$$\varepsilon = -\frac{(\omega_{sh}^2 - \omega^2)}{L_L(\omega^2\omega_{sh}^2)} < 0$$

$$\mu = -L_R\left(\frac{\omega_{se}^2 - \omega^2}{\omega^2}\right) < 0.$$

The resonances are derived in a similar way as explained for a two-layer MTM structure with a via, except for the modification explained above and illustrated in FIGS. 21(*a*) and 21(*b*).

Figure 22A:
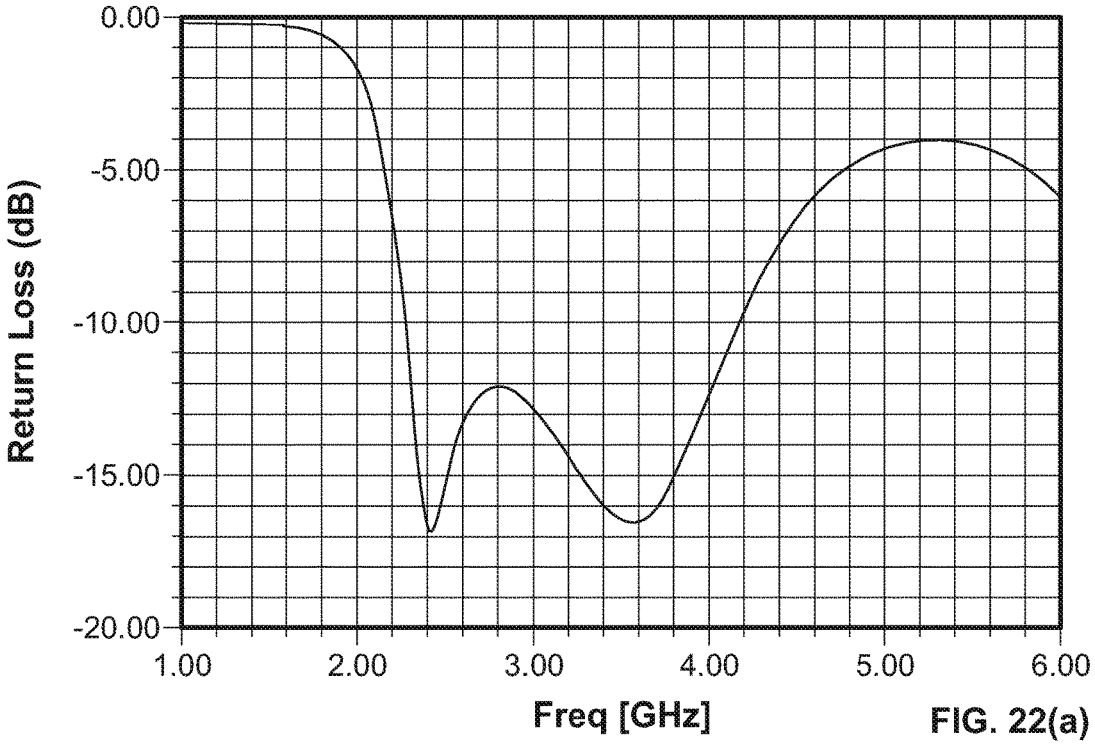
FIG. 22(*a*) shows the simulated return loss of the one-cell TLM-VL MTM antenna shown in FIGS. 20(*a*)-20(*d*).
Figure 22B:
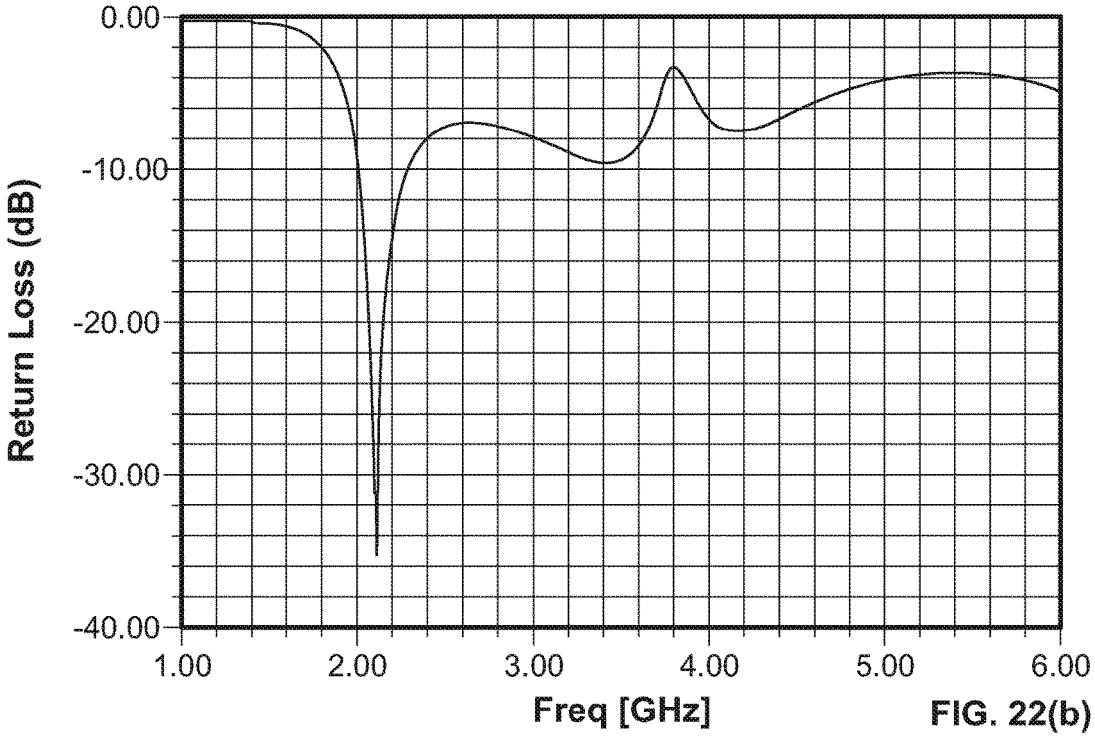
Figure 23:
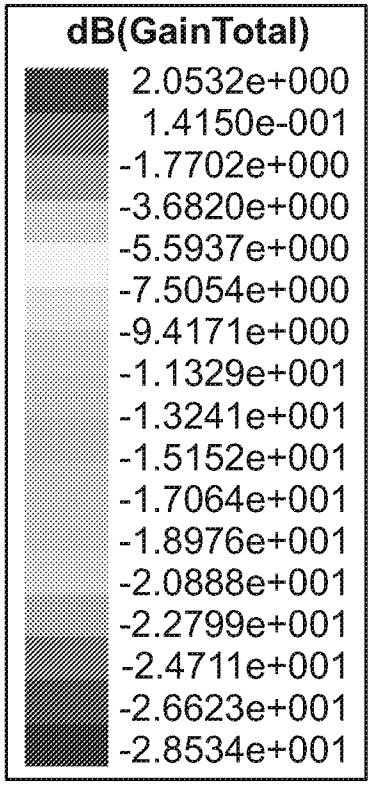
FIG. 23 shows the radiation pattern of the one-cell TLM-VL MTM antenna shown in FIGS. 20(*a*)-20(*d*) at 2.4 GHz.
Figure 23:
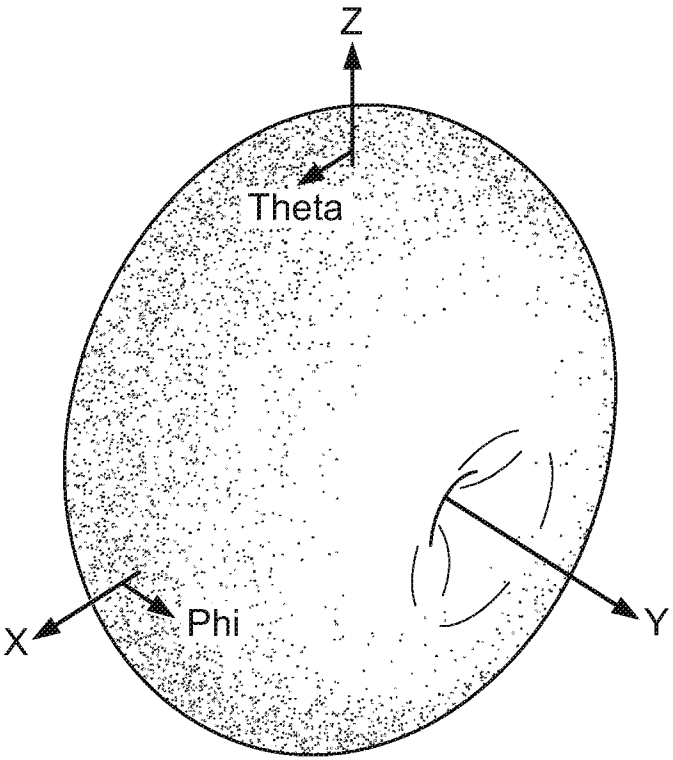
Figure 24A:
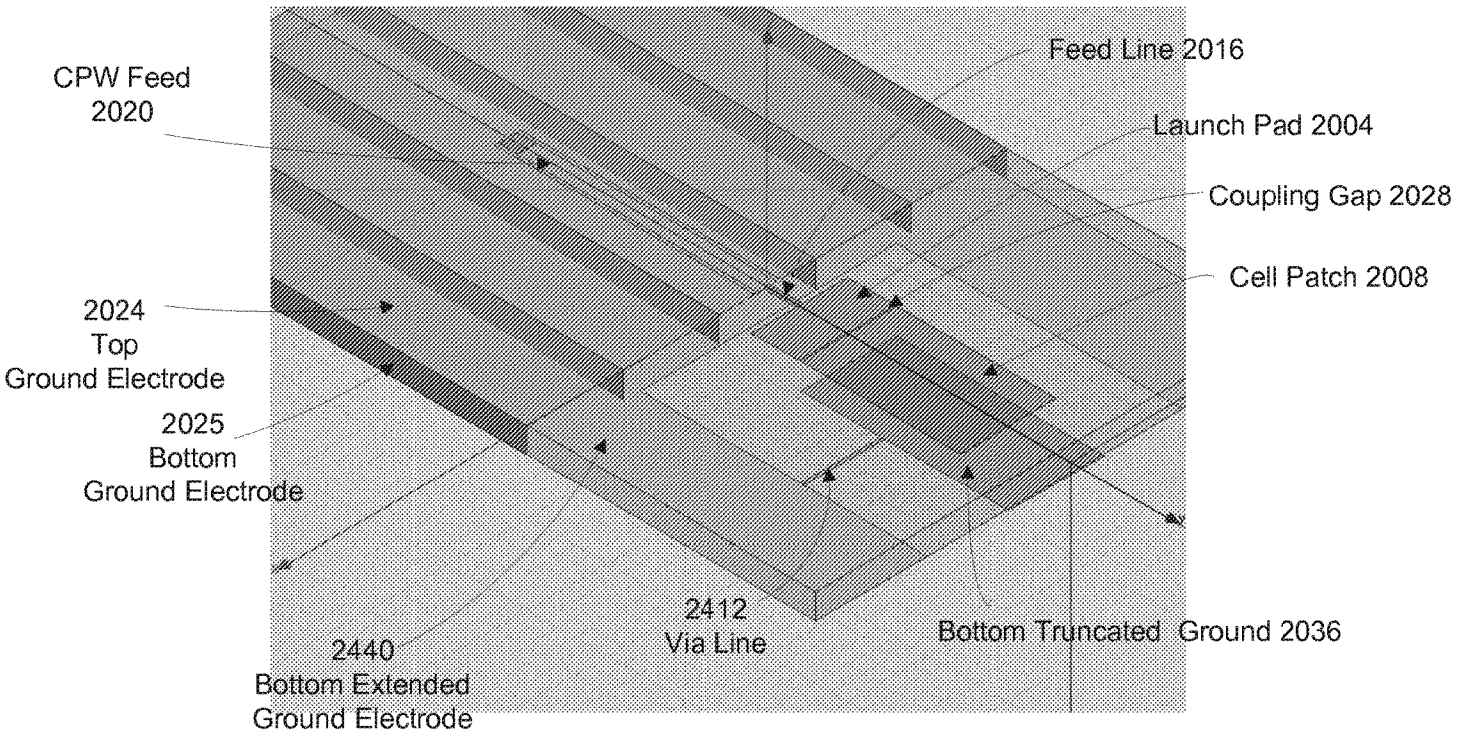
FIGS. 24(*a*)-24(*d*) show an example of a TLM-VL MTM antenna structure with a via line connected to an extended ground electrode, illustrating the 3D view, side view, top view of the top layer and top view of the bottom layer, respectively.
Figure 24B:
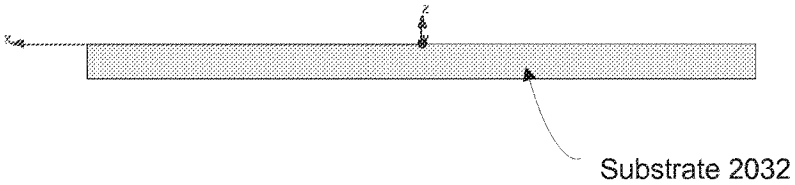
Figure 24D:
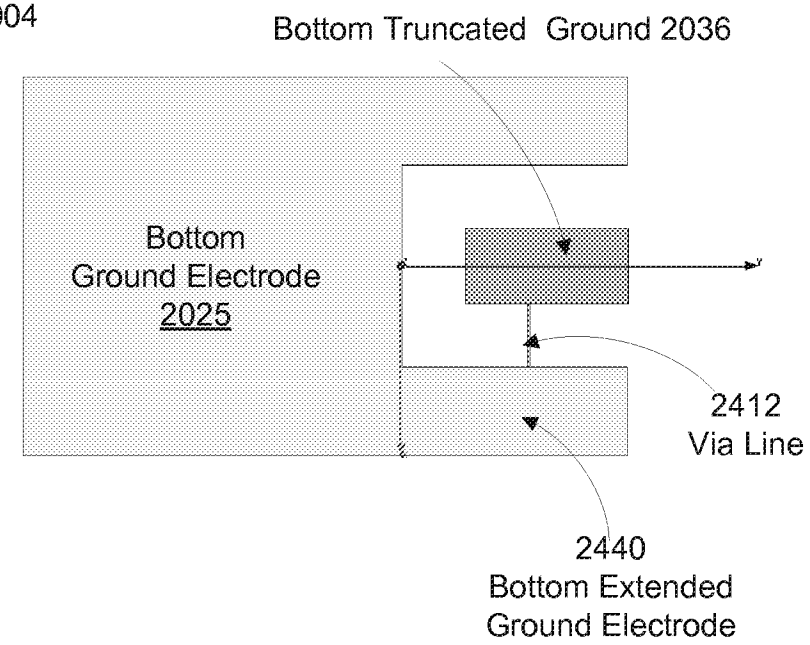
Figure 24C:
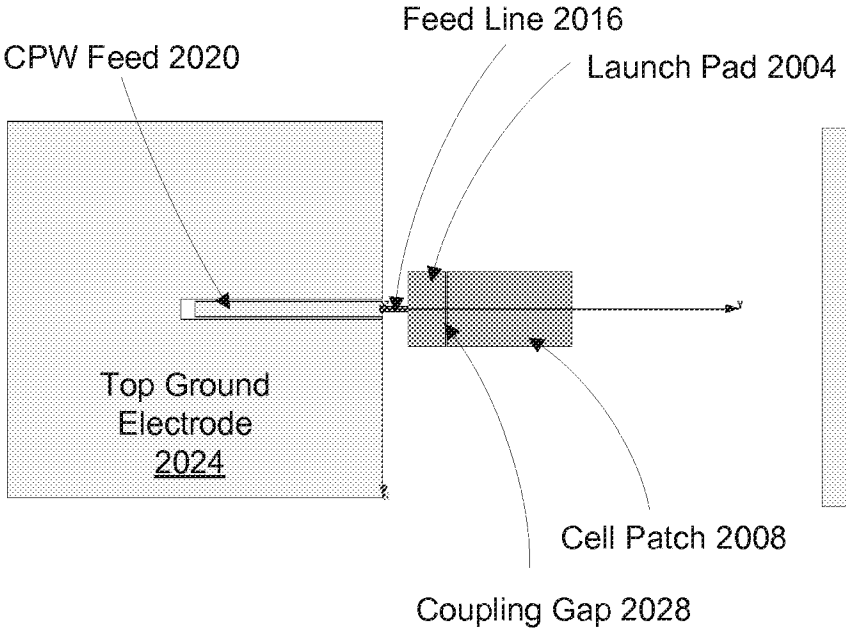

The design parameters for the one-cell TLM-VL antenna shown in FIGS. 20(*a*)-20(*d*) are determined to produce a resonance at 2.4 GHz, which is broad as can be seen from the simulated return loss in FIG. 22(*a*). To verify that the resonance is indeed triggered by an LH mode, a via is added to connect the center of the cell patch 2008 and the center of the bottom truncated ground 2036. This procedure is used to determine the location of the lowest LH mode corresponding to the antenna structure with the added via. The antenna with the via does have an LH resonance near 2.4 GHz, as evidenced in FIG. 22(*b*). In addition, FIG. 22(*a*) shows that, due to the presence of an RH mode near 3.6 GHz, a broadband covering both the WiFi and WiMax bands is achievable using this TLM-VL MTM antenna structure. FIG. 23 shows the radiation pattern of the one-cell TLM-VL antenna in FIGS. 20(*a*)-20(*d*) at 2.4 GHz. The pattern is substantially omnidirectional in the X-Z plane since the antenna shape is symmetric with respect to the Y-axis.

FIGS. 24(*a*)-24(*d*) illustrate an example of a TLM-VL MTM antenna with a via line 2412 connected to a bottom extended ground electrode 2440 while other elements of this structure in the top metallization layer are similar to those in FIGS. 20(*a*)-20(*d*). Referring to FIG. 24(*d*), the bottom metallization layer is patterned to form the bottom ground electrode 2025 with two integral extended ground parts 2440. In the illustrated example, the extended ground electrode part 2440 are symmetric extensions on both sides of the bottom truncated ground 2036 and the via line 2412 connects one extended part 2440 to the bottom truncated ground 2036. Other designs of the bottom ground electrode extensions are also possible.

Figure 25:
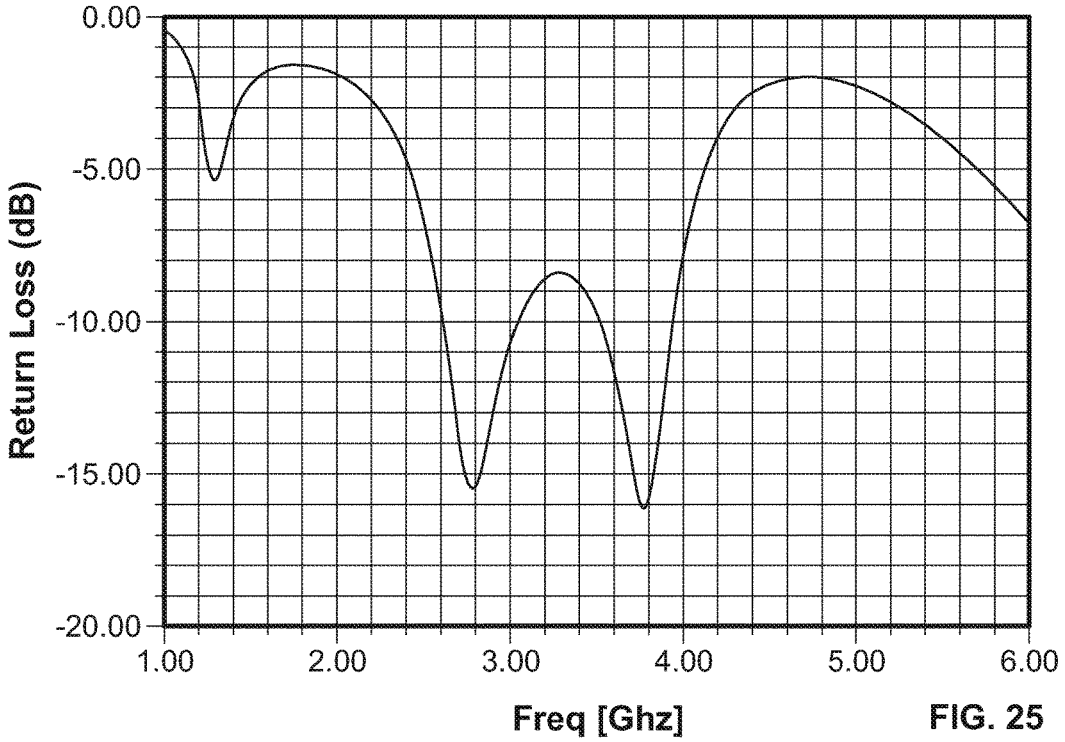
FIG. 25 shows the simulated return loss of the TLM-VL MTM antenna shown in FIGS. 24(*a*)-24(*d*).

FIG. 25 shows the simulated return loss and the broadband resonance similar to the result in FIG. 22(*a*)*for* a device without the extended ground electrode. Different from the TLM-VL MTM antenna in FIGS. 20(*a*)-20(*d*), the lowest LH resonance here is generated around 1.3 GHZ, and two RH resonances are generated near 2.8 GHz and 3.8 GHz. The high RH resonances together produce a broadband covering the WiFi and WiMax bands, and the lowest LH resonance can be used to cover a GPS band, for example.

Figure 27:
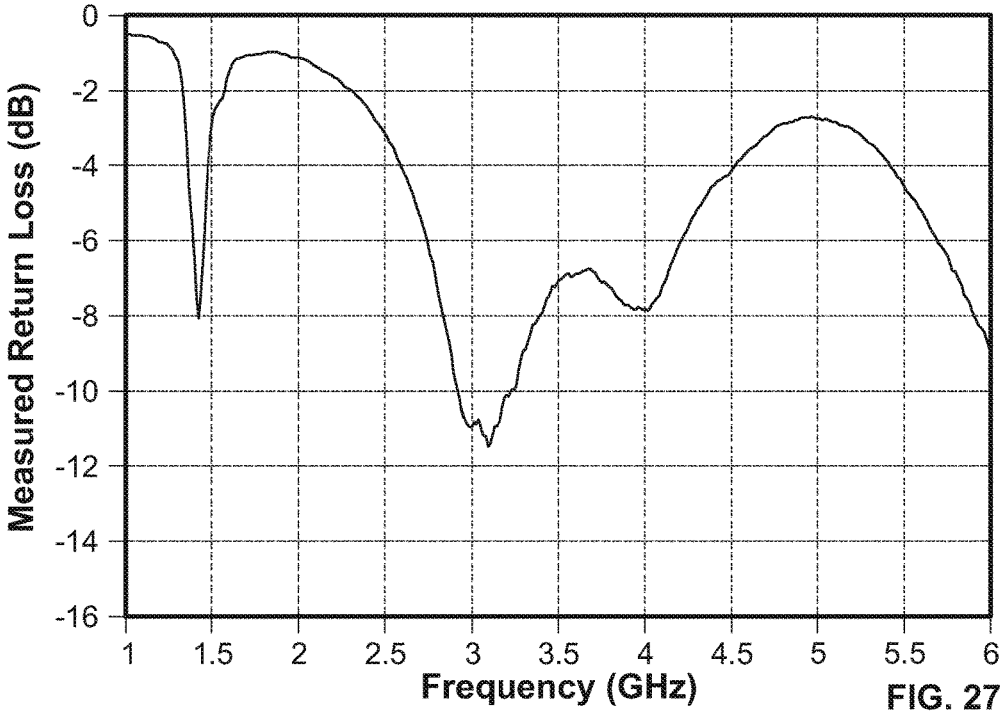
FIG. 27 shows the measured return loss of the TLM-VL MTM antenna shown in FIGS. 26(*a*) and 26(*b*).
Figure 26B:
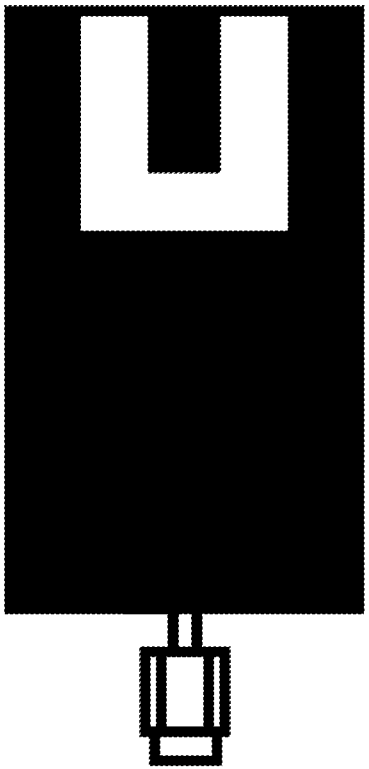
FIGS. 26(*a*) and 26(*b*) show photos of the TLM-VL MTM antenna fabricated as shown in FIGS. 24(*a*)-24(*d*).
Figure 26A:
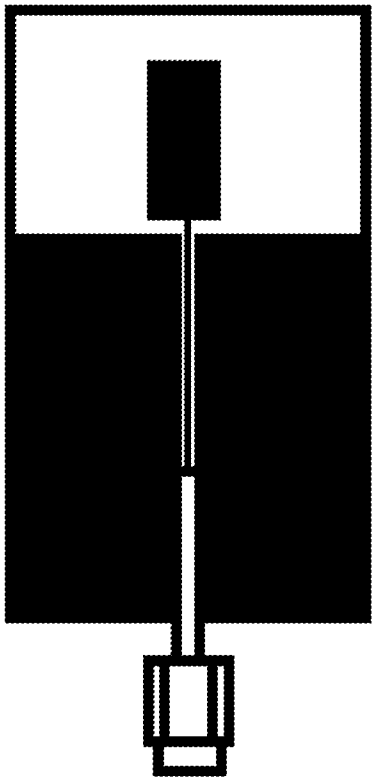
Figure 28A:
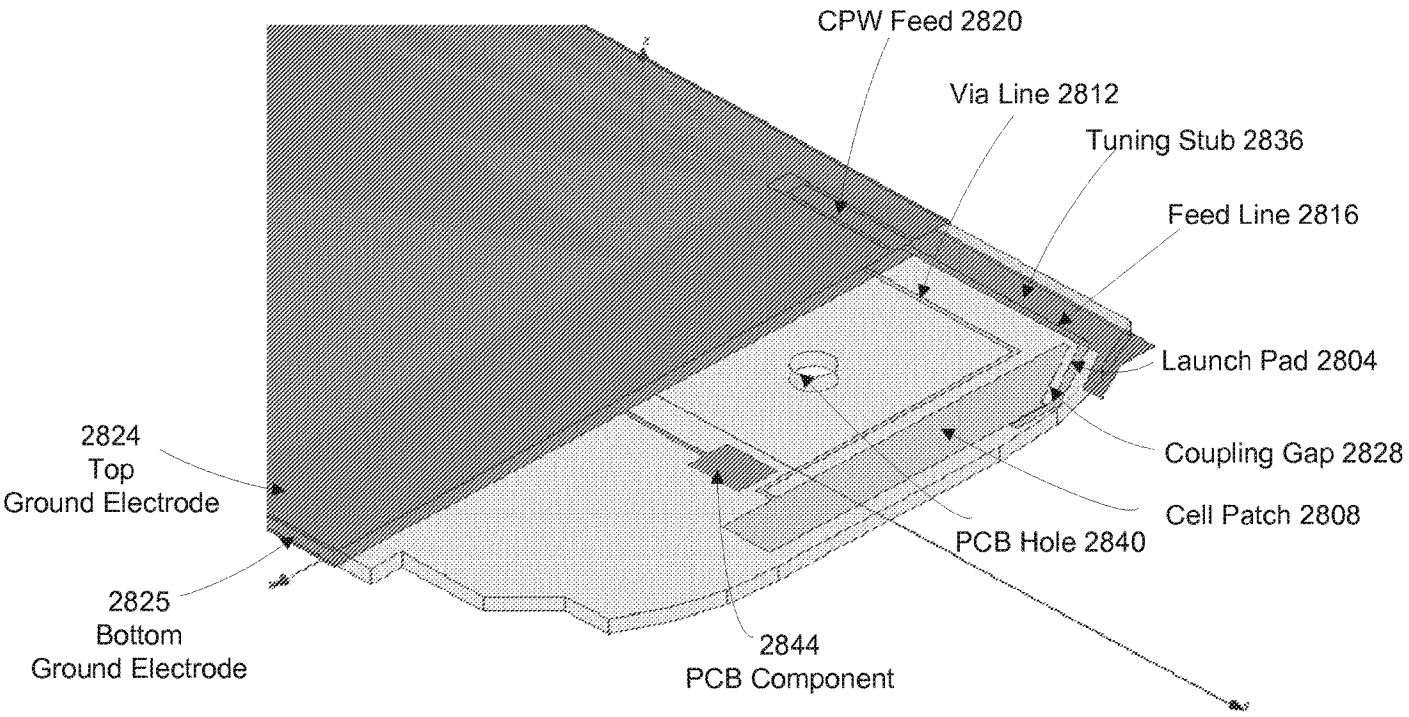
FIGS. 28(*a*)-28(*d*) show another example of a one-cell SLM MTM antenna structure, illustrating the 3D view, side view, top view of the top layer and top view of the bottom layer, respectively.
Figure 28B:
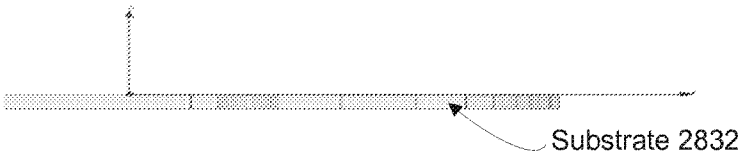
Figure 28D:
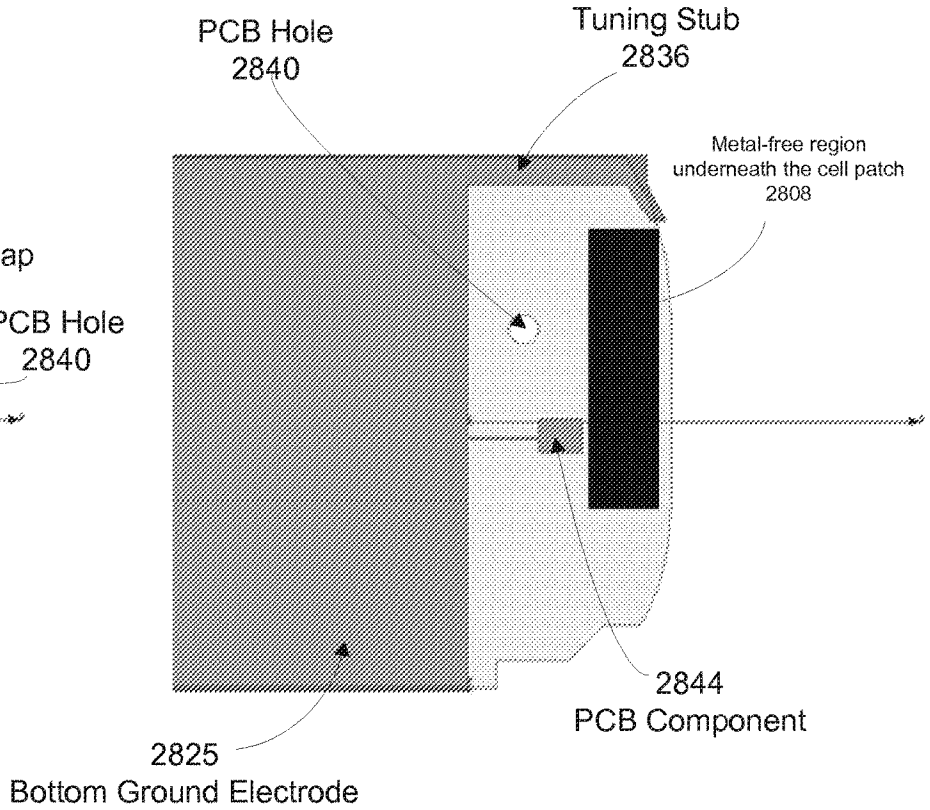
Figure 28C:
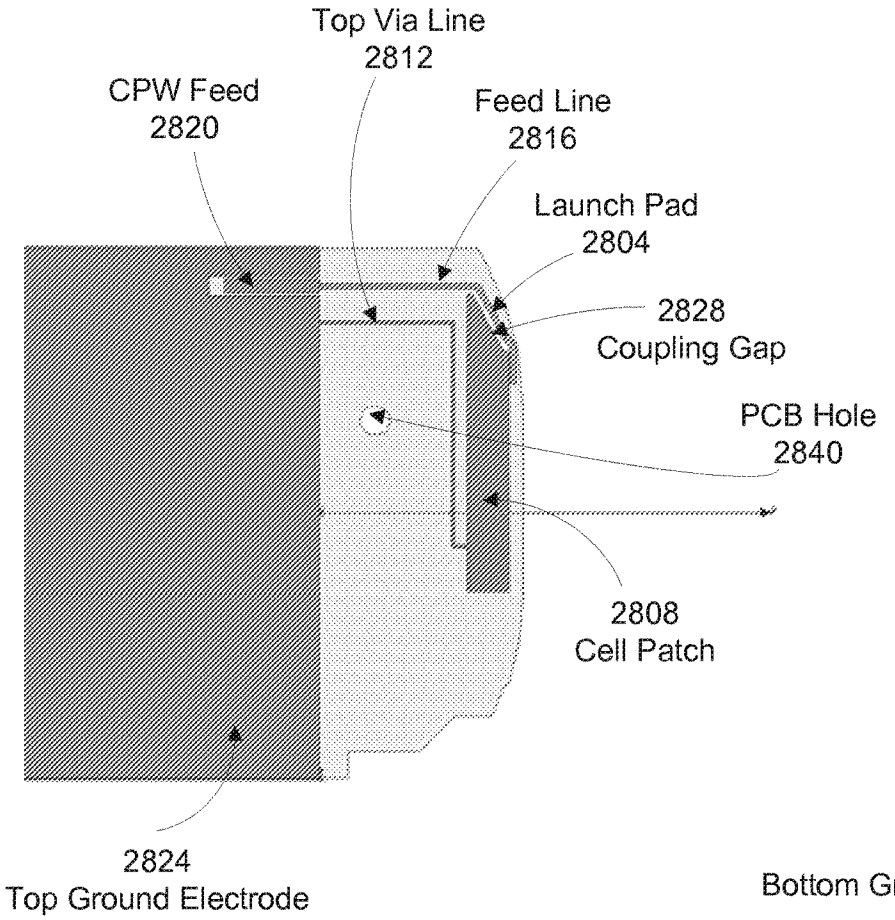

FIGS. 26(*a*) and 26(*b*) show photos of a TLM-VL antenna fabricated based on the design in FIGS. 24(*a*)-24(*d*) with the extended ground electrode 2440. The return loss measured for this antenna is depicted in FIG. 27, showing similar trends as the simulation result in FIG. 25.

FIGS. 28(*a*)-28(*d*) provide another example of a one-cell SLM MTM antenna, showing the 3D view, side view, top view of the top layer and top view of the bottom layer, respectively. This antenna is specifically designed to produce quad-band resonances for quad-band cell phone applications and is formed by using two top and bottom metallization layers formed on two surfaces of the substrate 2832. The antenna is formed in the top metallization layer that is patterned to form various components.

Referring to FIG. 28(*c*), the top metallization layer is patterned to include a top ground electrode 2824, a CPW feed 2820 formed in a gap within the top ground electrode 2824, a feed line 2816 connected to the CPW feed 2820, a launch pad 2804 connected to the feed line 2816, a cell patch 2808 spaced from the launch pad by a coupling gap 2828, and a via line 2812 that connects the cell patch 2808 to the top ground electrode 2824. The antenna is fed by a grounded CPW feed 2820 which can be configured to have a characteristic impedance of 50Ω. The feed line 2816 connects the CPW feed 2820 to the launch pad 2804. The locations of a PCB hole 2840 and a PCB component 2844 are indicated in FIGS. 28(*a*)-28(*d*) for reference.

Referring to FIG. 28(*d*), the bottom metallization layer is patterned to include the bottom ground electrode 2825, a tuning metal stub 2836 extended from the bottom ground electrode 2825 and one or more PCB board components 2844. The pattern of the bottom metallization layer provides a metal free region underneath the cell patch 2808.

In this example the feed line 2816 is 0.5 mm×14 mm. The launch pad 2804 is 0.5 mm×10 mm in total. The cell patch 2808 is capacitively coupled to the launch pad 2804 through a coupling gap 2828 of 0.1 mm (4 mil). The cell patch 2804 is 4 mm×20 mm with a cutout at one corner. The cell patch 2808 is shorted to the ground electrode 2824 through the via line 2812. The via line width is 0.3 mm (12 mil) and its length is 27 mm in total with two bends. The shape of the ground electrode 2824 is optimized and includes the tuning stub 2836 for better matching in both the cellular band (890-960 MHz) and the PCS/DCS band (1700-2170 MHz). The antenna covers an area of 17 mm×24 mm. Generally, the matching at high frequencies can be improved by bringing the top ground electrode 2824 closer to the launch pad 2804. On the other hand, in this example, the ground is added near the launch pad on the bottom layer, as indicated as the tuning stub 2836. Its size is 2.7 mm×17 mm. The substrate is a standard FR4 material with a dielectric constant of 4.4.

Figure 29A:
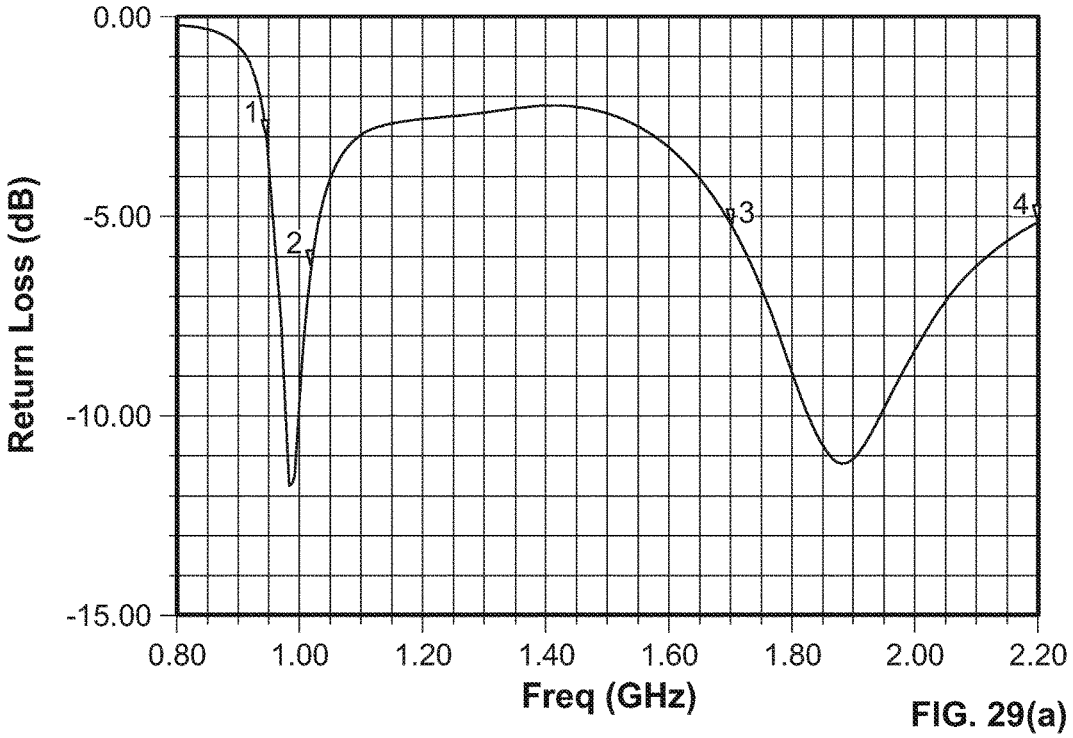
FIG. 29(*a*) shows the simulated return loss of the one-cell SLM MTM antenna shown in FIGS. 28(*a*)-28(*d*).
Figure 29B:
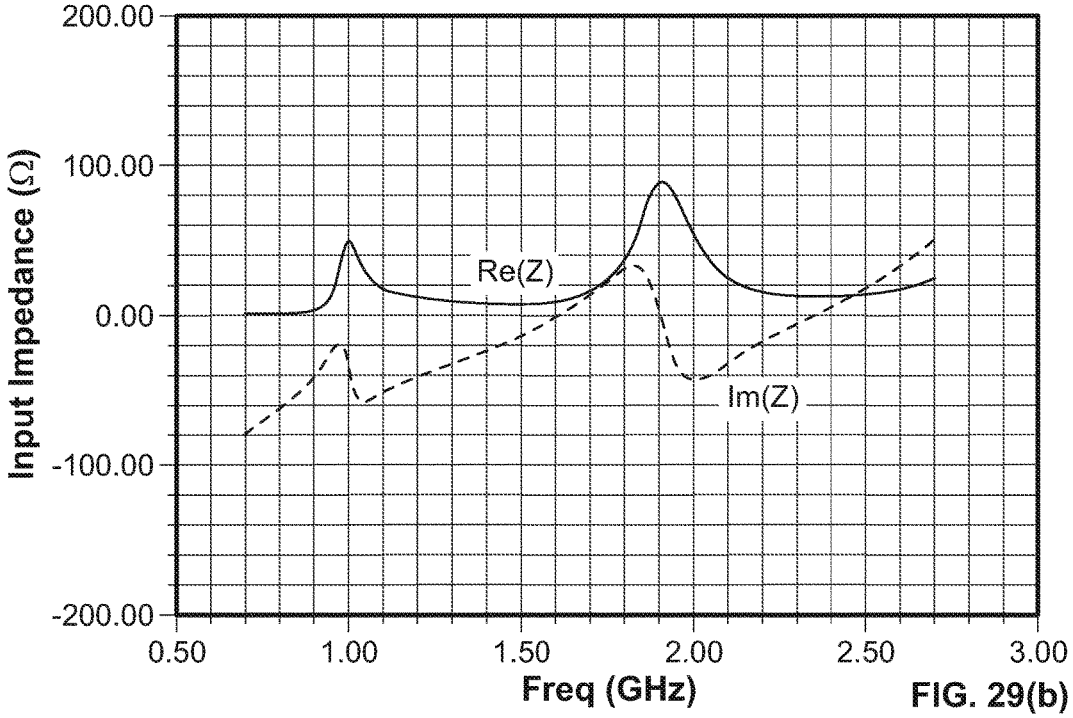

The HFSS EM simulation software is used to simulate the antenna performance. In addition, some samples are fabricated and characterized by measurements. The simulated return loss is shown in FIG. 29(*a*), which indicates good matching in both cellular and PCS/DCS bands. Four representative points in this figure are: point 1=(0.94 GHz, −2.94 dB), point 2=(1.02 GHz, −6.21 dB), point 3=(1.75 GHz, −7.02 dB) and point 4=(2.20 GHz, −5.15 dB). The simulated input impedance is plotted in FIG. 29(*b*).

Figure 30B:
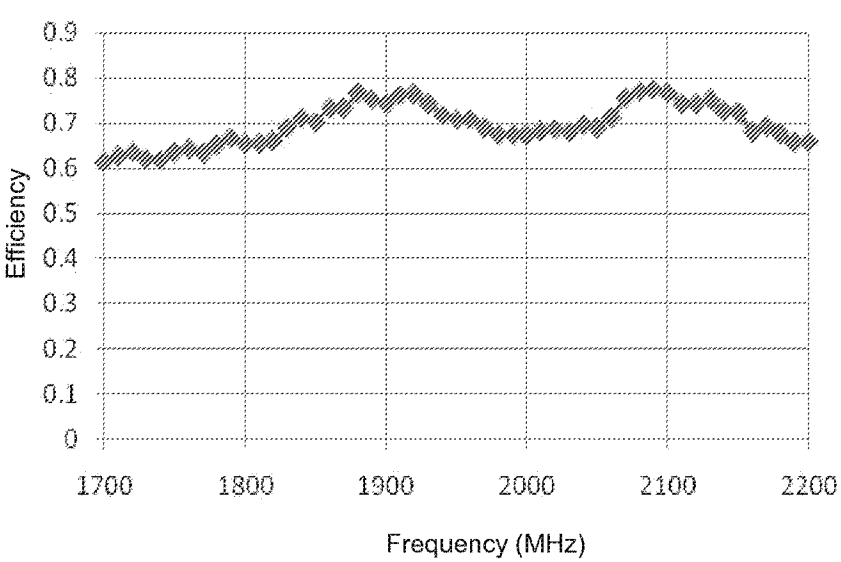
FIGS. 30(*a*) and 30(*b*) show the measured efficiency of the one-cell SLM MTM antenna fabricated as shown in FIGS. 28(*a*)-28(*d*), plotting the cellular band efficiency and the PCS/DCS efficiency, respectively.
Figure 30A:
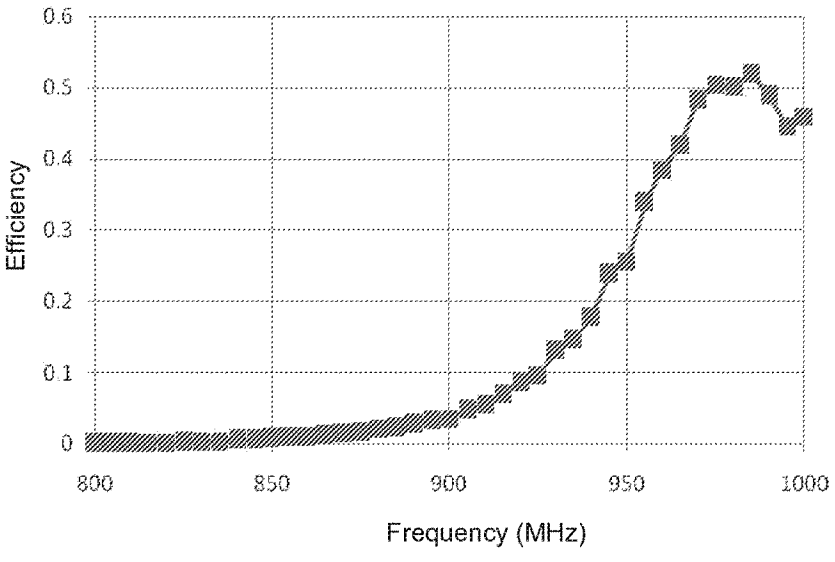

The efficiency measured for the fabricated antenna is plotted in FIGS. 30(*a*) and 30(*b*), which correspond to the cellular band efficiency and the PCS/DCS band efficiency, respectively. The antenna is highly efficient peaking at 52% in the cellular band and 78% in the PCS/DCS band.

Cell phones and handheld devices tend to be compact and thus may have complex electromagnetic properties, making the antenna integration difficult. Some antenna modifications can be made in the present implementation to enable stable operation of the antenna inside the device.

Figure 31:
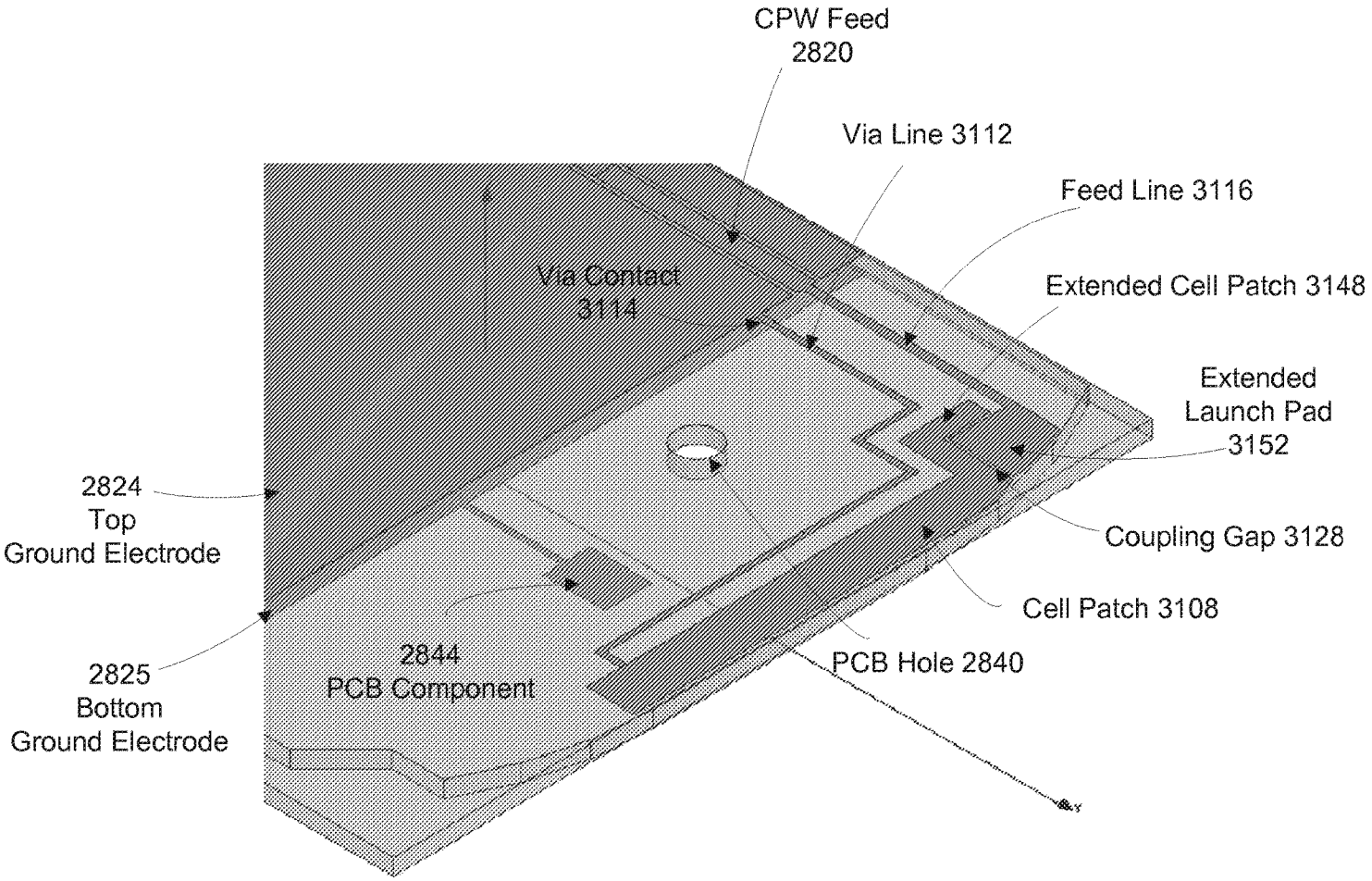
FIG. 31 shows another example of a one-cell SLM MTM antenna structure with modifications.

FIG. 31 shows an exemplary modified SLM MTM antenna structure based on the SLM MTM antenna in FIGS. 28(*a*)-28(*d*). The top metallization layer is patterned to include the top ground electrode 2824, the CPW feed 2820, the feed line 3116, the extended launch pad 3152, the cell patch 3108 and the extended cell patch 3148, and the via line 3112 connecting the cell patch 3108 to the top ground electrode 2824. The first modification is to increase the size of the launch pad to provide the extended launch pad 3152 to improve the capacitive component of the antenna impedance. This makes the loop larger in the Smith Chart, deliberately mismatching the antenna in free space. When the antenna is integrated in the device, the loop shrinks due to the loading of components around it. Thus, this scheme makes the antenna better matched when integrated. The second modification is to add an L shaped extended cell patch 3148 to the cell patch 3108. This increases the capacitive coupling between the cell patch 3108 and the extended cell patch 3152 due to the increased length of the coupling gap 3128, thereby decreasing the resonant frequency of the low band.

Another tuning parameter in the device in FIG. 31 is the point of contact 3114 between the via line 3112 and the top ground electrode 3124 on the top metallization layer. This contact point 3114 can be moved closer to the feed line 3116 to improve matching in the low band while increasing mismatching in the high band. The opposite effect is seen when the contact point 3114 is moved away from the feed line 3116. The locations of a PCB hole 3140 and a PCB component 3144 in the bottom metallization layer are indicated in FIG. 31 for reference.

Figure 32A:
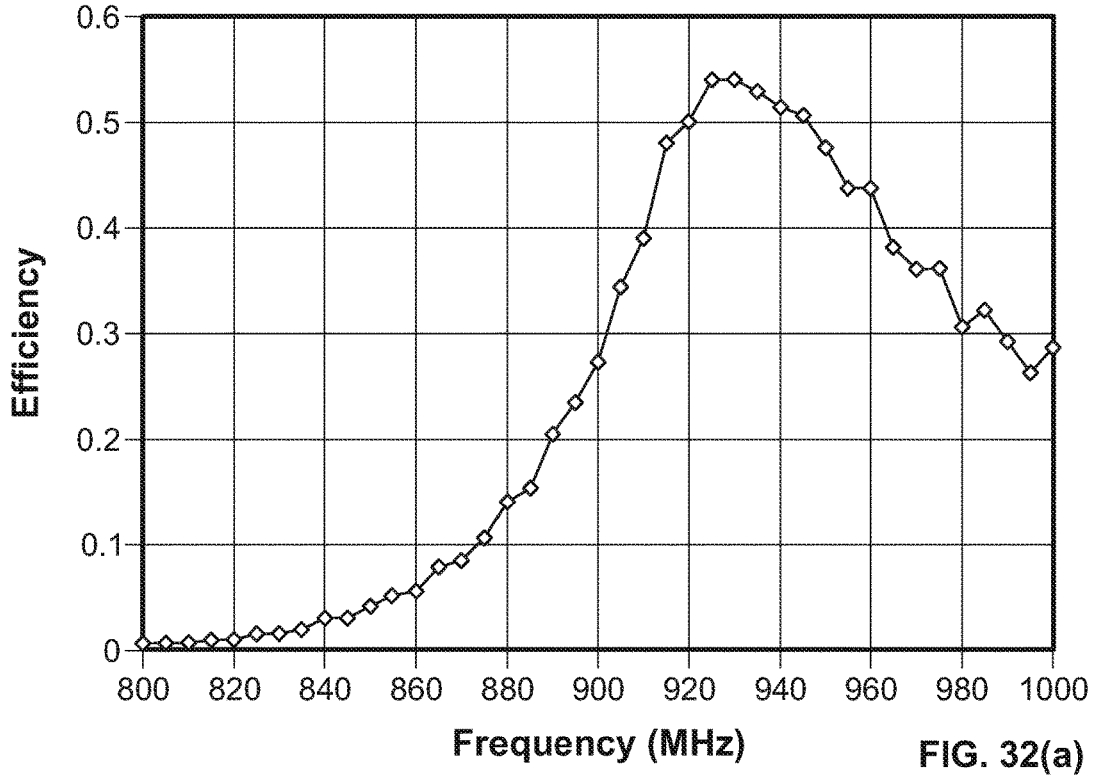
FIGS. 32(*a*) and 32(*b*) show the measured efficiency of the one-cell SLM MTM antenna fabricated as shown in FIG. 31, plotting the cellular band efficiency and the PCS/DCS efficiency, respectively.
Figure 32B:
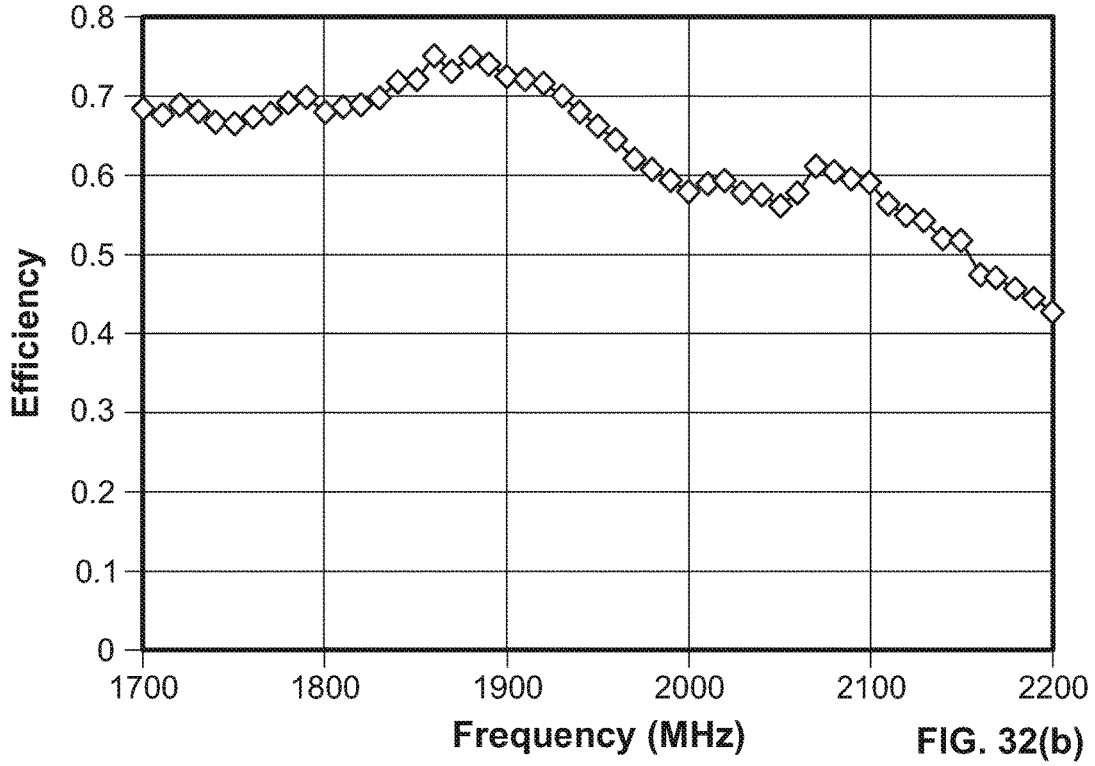
Figure 33A:
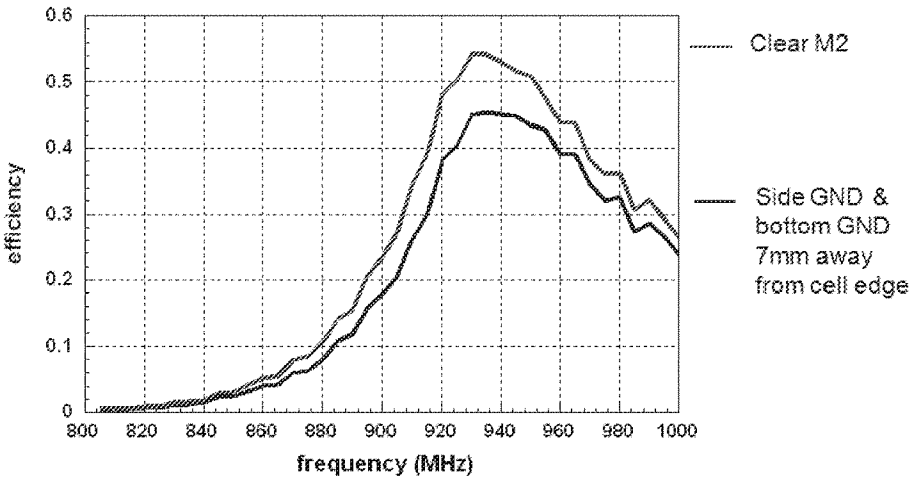
FIGS. 33(*a*) and 33(*b*) show the effect of an extended ground electrode on the efficiency, plotting the cellular band efficiency and the PCS/DCS efficiency, respectively, by comparing the cases with and without the extended ground electrode.
Figure 33B:
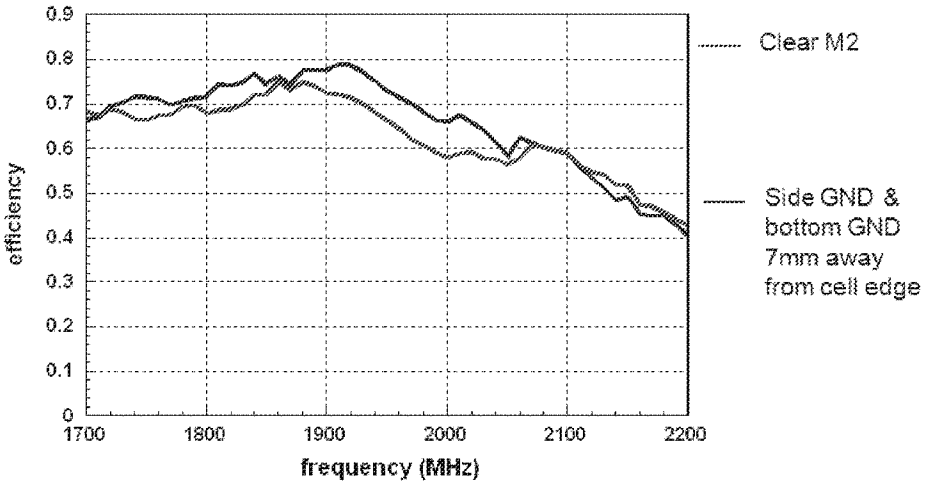
Figure 34A:
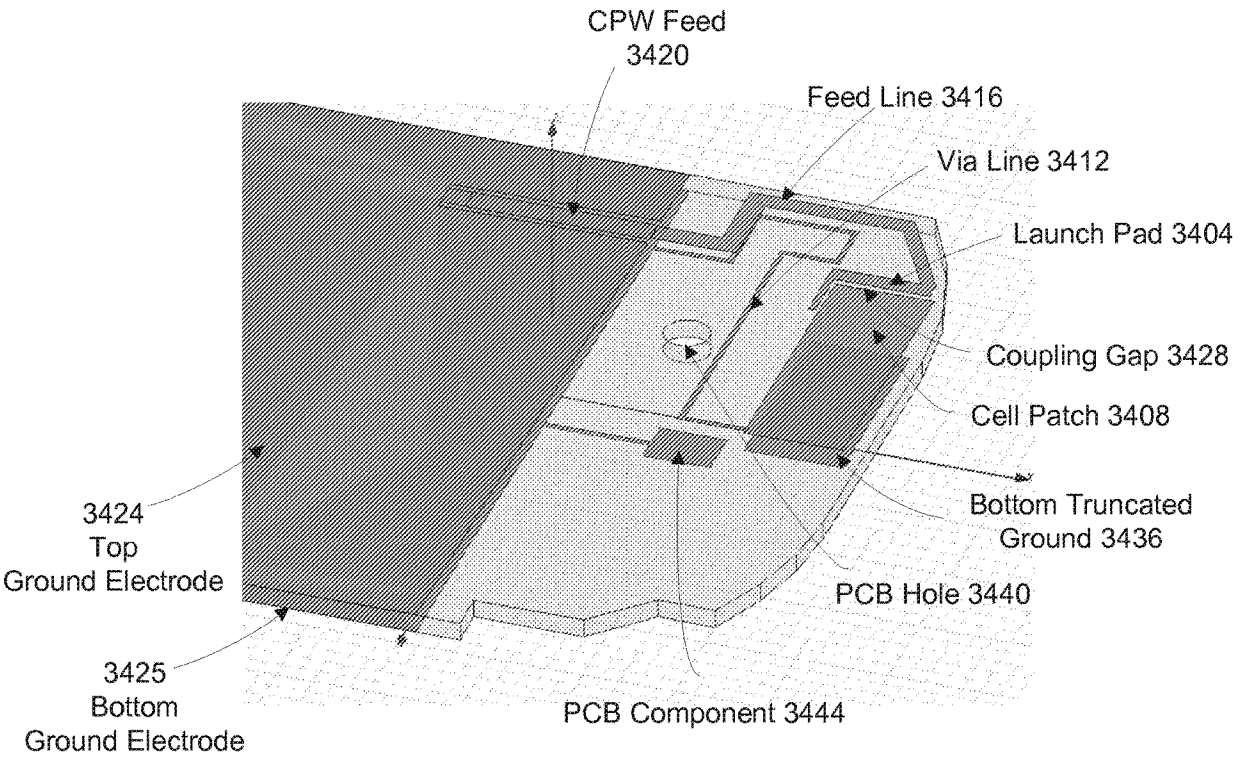
FIGS. 34(*a*)-34(*d*) show another example of a TLM-VL antenna structure, illustrating the 3D view, side view, top view of the top layer and top view of the bottom layer, respectively.
Figure 34B:
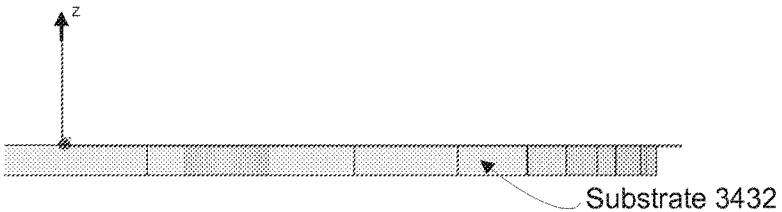
Figure 34D:
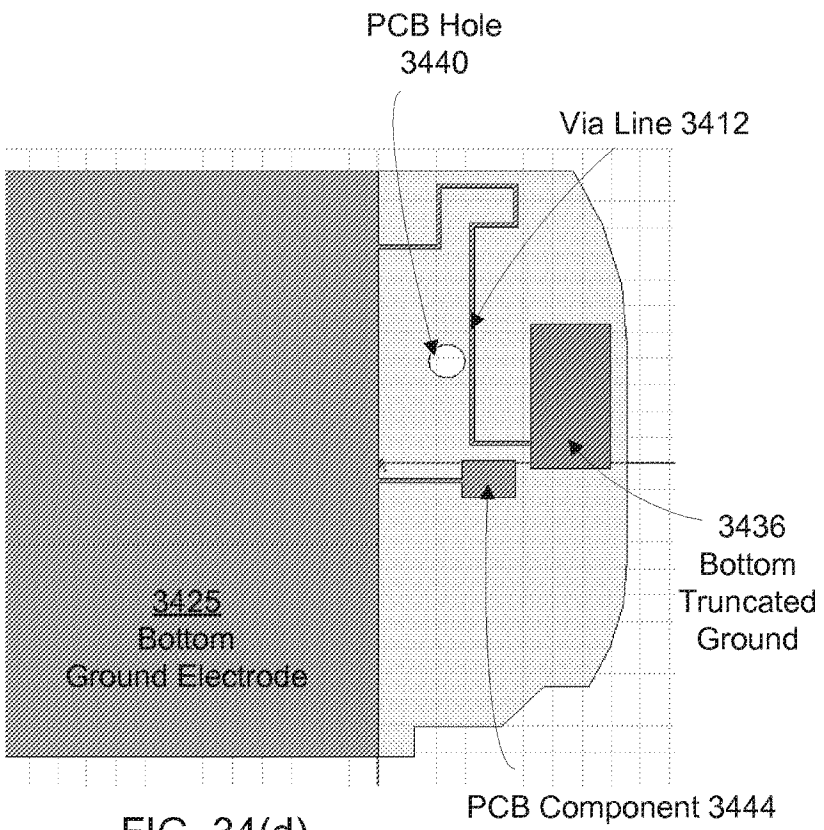
Figure 34C:
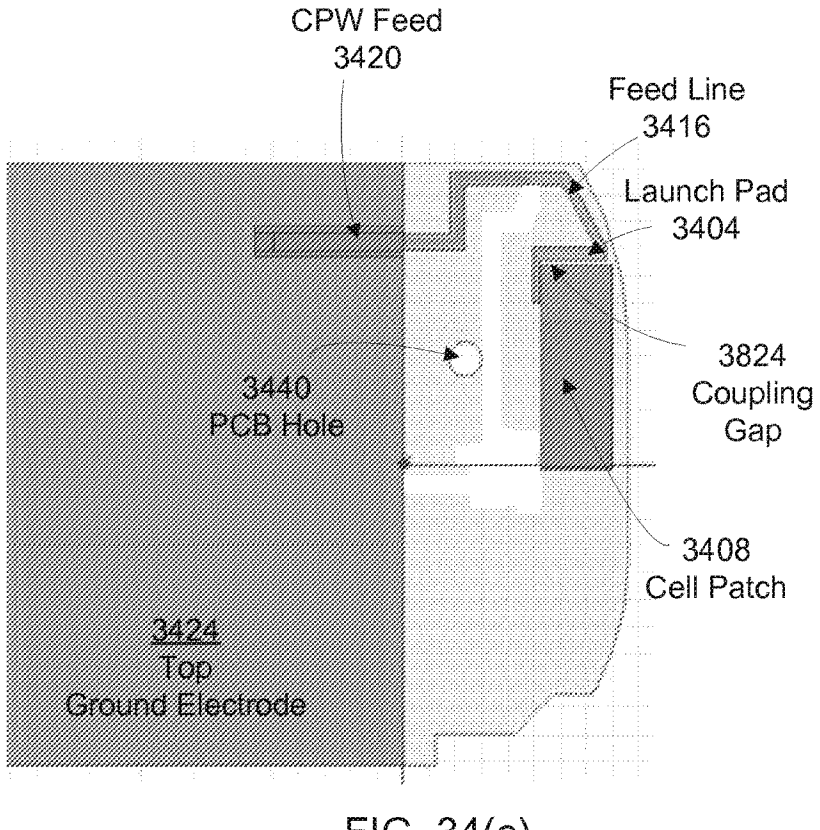

The antenna with the above modifications was fabricated. The measured efficiency of the antenna is shown in FIGS. 32(*a*) and 32(*b*). The antenna is highly efficient peaking at 51% in the cellular band and 74% in the PCS/DCS band. To analyze the effect of reducing the clearance around the antenna, the ground electrode in FIG. 31 is extended to below the antenna cell and on the side. FIGS. 33(*a*) and 33(*b*) summarize the effect on efficiencies, for the cellular band and the PCS/DCS band, respectively. It can be seen from these figures that the antenna performance is affected by the ground extension.

FIGS. 34(*a*)-34(*d*) shows an example of a quad-band TLM-VL MTM antenna for cell phone applications, showing the 3D view, side view, top view of the top layer and top view of the bottom layer, respectively. This TLM-VL MTM antenna includes a launch pad 3404 and a cell patch 3408 on the top layer without having a via line connecting the cell patch 3408 to the top ground electrode 3424. On the bottom metallization layer, this TLM-VL MTM antenna includes a bottom truncated ground 3436 and a via line 3412 that connects the bottom truncated ground 3436 to the bottom ground electrode 3425. The antenna is fed by a grounded CPW feed 3420 formed in the top ground electrode 3424 and a feed line 3416 connecting the CPW feed 3420 to the launch pad 3404. The feed may be configured to have a characteristic impedance of 50Ω. The locations of a PCB hole 3440 and a PCB component 3444 are also indicated in the figures for reference.

In one implementation of this design, the feed line 3416 is comprised of two sections for matching purposes. The first section is 1.2 mm×17.3 mm and the second section is 0.7 mm×5.23 mm. The L-shaped launch pad 3404 is used to provide sufficient coupling to the cell patch 3408 and better impedance matching. One arm of the L-shaped launch pad 3404 is 1 mm×5.6 mm and the other arm is 0.4 mm×3.1 mm. The cell patch 3408 is capacitively coupled to the launch pad 3404 with gaps of 0.4 mm in the longer arm and 0.2 mm in the shorter arm. The cell patch 3408 is 5.4 mm×15 mm, and the bottom truncated ground 3436 is 5.4 mm×10.9 mm. The shunt capacitor CR is induced because of the presence of the bottom truncated ground 3436 underneath the cell patch 3408. The via line 3412 that connects the bottom truncated ground 3436 with the bottom ground electrode 3425 induces an inductance (Lp) that is in series with CR as shown in FIG. 21(*b*). The shunt inductor LL is negligible because of no vias involved in the structure. In FIG. 21(*b*), the notation LL represents LL+Lp as in the Analysis 2. The via line dimension is 0.3 mm×40.9 mm. The via line route is optimized to match both the cellular band (824-960 MHz) and PCS/DCS band (1700-2170 MHz). The antenna covers the area of 15.9 mm×22 mm. The substrate is an FR4 material with a dielectric constant of 4.4.

Table 3 provides a summary of the elements of the TLM-VL antenna structure in this example.

TABLE 3

| Parameter | Description | | Location |
|---|---|---|---|
| Antenna Element | Each antenna element comprises a cell connected to the 50 Ω CPW Feed 3420 via a Launch Pad 3404 and a Feed Line 3416. Both Launch Pad 3404 and Feed Line 3416 are located on the top layer of Substrate 3432. | | |
| Feed Line | Connects the Launch Pad 3404 with the 50 Ω CPW Feed 3420. | | Top Layer |
| Launch Pad | L-shape that couples a Cell Patch 3408 to the Feed Line 3416. There is a Coupling Gap 3428 between the Launch Pad 3404 and the Cell Patch 3408. | | Top Layer |
| Cell | Top Cell Patch | Rectangular shape | Top Layer |
| | Bottom Truncated ground | Rectangular shape | Bottom Layer |
| | Via Line | Connects the Bottom truncated ground 3436 with the bottom ground electrode 3425. | Bottom Layer |

Figure 35A:
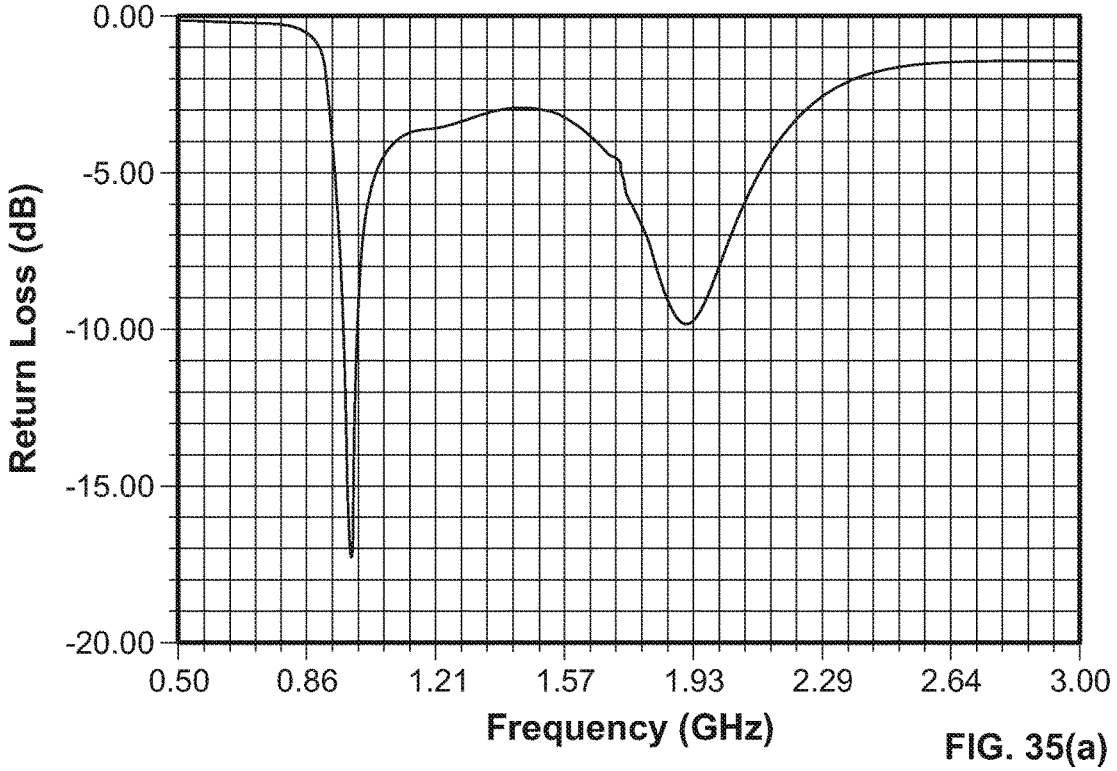
FIG. 35(*a*) shows the simulated return loss of the TLM-VL antenna shown in FIGS. 34(*a*)-34(*d*).
Figure 35B:
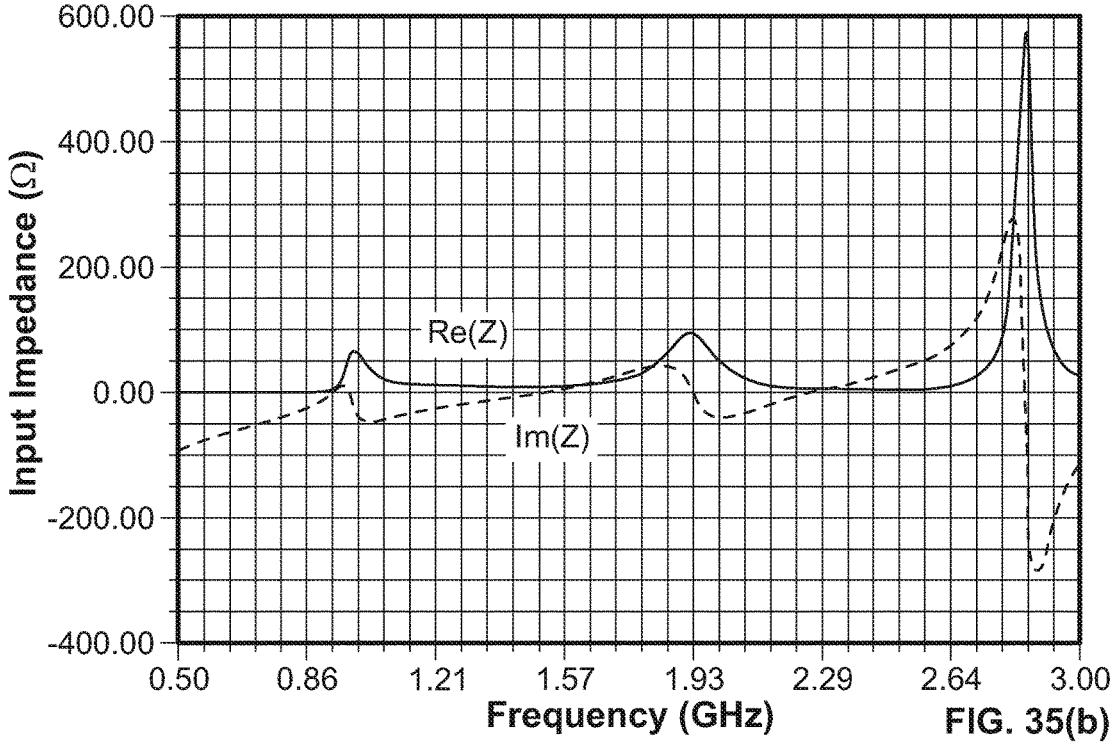
Figure 36A:
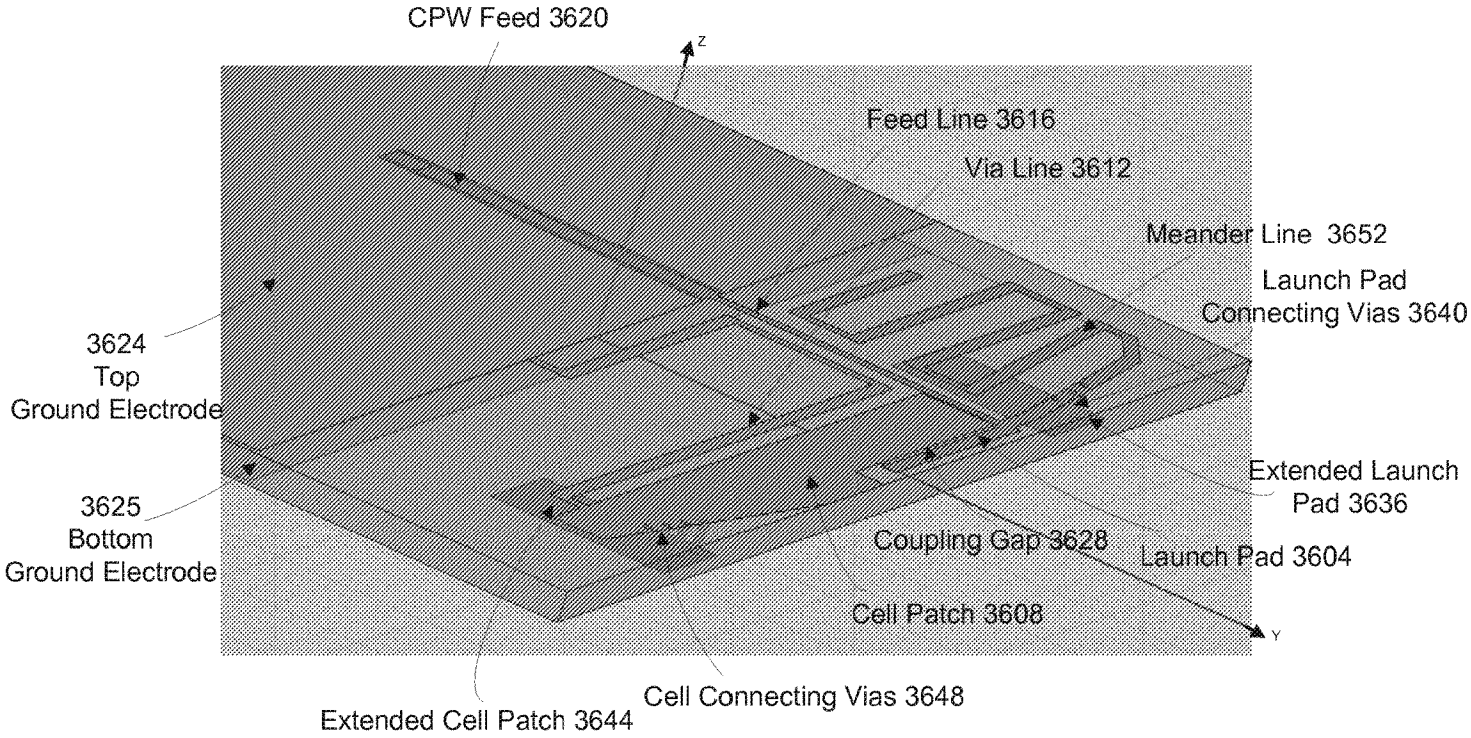
FIGS. 36(*a*)-36(*d*) show an example of a semi single-layer MTM antenna structure, illustrating the 3D view, side view, top view of the top layer with the bottom layer overlaid, and the top view of the bottom layer with the top layer overlaid, respectively.
Figure 36B:
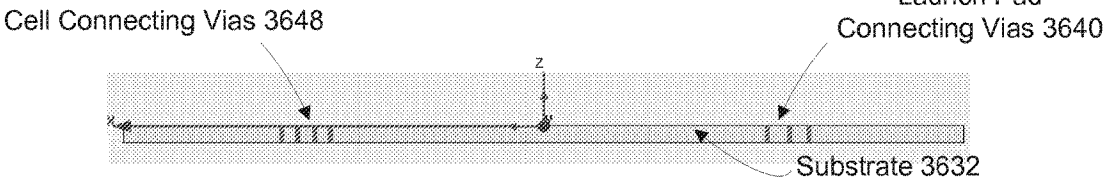
Figure 36D:
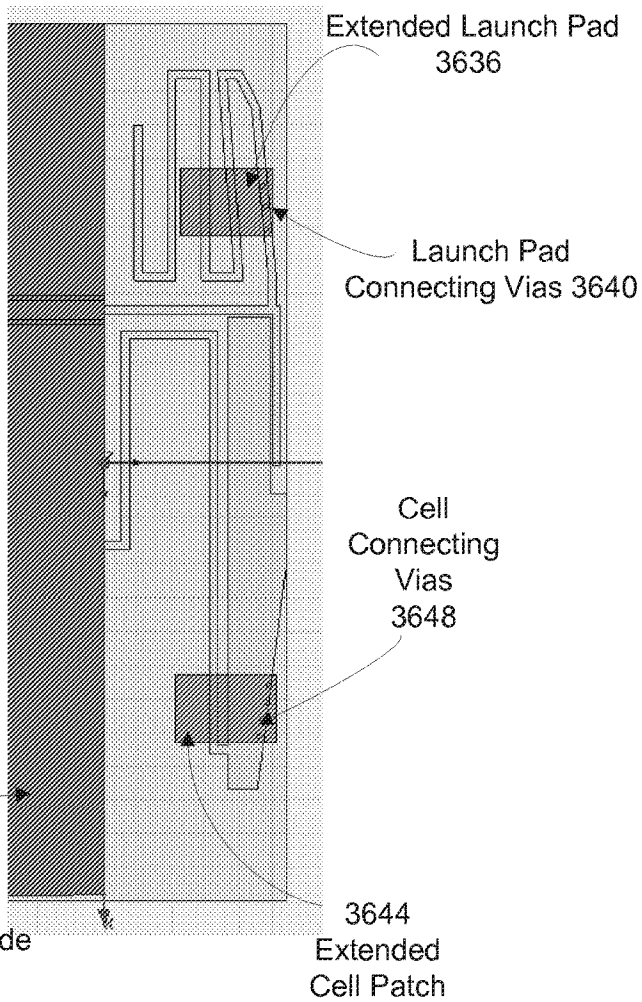
Figure 36C:
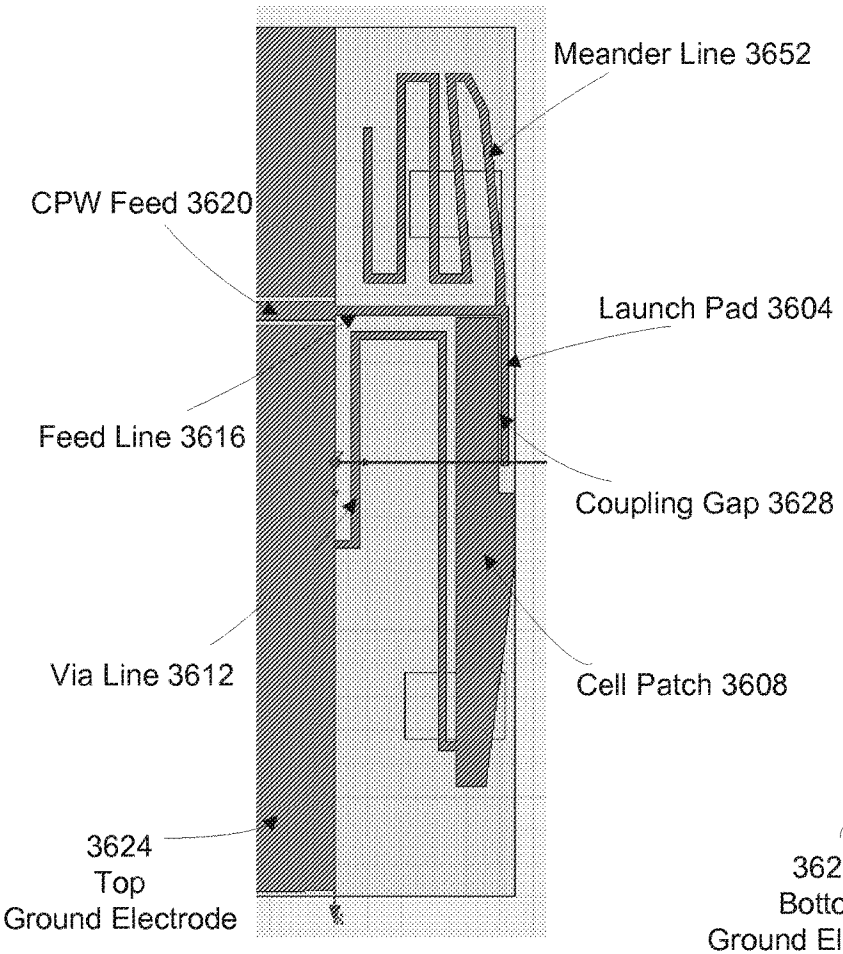

The HFSS EM simulation software is used to simulate the antenna performance. The simulated return loss is shown in FIG. 35(*a*) and shows good matching in both cellular and PCS/DCS bands. The simulated input impedance is shown in FIG. 35(*b*).

In the above MTM structure examples, each unit cell has a single cell patch that is located at one location. In some implementations, a cell patch may include at least two metal patches located at different locations that are interconnected to effectuate an "extended" cell patch.

FIGS. 36(*a*)-36(*d*) show an example of a penta-band MTM antenna with a semi single-layer structure, showing the 3D view, side view, top view of the top layer and top view of the bottom layer, respectively. In this design, a cell includes two metal patches that are respectively formed in the top and bottom metallization layers and are connected by conductive vias. Of the two metal patches, the cell patch 3608 in the top layer is larger in size than the extended cell patch 3644 in the bottom layer and thus is the main cell patch. The extended cell patch 3644 in the bottom layer is not connected to a ground electrode. A via line 3612 is formed in the top layer, the same layer of the cell patch 3608, to connect the cell patch 3608 to the top ground electrode 3624. As such, the top ground electrode 3624 is the ground electrode for the cell patch 3608. Therefore, this device does not have a bottom truncated ground for the cell in the bottom layer. For this reason, this design is a "semi single-layer structure."

More specifically, this MTM antenna has a launch pad 3604 with an added meander line 3652 and a cell patch 3608, all of which are on the top layer. The cell patch 3608 is extended to an a cell patch extension 3644 in the bottom layer by using one or more vias 3648 to connect the cell patch 3608 on the top and the cell patch extension 3644 on the bottom. The launch pad 3604 may also be extended to an a launch pad extension 3636 in the bottom layer by using one or more vias 3640 to connect the launch pad 3604 on the top and the launch pad extension 3636 on the bottom. The launch pad extension 3636 on the bottom layer can also be referred to as an extended launch pad 3636, and the cell patch extension 3644 on the bottom layer can also be referred to as an extended cell patch 3644. The respective vias are referred to as launch pad connecting vias 3640 and cell connecting vias 3648 in the figures. Such extensions can be made to comply with the space requirements while maintaining a certain performance level.

FIG. 36(*c*) shows the bottom layer that is overlaid with the top layer. FIG. 36(*d*) show the top layer that is overlaid with the bottom layer.

The antenna is fed by a grounded CPW feed 3620 with a characteristic impedance of 50Ω. The feed line 3616 connects the CPW feed 3620 to the launch pad 3604, which has the added meander line 3652. The cell patch 3608 has a polygonal shape, and capacitively coupled to the launch pad 3604 through a coupling gap 3628. The cell patch 3608 is shorted to the top ground electrode 3624 on the top layer through the via line 3612. The via line route is optimized for matching. The substrate 3632 can be made of a suitable dielectric material, e.g., an FR4 material with a dielectric constant of 4.4.

Table 4 provides a summary of the elements of the semi single-layer penta-band MTM antenna structure in this example.

TABLE 4

| Parameter | Description | | Location |
|---|---|---|---|
| Antenna Element | Each antenna element comprises a cell connected to the 50 Ω CPW Feed 3620 via a Launch Pad 3604 and a Feed Line 3616. Both Launch Pad 3604 and Feed Line 3616 are located on the top layer of Substrate 3632. | | |
| Feed Line | Connects the Launch Pad 3604 with the 50 Ω CPW Feed 3620. | | Top Layer |
| Launch Pad | Rectangular shaped and is coupled to a Cell Patch 3608 through a Coupling Gap 3628. A Meander Line 3652 is attached to the Launch Pad 3604. | | Top Layer |
| Meander Line | Added to the Launch Pad 3604. | | |
| Extended Launch Pad | A rectangular shaped patch that is an extension of the Launch Pad 3604. | | Bottom Layer |
| Launch Pad Connecting Vias | Vias connecting the Launch Pad 3604 on the top layer with the Extended Launch Pad 3636 on the bottom layer. | | |
| Cell | Cell Patch | Polygonal shape | Top Layer |
| | Extended Cell Patch | A rectangular shaped patch that is an extension of the Cell Patch 3608. | Bottom Layer |
| | Via Line | Line that connects the Cell Patch with the top ground electrode 3624. | Top Layer |
| | Cell Connecting Vias | Vias connecting the Cell Patch 3608 on the top layer with the Extended Cell Patch 3644 on the bottom layer. | |

Figure 37A:
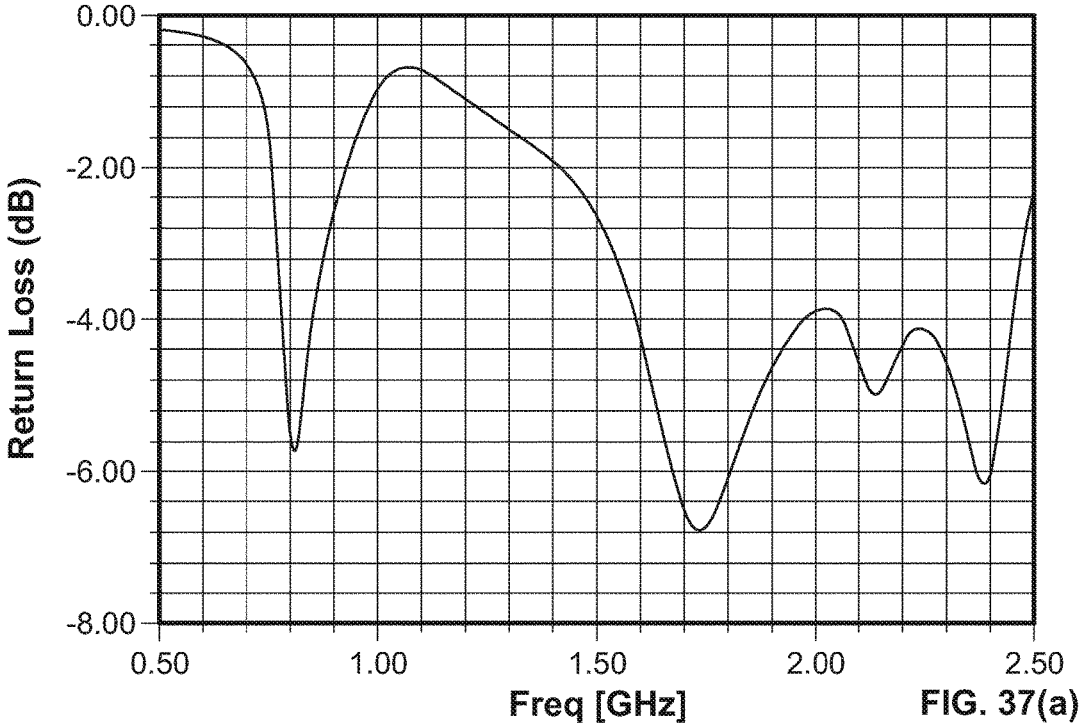
FIG. 37(*a*) shows the simulated return loss of the semi single-layer antenna shown in FIGS. 36(*a*)-36(*d*).
Figure 37B:
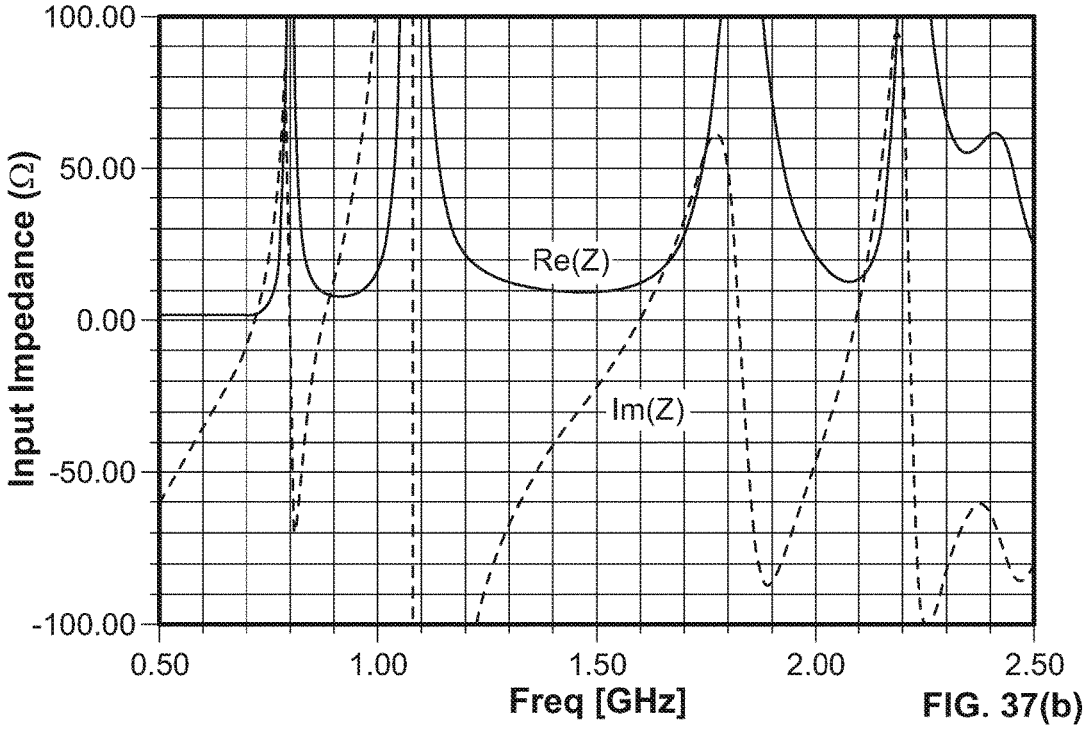

The HFSS EM simulation software is used to simulate the antenna performance. The simulated return loss is shown in FIG. 37(*a*), and the simulated input impedance is shown in FIG. 37(*b*). As evidenced by these figures, the LH resonance appears at about 800 MHZ in this example.

Figure 38:
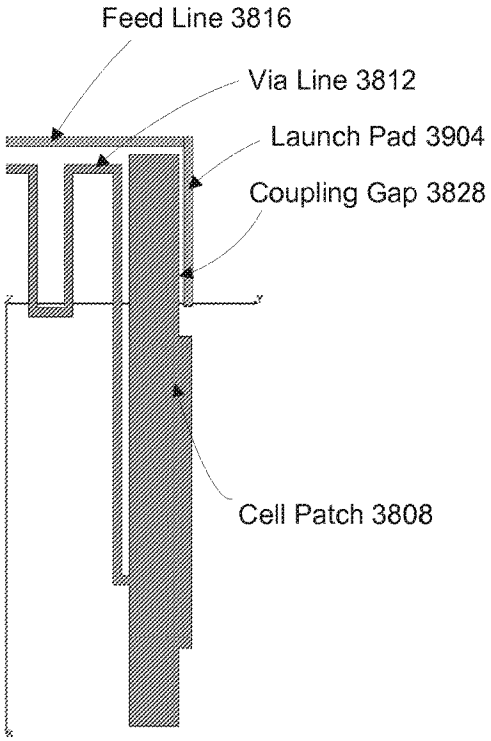
FIG. 38 shows another example of a SLM MTM antenna structure, illustrating the top view of the top layer.

Penta-band MTM antennas can be constructed based on a single layer. One example of a SLM penta-band MTM antenna is shown in FIG. 38, which shows the top view of the top layer. The CPW feed and CPW ground are omitted in this figure.

Examples for various parameters in one exemplary implementation are provided below. The launch pad 3804 is rectangular shaped with dimensions of 10.5 mm×0.5 mm. The feed line 3816 delivers power from the CPW feed to the launch pad 3804, and is 10 mm×0.5 mm. The launch pad 3804 couples capacitively to the cell patch 3808, which is 32 mm×3.5 mm. The coupling gap 3828 is 0.25 mm in width. There are two cutouts at the corners of the cell patch 3808. The first cutout is near the launch pad with dimensions of 10.5 mm×0.75 mm. The second cutout is at the top corner of the cell patch 3808 with dimensions of 4.35 mm×0.75 mm. The second cutout is not critical to the performance but is shaped to meet the board outline of a product for the present application. The via line 3812 connects the cell patch 3808 to the CPW ground. The width of the via line 3812 is 0.5 mm. The total length of the via line is 45.9 mm. The via line has seven segments of lengths 0.4 mm, 23 mm, 3.25 mm, 8 mm, 1.5 mm, 8 mm and 1.75 mm, respectively, starting from the cell patch 3808 to the CPW ground.

The routing of the via line 3812 is shown in FIG. 38. In one implementation, the via line 3812 terminates on the CPW ground at 1 mm away from the feed line 3816.

Figure 39:
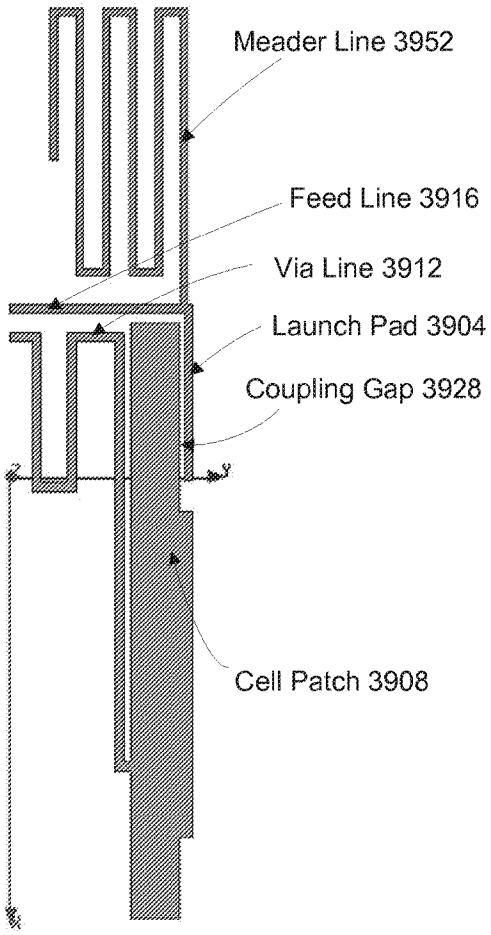
FIG. 39 shows another example of a SLM MTM antenna structure (with meander), illustrating the top view of the top layer.

FIG. 39 shows another example of a SLM penta-band antenna. Only the top view of the top layer is presented and the CPW feed and CPW ground are omitted in this figure. A meander line 3952 is attached to the launch pad 3904. The total length of the meander is 84.8 mm in this example. The remaining structure can be identical to the one shown in FIG. 38.

Figure 40:
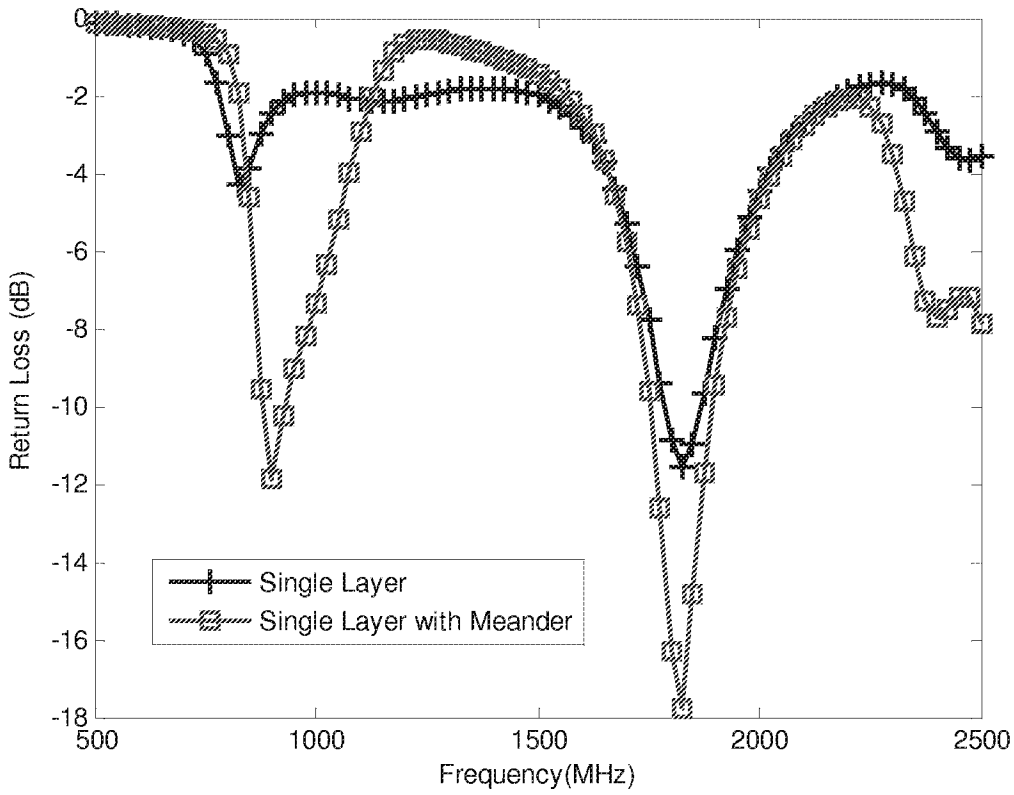
FIG. 40 shows the simulated return losses of the SLM MTM antenna shown in FIG. 38 and of the SLM MTM antenna (with meander) shown in FIG. 39.

The SLM penta-band antenna shown in FIG. 38 (without the meander line) creates two distinct bands, as evidenced by the simulated return loss indicated by the line with cross points in FIG. 40. The low band has a sufficient bandwidth to meet quad-band cell phone applications but is too narrow to meet the requirement for penta-band cell phone applications. The SLM penta-band antenna with the meander line 3952, shown in FIG. 39, can be used to increase the bandwidth. The length of the meander line 3952 is adjusted to create a resonance at a frequency higher than, but close to the LH resonance. The resulting bandwidth of the two modes is sufficient to cover the low band ranging from 824 MHz to 960 MHz, as can be seen from the simulated return loss indicated by the line with open squares in FIG. 40. While in this particular example the meander line 3952 is used to create the additional mode in the low band, it can be used to increase the high band as well if needed, but with a shorter meander line length. Furthermore, it possible to use a spiral, multi-layer meander line or a combination of these to introduce an additional mode.

Table 5 provides a summary of the elements of the SLM penta-band MTM antenna structure with a meander line.

TABLE 5

| Parameter | Description | | Location |
|---|---|---|---|
| Antenna Element | Each antenna element comprises a cell connected to the 50 Ω CPW Feed via a Launch Pad 3904 and Feed Line 3916. Both Launch Pad 3904 and Feed Line 3916 are located on the top of substrate. | | |
| Feed Line | Connects the Launch Pad 3904 with the 50 Ω CPW Feed. | | Top Layer |
| Launch Pad | Rectangular shaped and is coupled to a Cell Patch 3908 through a Coupling Gap 3928. A Meander Line 3952 is attached to the Launch Pad 3904. | | Top Layer |
| Meander Line | Added to the Launch Pad 3904. | | Top layer |
| Cell | Cell Patch | Polygonal shape | Top Layer |
| | Via Line | Connects the Cell Patch 3908 with the top ground electrode. | Top Layer |

Figure 42:
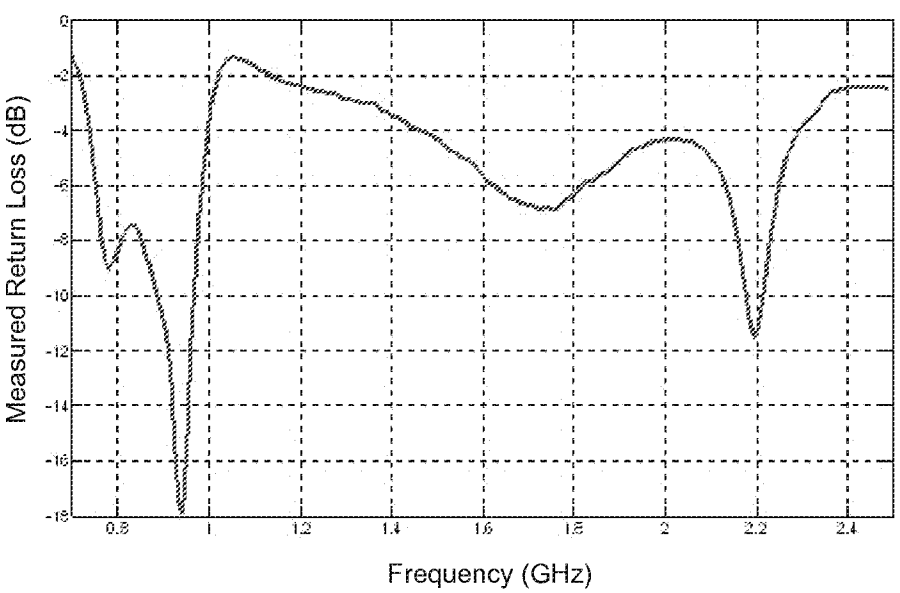
FIG. 42 shows the measured return loss of the fabricated SLM MTM antenna shown in FIG. 41.
Figure 41:
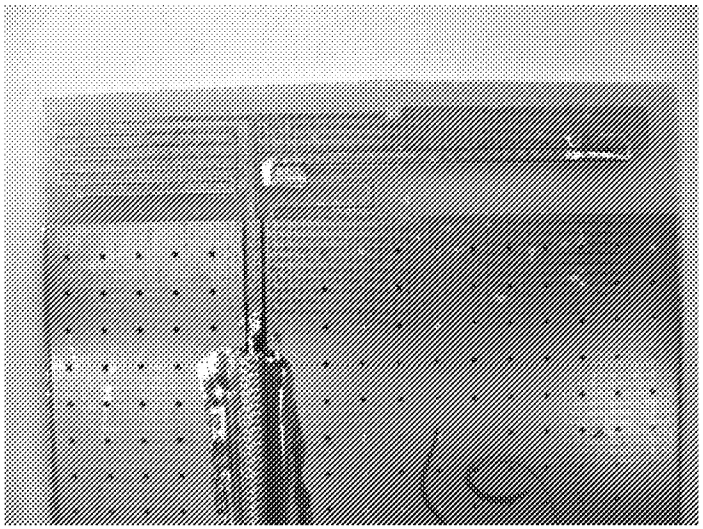
FIG. 41 shows a photo of the SLM MTM antenna (with meander) fabricated as shown in FIG. 39.

FIG. 41 shows a photo of the antenna prototype of the SLM penta-band MTM antenna with a meander line in FIG. 39, fabricated based on a 1 mm FR-4 board. FIG. 42 shows the measured return loss of the prototype. This antenna has a −6 dB return loss with the bandwidth of 240 MHz (760 MHz-1000 MHz) in the low band and 600 MHz bandwidth in the high band.

Figure 43A:
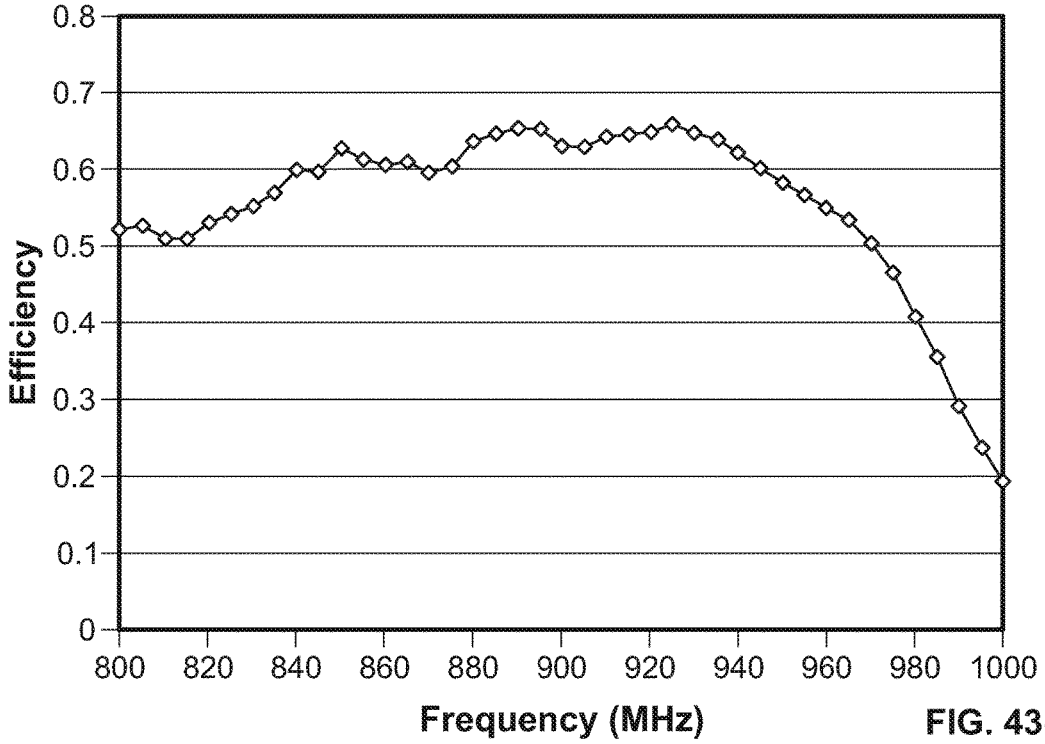
FIGS. 43(*a*) and 43(*b*) show the measured efficiency of the SLM MTM antenna shown in FIG. 41, plotting the cellular band efficiency and the PCS/DCS band efficiency, respectively.
Figure 43B:
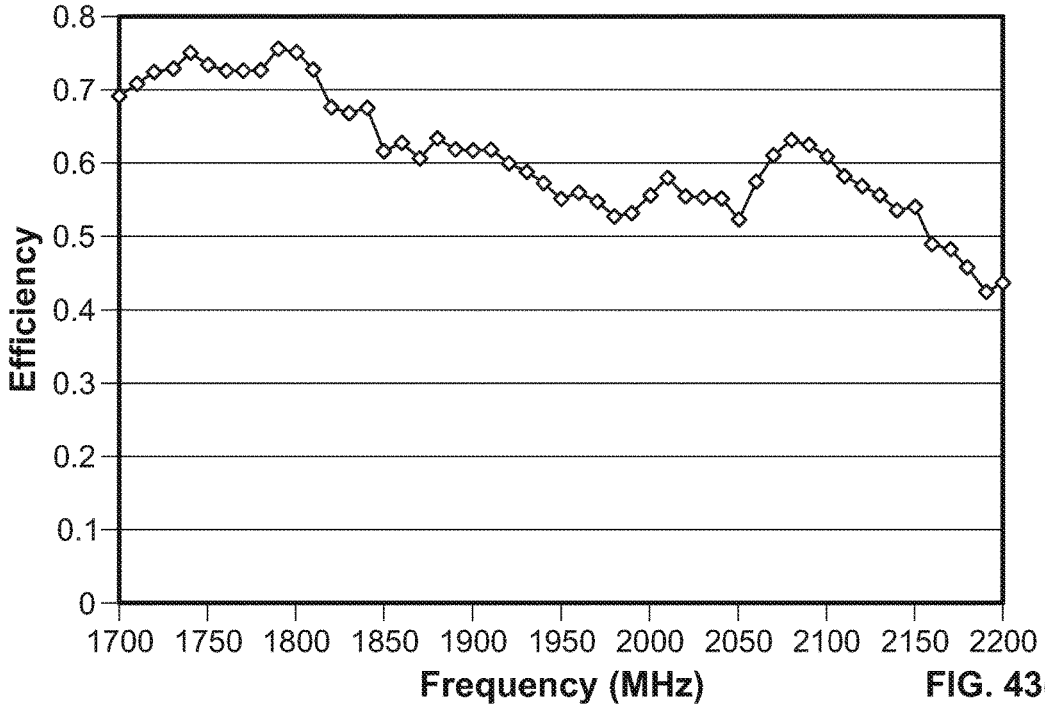

The measured efficiency is shown in FIGS. 43(*a*) and 43(*b*) for the low band and high band, respectively. The peak efficiency in the low-band is 66%, and a near constant 60% efficiency is achieved in the high band.

Figure 46:
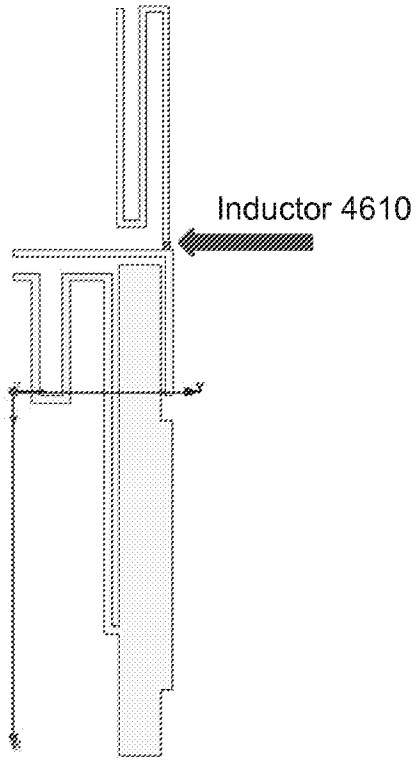
FIG. 46 shows the SLM MTM antenna with meander shown in FIG. 39 with a lumped inductor in the shortened meander line trace.
Figure 45:
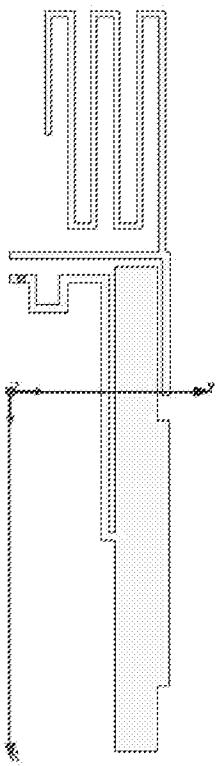
FIG. 45 shows the SLM MTM antenna with meander shown in FIG. 39 with a lumped inductor in the shortened via line trace.
Figure 44:
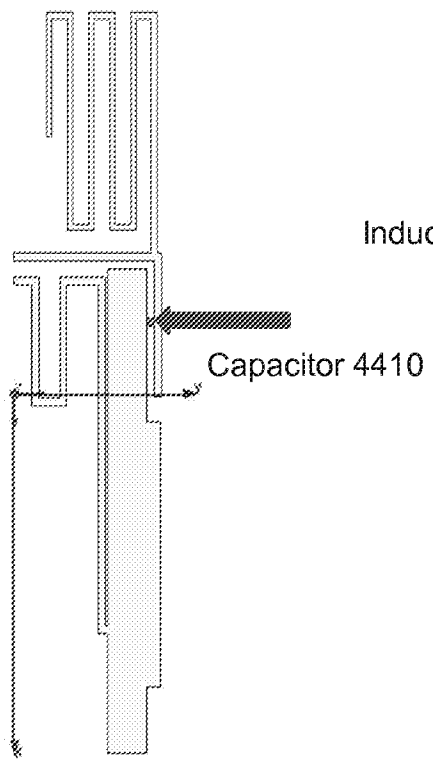
FIG. 44 shows the SLM MTM antenna with meander shown in FIG. 39 with a lumped capacitor between the launch pad and cell patch.

In many practical situations there are space constraints that require a certain routing of traces in the antenna structure. The antenna can be further compacted by using lumped circuit elements, such as capacitors or inductors, to augment the inductance and capacitance involved in the structure. FIGS. 44, 45 and 46 show such design examples where the SLM penta-band MTM antenna with a meander line in FIG. 39 is used.

In FIG. 44, the capacitance between the launch pad 3904 and the cell patch 3908 is enhanced by using a lumped capacitor 4410. In this example, the gap between the launch pad 3904 and cell patch 3908 is increased from 0.25 mm to 0.4 mm, and the reduced capacitance is compensated for by the added lumped capacitance of 0.3 pF. Instead of increasing the gap, the length of the gap can be reduced and the reduced capacitance can be compensated for by the added lumped capacitance.

In FIG. 45, a lumped inductor 4510 is added to the via line trace. The length of the via line 3912 is reduced by 24 mm, but the reduced inductance due to the shortened via line 3912 is compensated for by the added lumped inductance of 10 nH.

In FIG. 46, a lumped inductor 4610 is added and the length of the meander line 3952 is reduced. In this example, the inductor 4610 is coupled at the junction of the meander line 3952 and the launch pad 3904. By adding an inductance of 23 nH using the lumped inductor 4610, the printed meander line 3952 required to obtain the low resonance same as the one shown in FIG. 40 is now reduced from 84.8 mm to 45.7 mm.

Since lumped elements do not radiate, the lumped elements can be located at locations where there is little radiation to minimize the impact on the radiation efficiency of the antenna. For example, it is possible to obtain the same resonance with the meander line by adding the inductor 4610 at the beginning or end of the meander line. However, adding the inductor 4610 at the end of the meander line may significantly reduce the radiation efficiency because the end of the meander line has the highest radiation. It should be noted that these lumped element techniques can be combined to achieve further miniaturization.

Figure 47:
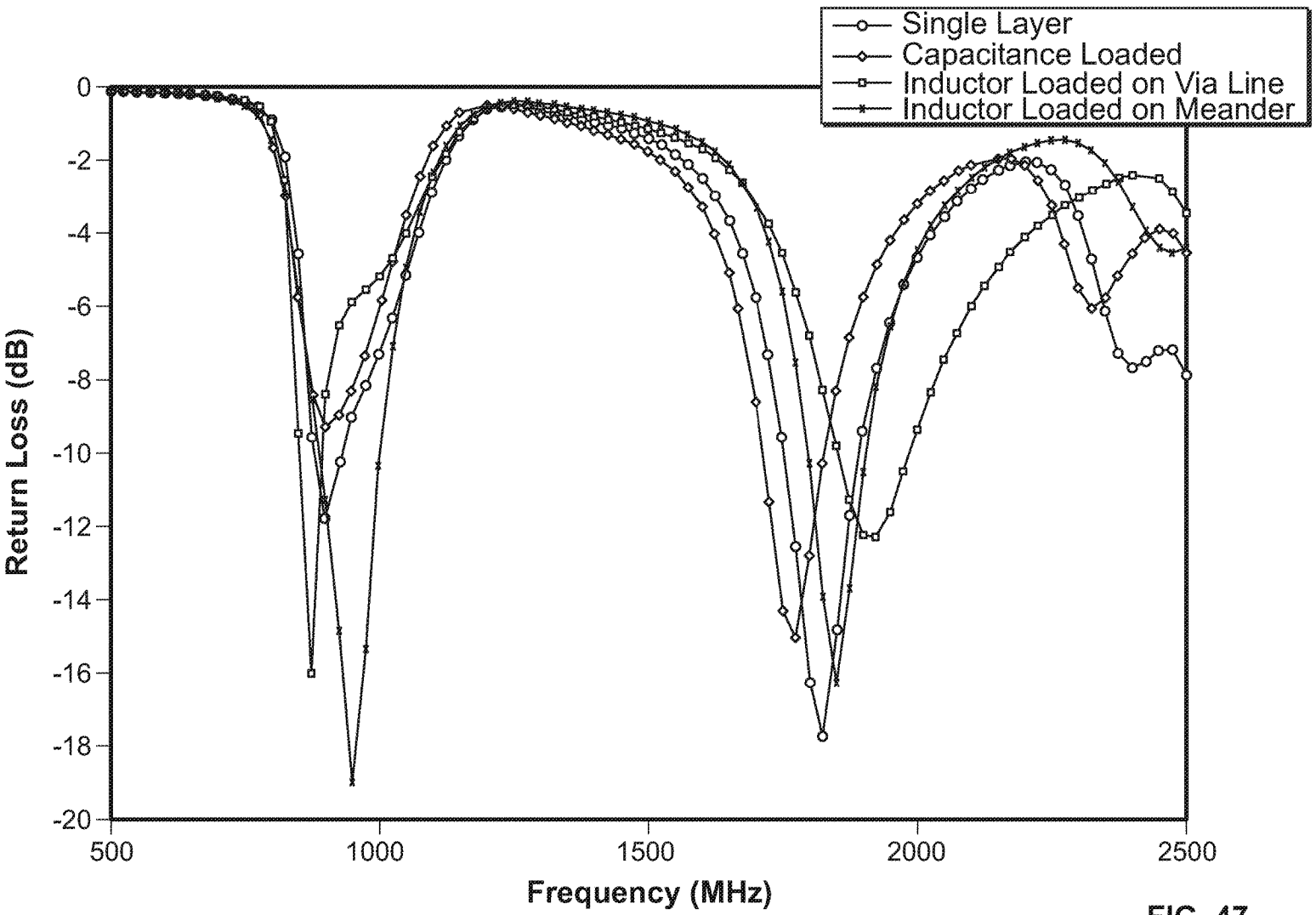
FIG. 47 shows the simulated return losses of the SLM MTM antenna with meander for the cases with the lumped capacitor in FIG. 44, with the lumped inductor in FIG. 45, with the lumped inductor in FIG. 46, and without any lumped element in FIG. 39.
Figure 48A:
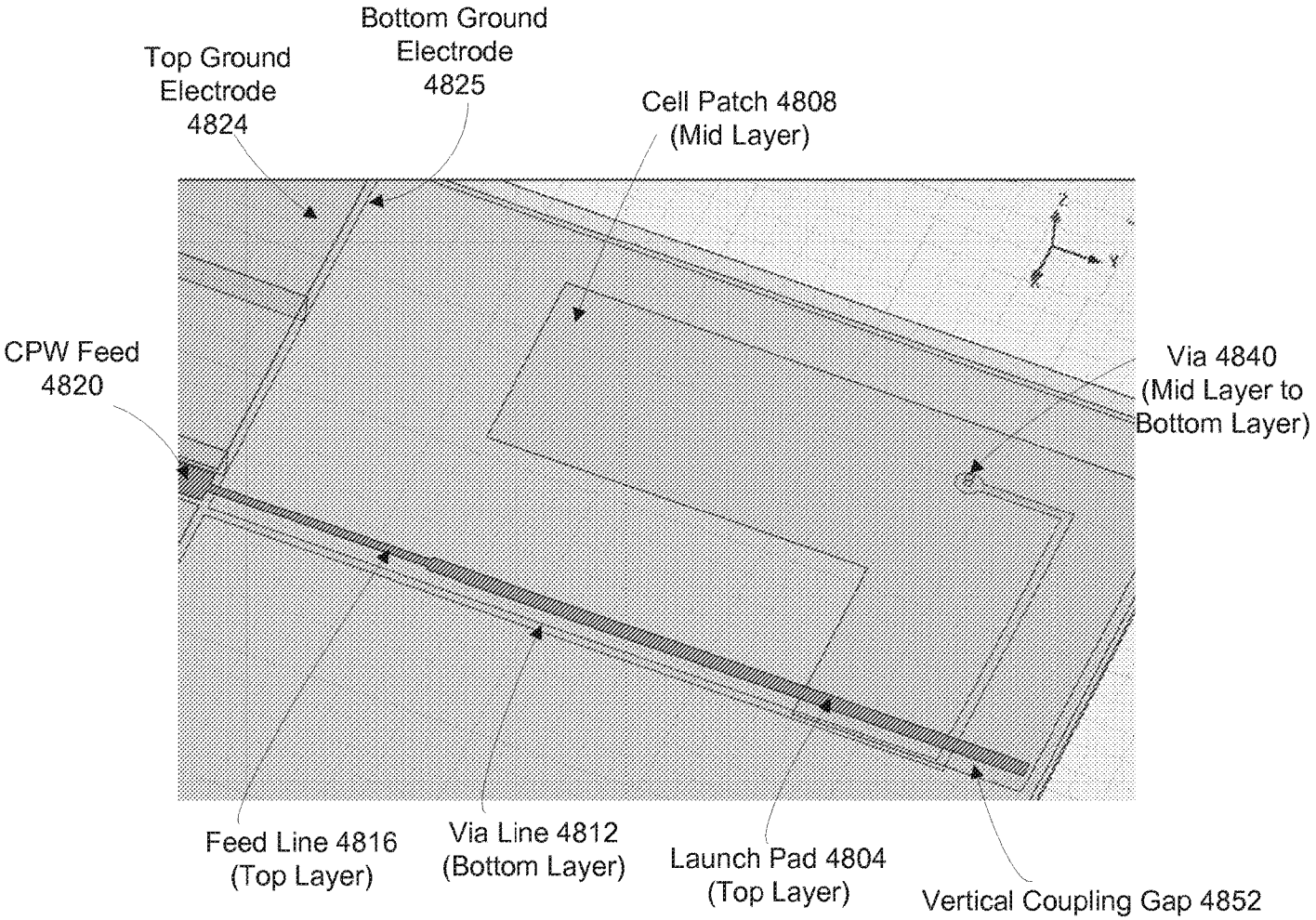
FIGS. 48(*a*)-48(*f*) show an example of a three-layer M™ antenna structure with a vertical coupling, illustrating the 3D view, top view of the top layer, top view of the mid-layer, top view of the bottom layer, top view of the top and mid layers overlaid, and the side view, respectively.
Figure 48B:
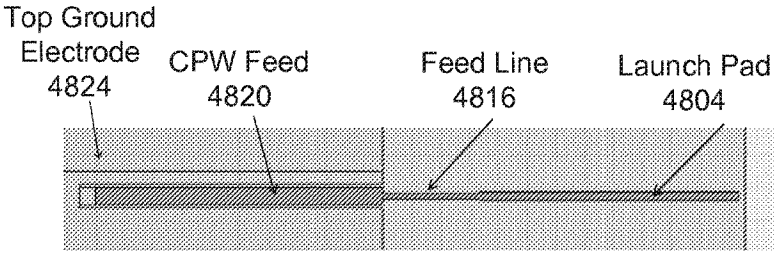
Figure 48C:
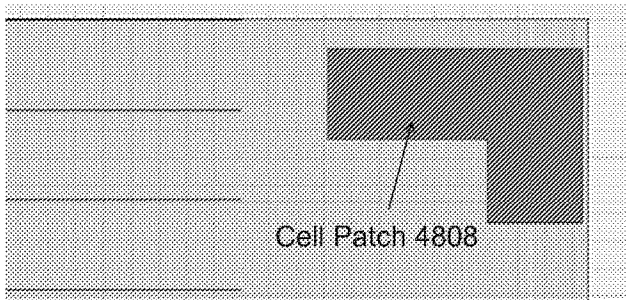
Figure 48E:
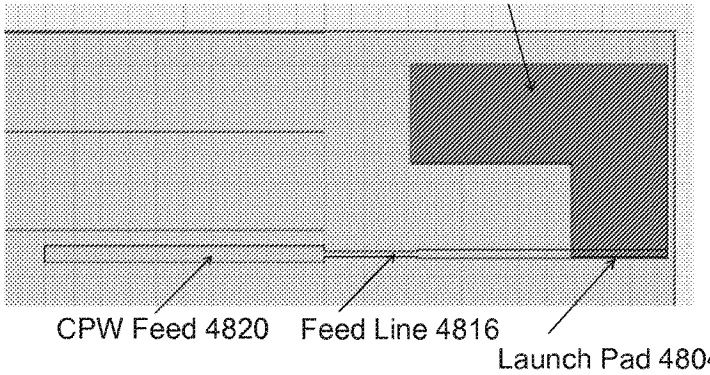
Figure 48D:
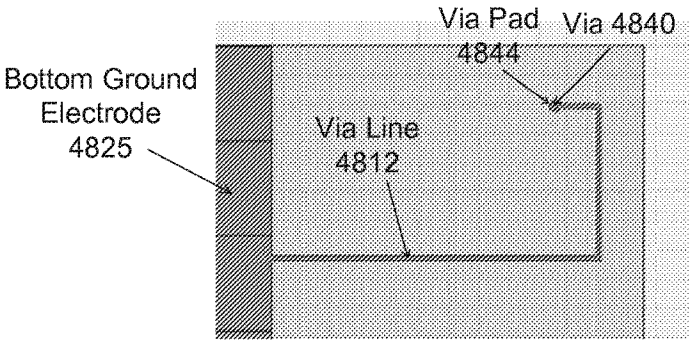
Figure 48F:
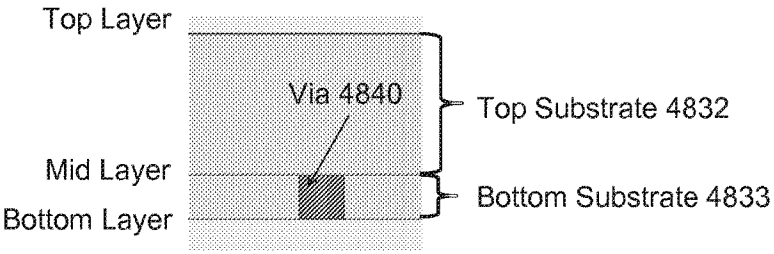

FIG. 47 shows the simulation results for the SLM penta-band MTM antenna loaded with the lumped elements described above. As evidenced in this figure, the bands and bandwidths similar to those in FIG. 40 can be obtained with the loading techniques described above.

In the SLM or TLM-VL MTM antenna examples described so far, the coupling structure for capacitive coupling between the launch pad and cell patch is implemented in a planar fashion, that is, both the launch pad and cell patch are located on the same layer and thus the coupling gap between the two is formed in the same plane. However, the coupling gap can be formed vertically, that is, the launch pad and cell patch can be located on two different layers, thereby forming a vertical, non-planar coupling gap in between.

An example of a three-layer MTM antenna with the vertical coupling between a cell patch and a launch pad at different layers is illustrated in FIGS. 48(*a*)-48(*f*), showing the 3D view, top view of the top layer, top view of the mid-layer, top view of the bottom layer, top view of the top and mid layers overlaid, and the side view, respectively. As shown in FIG. 48(*f*), this three-layer MTM structure comprises a top substrate 4832 and a bottom substrate 4833 that are stacked over each other to provide three metallization layers, the top layer on the top surface of the top substrate 4832, the middle layer between the two substrates 4832 and 4833, and the bottom layer on the bottom surface of the substrate 4833. In one implementation, the middle layer may 30 mil (0.76 mm) and the bottom layer is 1 mm. This keeps the overall thickness of 1 mm same as a two-layer structure.

The top layer includes a feed line 4816 that connects a CPW feed 4820 to a launch pad 4804. The CPW feed 4829 can be formed in a CPW structure that has a top ground electrode 4824 and a bottom ground electrode 4825. Both the feed line 4816 and launch pad 4804 have a rectangular shape with dimensions of 6.7 mm×0.3 mm and 18 mm×0.5 mm, respectively. The mid layer includes an L-shaped cell patch 4808 which may, in one implementation, have one section with dimensions of 6.477 mm×18.4 mm and the other section with dimensions of 6.0 mm×6.9 mm. A vertical coupling gap 4852 is formed between the launch pad 4804 on the top layer and the cell patch 4808 on the mid layer. A via 4840 is formed in the bottom substrate to couple the cell patch 4808 on the mid layer to a via line 4812 on the bottom layer through a via pad 4844. The via line 4812 on the bottom layer is shorted to the bottom ground electrode 4825 with two bends, as can be seen from FIG. 48(*d*).

Figure 49A:
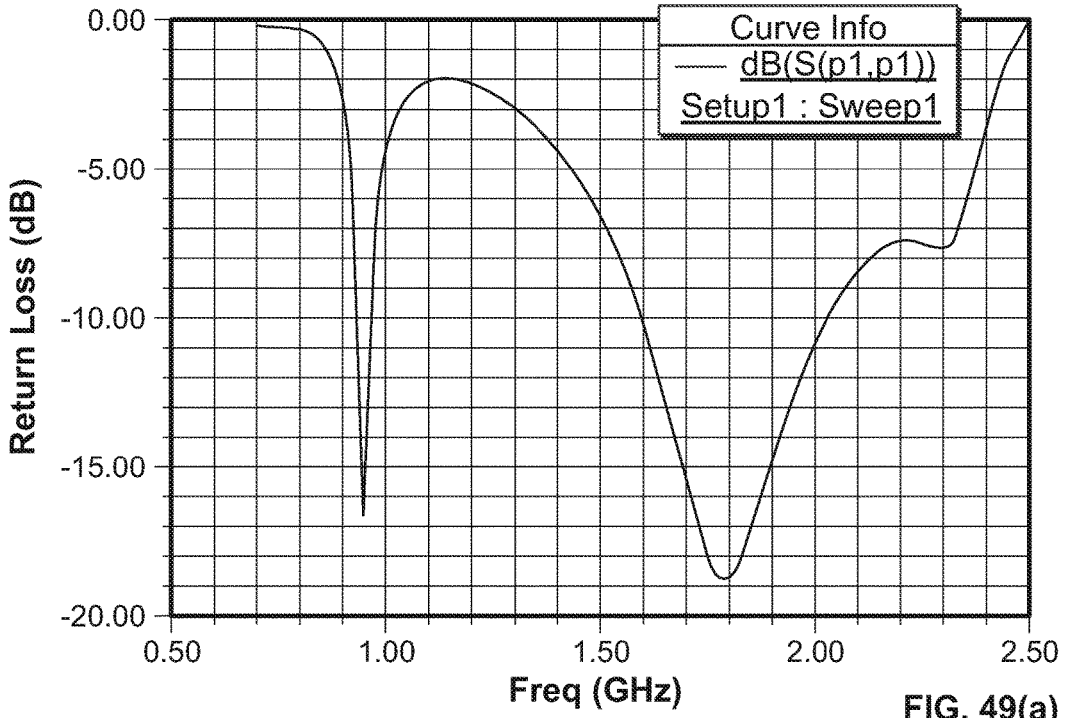
FIG. 49(*a*) shows the simulated return loss of the three-layer MTM antenna with the vertical coupling shown in FIGS. 48(*a*)-48(*f*).
Figure 49B:
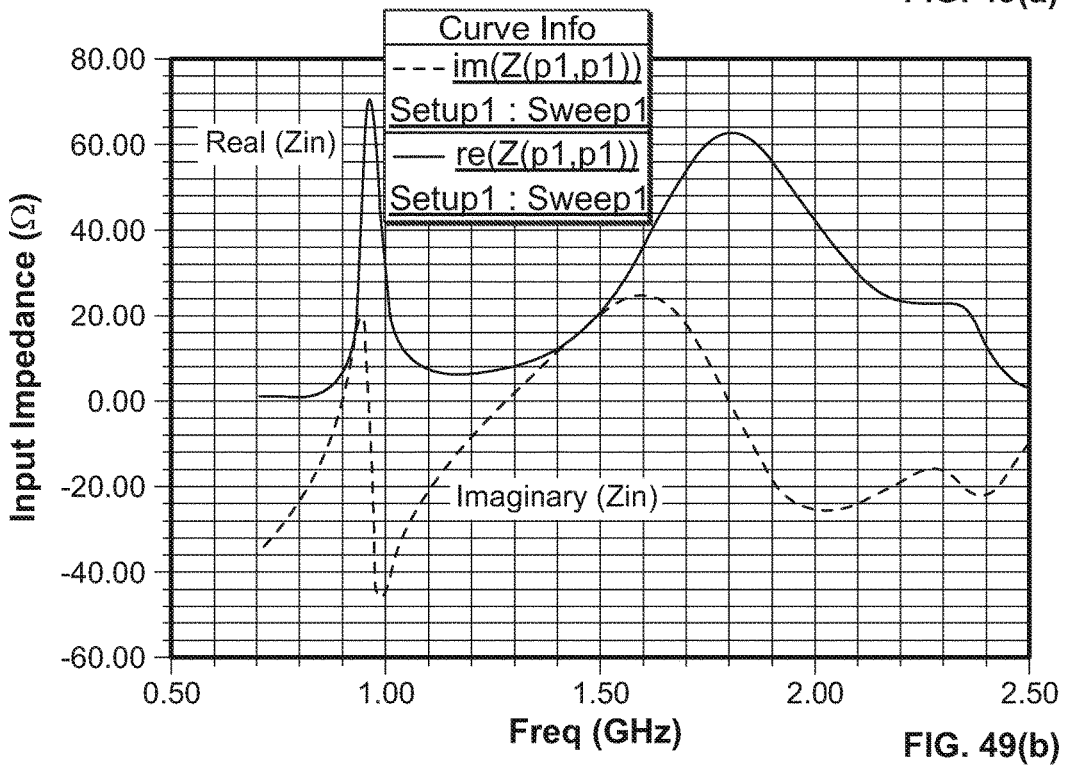

The simulated return loss of the three-layer MTM antenna with the vertical coupling is plotted in FIG. 49(*a*), which shows two bands at −6 dB return loss: the low band at 0.925-0.99 GHz and the high-band at 1.48-2.36 GHz.

The simulated input impedance of the three-layer M™ antenna with the vertical coupling is plotted in FIG. 49(*b*). Generally, a perfect 50Ω matching corresponds to Real(Zin)=50Ω and Imaginary(Zin)=0 within the operating frequency band, and implies good transfer of energy between the CPW feed and antenna. FIG. 49(*b*) shows that a good matching occurs near 950 MHZ in the low band (LH mode) and near 1.8 GHz in the high band (RH mode).

Figure 50A:
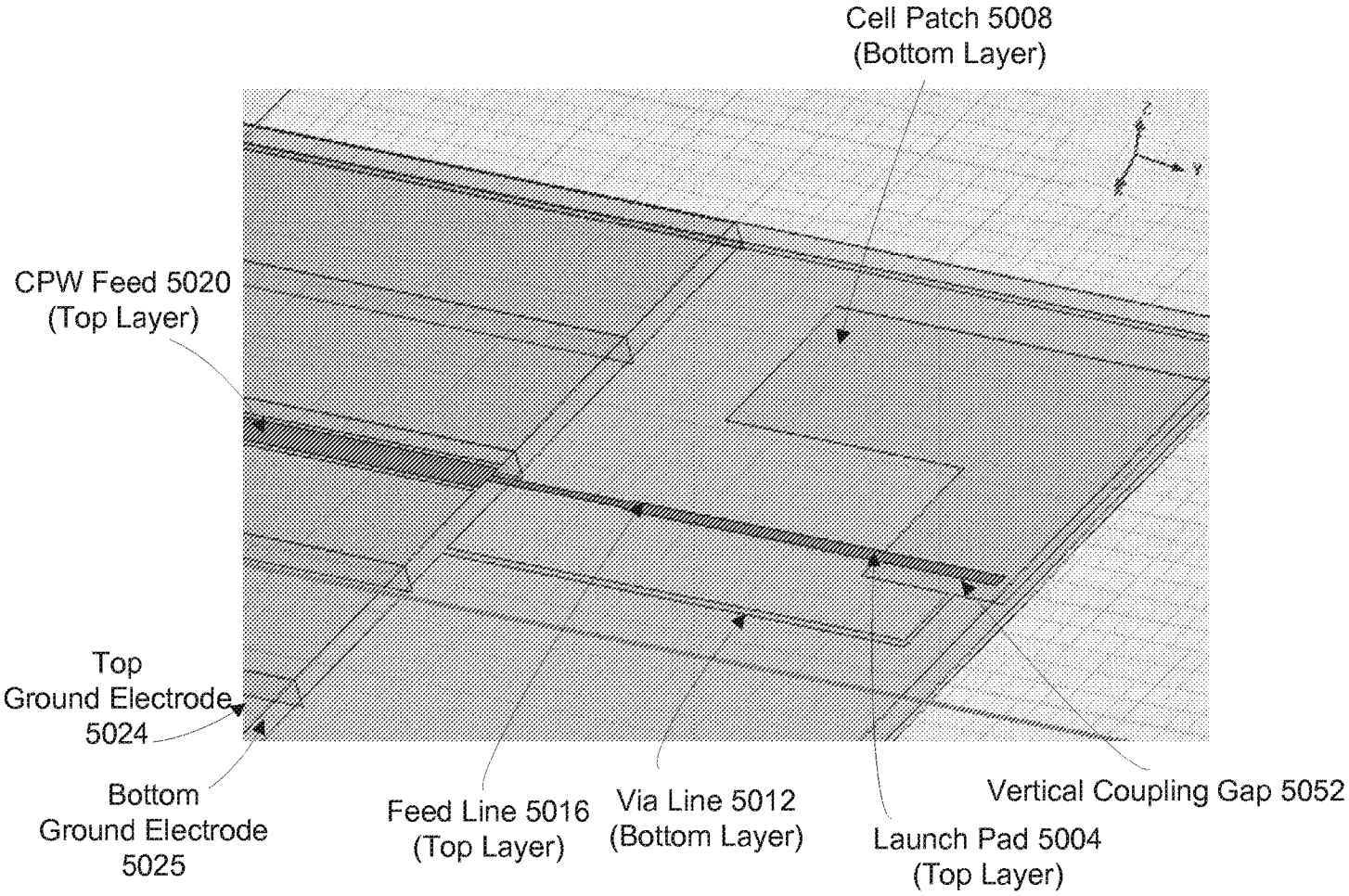
FIGS. 50(*a*)-50(*c*) show an example of a TLM-VL MTM antenna with the vertical coupling, illustrating the 3D view, top view of the top layer and top view of the bottom layer, respectively.
Figure 50B:
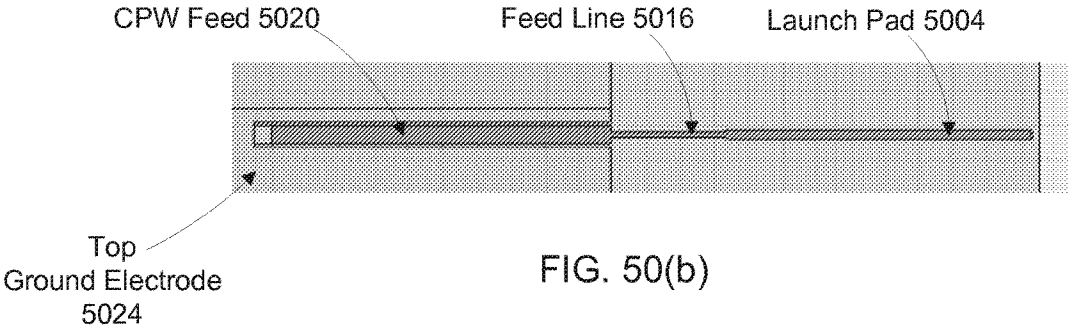
Figure 50C:
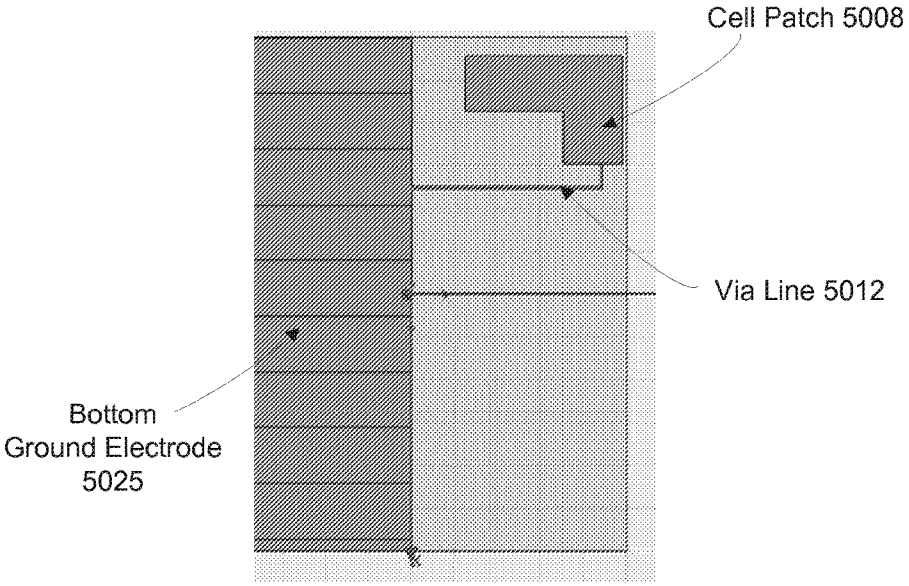

The three-layer MTM antenna with the vertical coupling described above can be modified to include only two layers without vias. An example of such a TLM-VL MTM antenna with the vertical coupling is illustrated in FIGS. 50(*a*)-50(*c*), showing the 3D view, top view of the top layer and top view of the bottom layer, respectively. This TLM-VL MTM antenna includes a launch pad 5004 on the top layer and a cell patch 5008 on the bottom layer. A feed line 5016 connects the launch pad 5004 to the CPW feed 5020 formed in the top ground electrode 5024 on the top layer. The vertical coupling gap 5052 is formed between the launch pad 5004 on the top layer and the cell patch 5008 on the bottom layer. Different from the three-layer counterpart, this TLM-VL MTM antenna has a via line 5012 on the same bottom layer as the cell patch 5008 and directly connects the cell patch 5008 to the bottom ground electrode 5025.

Figure 51A:
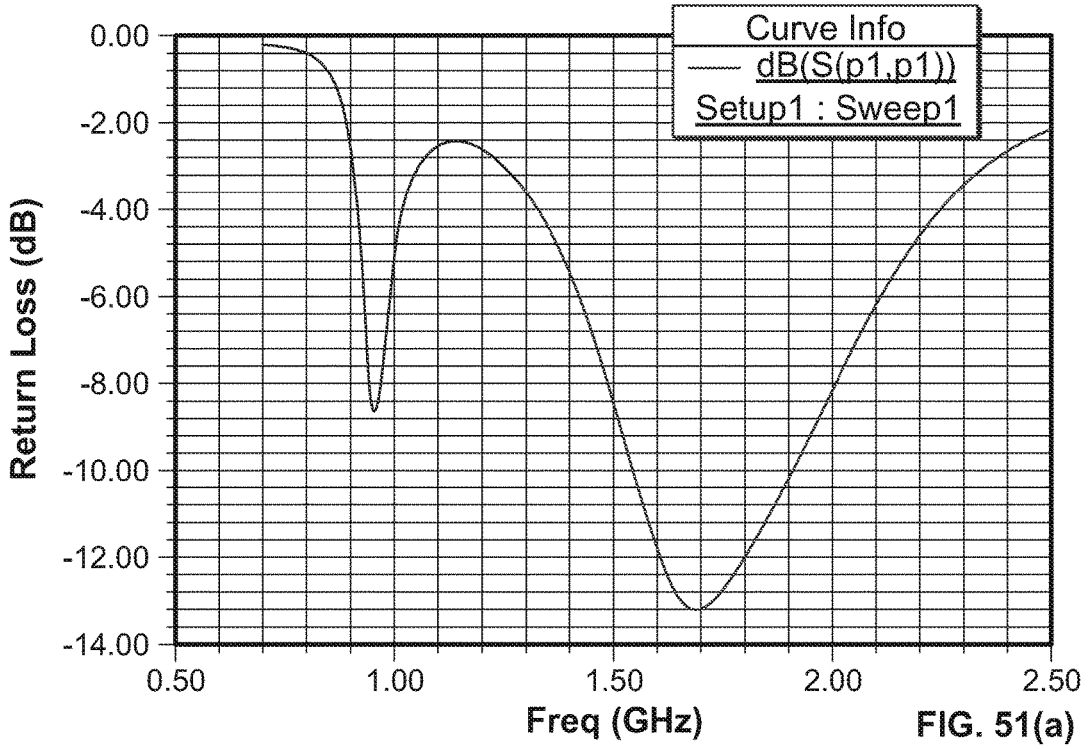
FIG. 51(*a*) shows the simulated return loss of the TLM-VL MTM antenna with the vertical coupling shown in FIGS. 50(*a*)-50(*c*).
Figure 51B:
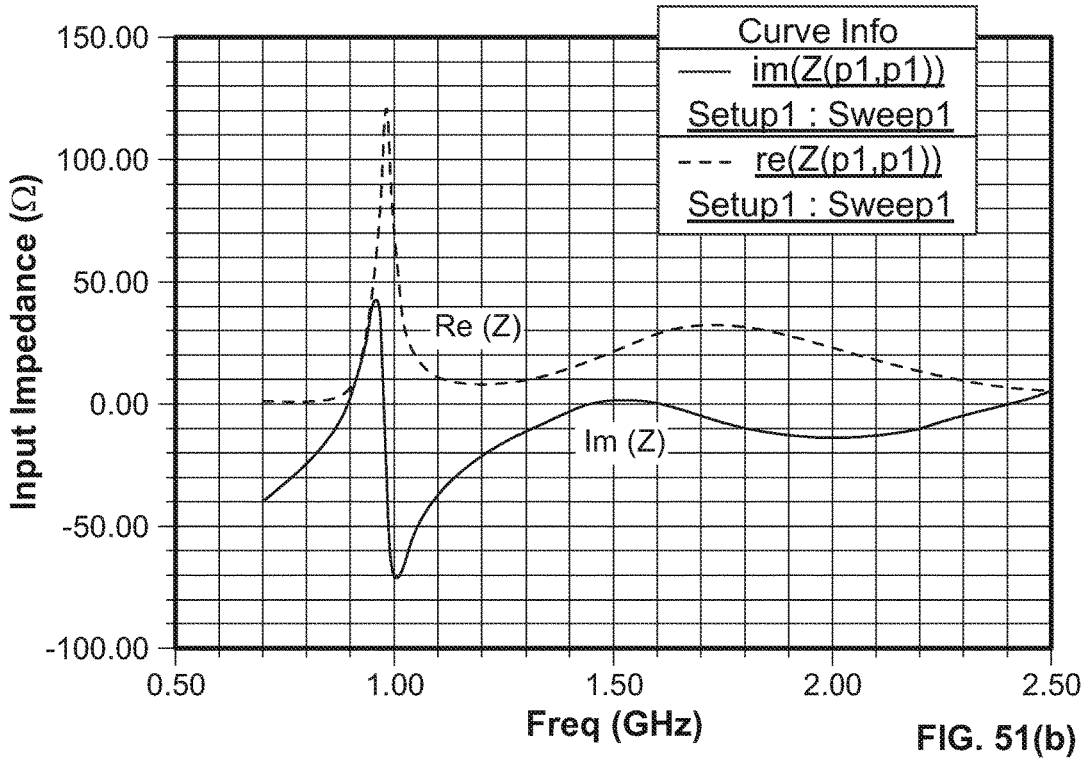

The simulated return loss of the TLM-VL MTM antenna with the vertical coupling is plotted in FIG. 51(*a*), which shows low and high bands. The bandwidth of the high band is narrower than that for the three-layer counterpart, as can be seen upon comparing FIG. 49(*a*) and FIG. 51(*a*).

The simulated input impedance of the TLM-VL MTM antenna with the vertical coupling is plotted in FIG. 51(*b*), which shows that a good matching occurs near 950 MHZ in the low band (LH mode) but not in the high band (RH mode).

Based on the above examples, various CRLH MTM structures can be constructed. One example is a metamaterial device that includes a dielectric substrate having a first surface and a second, different surface; and a composite left and right handed (CRLH) metamaterial structure formed on the substrate. This structure includes a ground electrode on the first surface; a cell patch on the first surface and spaced from the ground electrode; a via line coupling the cell patch with the ground electrode; and a feed line on the first surface and electromagnetically coupled to the cell patch through a gap to direct a signal to or from the cell patch. In one configuration, this structure also includes a cell patch extension formed on the second surface and a conductive via penetrating the substrate to connect the cell patch on the first surface to the cell patch extension on the second surface. In another configuration, this structure can further include a launch pad formed on the first surface and positioned between the feed line and the cell patch. The launch patch is spaced from and electromagnetically coupled to the cell patch and connected to the feed line. A launch pad extension is formed on the second surface and a conductive via that penetrates the substrate to connect the launch pad on the first surface to the launch pad extension on the second surface.

Another example for a metamaterial device is a CRLH MTM structure formed on a dielectric substrate having a first surface and a second, different surface. This MTM structure includes a cell patch on the first surface; a top ground electrode spaced from the cell patch and located on the first surface; a top via line on the first surface having a first end connected to the cell patch and a second end connected to the top ground electrode; and a bottom cell ground electrode formed on the second surface beneath the cell patch on the first surface. The bottom cell ground electrode is not directly connected to the cell patch through a conductive via that penetrates through the substrate. This MTM structure also includes a bottom ground electrode formed on the second surface spaced from the bottom cell ground electrode; a bottom via line on the second surface having a first end connected to the bottom cell ground electrode and a second end connected to the bottom ground electrode; a launch pad on the first surface spaced from the cell patch by a gap to electromagnetically coupled to the cell patch; and a feed line connected to the launch pad to direct a signal to or from the cell patch. The second surface is free of a metallization area underneath the cell patch on the first surface.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. However, it is understood that variations and enhancements may be made.

What is claimed is:

1. A metamaterial device, comprising:

a dielectric substrate having a first surface and a second, different surface;

a first metallization layer formed on the first surface; and a second metallization layer formed on the second surface, wherein the first and second metallization layers are patterned to have two or more conductive parts including one or more cell patches on the first metallization layer to form a composite left and right handed (CRLH) metamaterial structure that comprises one or more unit cells, each of which is free of a conductive via structure traversing the dielectric substrate to connect the first metallization layer and the second metallization layer, and wherein the second metallization layer includes:

a bottom ground electrode located outside a footprint of the one or more cell patches;

a cell ground electrode located underneath a first cell patch amongst the one or more cell patches and electromagnetically coupled to the first cell patch without being connected to the first cell patch by a conductor that penetrates through the substrate, the cell ground electrode separated from the bottom ground electrode; and a conductive line that connects the cell ground electrode to the bottom ground electrode;

wherein the dielectric substrate is shaped to conform to a curved or bent shape of another structure.

2. The device as in claim 1, wherein the dielectric substrate is attached to the structure to which the dielectric substrate is shaped to conform.

3. The device as in claim 2, wherein the dielectric substrate is not flat.

4. The device as in claim 2, wherein the dielectric substrate is flexible.

5. The device as in claim 1, wherein:

the first metallization layer comprises a launch pad positioned close to and spaced from the first cell patch amongst the one or more cell patches, to electromagnetically couple to the first cell patch, and a feed line connected to the launch pad to direct a signal to or receive a signal from the first cell patch via the launch pad;

wherein the first cell patch, the launch pad and the cell ground electrode form a first unit cell amongst the one or more unit cells.

6. The device as in claim 1, wherein the two or more conductive parts are configured to generate two or more frequency resonances.

7. The device as in claim 6, wherein the two or more frequency resonances include a first frequency resonance in a low band and a second frequency resonance in a high band, the first frequency resonance being a left-handed (LH) mode frequency resonance and the second frequency resonance being a right-handed (RH) mode frequency resonance.

8. The device as in claim 6, wherein at least two out of the two or more frequency resonances are sufficiently close to collectively produce a broadband.

9. The device as in claim 1, wherein the cell ground electrode comprises a truncated ground formed on the second surface underneath the first cell patch amongst the one or more cell patches, the truncated ground electromagnetically coupled to the first cell patch through a portion of the dielectric substrate sandwiched between the first cell patch and the truncated ground;

where the conductive line comprises a via line formed on the second surface, the via line coupling the truncated ground with the bottom ground electrode; and wherein the device includes a feed line electromagnetically coupled to the first cell patch through a gap to direct an antenna signal to or from the first cell patch.

10. The device as in claim 9, wherein the bottom ground electrode includes an extended portion added to be closer to the first cell patch than the bottom ground electrode without the extended portion.

11. The device as in claim 10, wherein the bottom ground electrode, the first cell patch, the truncated ground, the feed line, the via line, and the gap are configured to generate frequency resonances for a quad-band operation.

12. The device as in claim 9, wherein the first cell patch is shaped and configured to increase a length of the gap.

13. The device as in claim 9, wherein a location where the via line is attached to the bottom ground electrode is determined with respect to a feed location to enhance matching.

14. The device as in claim 9, wherein the bottom ground electrode includes an extended portion configured to enhance matching.

15. The device as in claim 9, further comprising a conductive line attached to the feed line on the first surface, wherein the bottom ground electrode, the first cell patch, the truncated ground, the via line, the gap, the feed line, and the conductive line are configured to generate frequency resonances for a penta-band antenna operation.

16. The device as in claim 15, wherein the conductive line has a meander shape.

17. The device as in claim 15, wherein the conductive line has a spiral shape.

18. The device as in claim 9, further comprising a capacitor that couples the first cell patch and the feed line, wherein one or more of a width of the gap is increased or a length of the gap is decreased as compared to one or more of the width or the length of the gap in the absence of the capacitor based on a capacitance value of the capacitor.

19. The device as in claim 9, further comprising an inductor inserted in the via line, wherein a length of the via line is shortened as compared to the length of the via line in the absence of the inductor based on an inductance value of the inductor.

20. The device as in claim 1, further comprising a lumped element coupled to the two or more conductive parts.

21. The device as in claim 1, wherein the two or more conductive parts include:

a top ground electrode formed on the first surface;

a via line formed on the first surface, the via line coupling the first cell patch amongst the one or more cell patches with the top ground electrode; and a feed line formed on the second surface, the feed line electromagnetically coupled to the first cell patch through a portion of the dielectric substrate sandwiched between the feed line and the first cell patch to direct an antenna signal to or from the first cell patch.

22. The device as in claim 21, wherein the top ground electrode, the first cell patch, the via line, and the feed line are configured to generate frequency resonances suited for a quad-band operation.

23. The device as in claim 22, wherein the frequency resonances include an LH mode frequency resonance in a low band of the quad-band.

24. The device as in claim 1, wherein the one or more cell patches includes the first cell patch and a second cell patch spaced from each other by a gap and electromagnetically coupled to each other over the gap;

a top ground electrode comprising a main ground electrode area and a ground electrode extension connected to the main ground electrode area as an extension of the main ground electrode, the ground electrode extension being shaped and positioned to have a first part spaced from the first cell patch by a distance and a second part spaced from the second cell patch by substantially the same distance;

in the first metallization layer, a first via line coupling the first cell patch to the first part of the ground electrode extension;

in the first metallization layer, a second via line coupling the second cell patch to the second part of the ground electrode extension with a length substantially equal to the first via line; and in the first metallization layer, a feed line electromagnetically coupled to one of the first and second cell patches through a gap to direct a signal to or from the one of the first and second cell patches.

25. The device as in claim 24, wherein the single-layer CRLH MTM structure is configured to generate two left-handed (LH) mode frequency resonances.

26. The device as in claim 24, wherein the two or more conductive parts of the metamaterial structure are structured to form a metamaterial transmission line and are positioned and sized to generate two or more frequency resonances at which the metamaterial transmission line operates.

27. The device as in claim 1, wherein the dielectric substrate is shaped to conform to a curved shape of another structure.

28. The device as in claim 1, wherein the dielectric substrate is shaped to conform to a bent shape of another structure.

29. The device as in claim 1, wherein the dielectric substrate is shaped to conform to a wall of a housing of a product, a surface of an antenna carrier, or a contour of a device package.

* * * * *